US007094514B2

(12) United States Patent
Serizawa et al.

(10) Patent No.: US 7,094,514 B2
(45) Date of Patent: Aug. 22, 2006

(54) IMAGE FORMING METHOD

(75) Inventors: Manabu Serizawa, Minamiashigara (JP); Hidekazu Yaguchi, Minamiashigara (JP); Tsutomu Kubo, Minamiashigara (JP); Kazuhiko Yanagida, Minamiashigara (JP); Shigeru Seitoku, Minamiashigara (JP); Yasuo Matsumura, Minamiashigara (JP); Sueko Sakai, Minamiashigara (JP); Hiroyuki Tanaka, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 77 days.

(21) Appl. No.: 10/660,614

(22) Filed: Sep. 12, 2003

(65) Prior Publication Data

US 2004/0185367 A1 Sep. 23, 2004

(30) Foreign Application Priority Data

Mar. 10, 2003 (JP) ..... 2003-062888
Jun. 9, 2003 (JP) ..... 2003-163390

(51) Int. Cl.
*G03G 9/08* (2006.01)

(52) U.S. Cl. ..... 430/126; 430/111.4; 430/108.6

(58) Field of Classification Search ..... 430/126, 430/124, 110.3, 111.4, 108.6
See application file for complete search history.

(56) References Cited

U.S. PATENT DOCUMENTS 2,297,691 A * 10/1942 Carlson ..... 430/55
5,273,852 A * 12/1993 Takenouchi et al. ..... 430/96
6,002,903 A * 12/1999 Hayase et al. ..... 430/126
6,336,026 B1 * 1/2002 Heeks et al. ..... 399/302
2003/0039913 A1 * 2/2003 Kadokura et al. ..... 430/124

FOREIGN PATENT DOCUMENTS

| | | |
|---|---|---|
| JP | A 62-105151 | 5/1987 |
| JP | A 63-216055 | 9/1988 |
| JP | A 63-282752 | 11/1988 |
| JP | A 63-311263 | 12/1988 |
| JP | A 3-172852 | 7/1991 |
| JP | A 6-250439 | 9/1994 |
| JP | A 9-179467 | 7/1997 |
| JP | 10260601 A * | 9/1998 |
| JP | A 10-282696 | 10/1998 |
| JP | B2 3141783 | 12/2000 |
| JP | A 2001-154390 | 6/2001 |
| JP | A 2002-62683 | 2/2002 |
| JP | A 2002-62777 | 2/2002 |
| JP | A 2002-221886 | 8/2002 |

OTHER PUBLICATIONS

Diamond, Arthur S. (ed.) Handbook of Imaging Materials. New York: Marcel-Dekker, Inc. (1991) pp. 160-162, 178.*

* cited by examiner

*Primary Examiner*—Christopher Rodee
(74) *Attorney, Agent, or Firm*—Oliff & Berridge, PLC

(57) ABSTRACT

The present invention relates to an image forming method wherein the surface of an electrophotographic photoreceptor contains a compound having an unsaturated double bond, a toner for electrostatic latent image development has a binder resin obtained by polymerizing a polymerizable monomer having a vinyl double bond, has at least one kind of metal oxide particles and/or metal nitride particles on the surface of the toner and has a shape factor SF1 of 110 to 140, and the storage of elastic modulus at 160° C. (G'(160)) of the toner for electrostatic latent image development is in a predetermined range.

19 Claims, 1 Drawing Sheet

IMAGE FORMING METHOD

CROSS-REFERENCE TO RELATED APPLICATION

This application claims priority under 35 USC 119 from Japanese patent Application Nos. 2003-62888 and 2003-163390, the disclosure of which is incorporated by reference herein.

BACKGROUND OF THE INVENTION

1. Field of the Invention

The present invention relates to an image forming method wherein an electrostatic latent image formed by electrophotography, electrostatic recording etc. is visualized through the steps of development, transfer and fixation to give a suitable image.

2. Description of the Related Art

A method of visualizing image information via an electrostatic latent image, such as an electrophotographic method etc., is used in various fields. In the electrophotographic method, an electrostatic latent image on an electrophotographic photoreceptor (electrostatic latent image bearing body, also referred to hereinafter as "photoreceptor") after a charging step, a light exposure step etc. is developed with a toner for electrostatic latent image development (also referred to hereinafter as "toner") and visualized through a transfer step, a fixing step etc.

A process of producing a toner by an emulsion-polymerization aggregation process in which the shape and surface structure of the toner are intentionally regulated has been proposed as a countermeasure to the broad distribution of particle sizes, irregular shapes, and insufficient durability of performance in a process of producing a toner by a kneading-pulverizing process (see, for example, Japanese Patent Application Laid-Open (JP-A) Nos. 63-282752 and 6-250439).

The emulsion-polymerization aggregation process generally means a process wherein a resin dispersion is prepared by emulsion polymerization, while a colorant dispersion having a colorant dispersed in a solvent is prepared, and the resin dispersion is mixed with the colorant dispersion, to form aggregated particles having particle sizes corresponding to the toner particle size, and then the aggregated particles are coalesced and united by heating to form a toner, and there is proposed a means of realizing more accurate regulation of a particle structure by arbitrarily regulating the internal structure of the toner from an inner layer to a surface layer (see, for example, Japanese Patent No. 3141783).

By the methods easily realizing a smaller diameter of toner and accurate regulation of a particle structure, image qualities in an electron photograph are significantly improved, and simultaneously higher reliability can also be achieved.

As digitalization and coloring advance in recent years, an image forming method by electrophotography using the toner and developing agent technology described above is now applied in some fields of printing, and coming to be practically used in the graphic arts market, for example, in on-demand-printing. The graphic arts market is defined as a market whose targets are business and divisions involved in producing printings, including tracing, copying, and reproduction, which is a business relating to production of prints employing a large-scale production system, of a small number of created printings such as wood-cut prints, of original writings and paintings.

However, when compared with the original and orthodox conventional printing, the electrophotographic methods satisfies the feature of on-demand-printing as non-planographic printing, but there remain various problems to be solved for improving the market value as producer goods of products particularly in the field of graphic arts from the viewpoint of performance in respect of color regeneration, resolution, image qualities, typically gloss, feel of the material, uniform qualities in the same image, and duration of image qualities in continuous printing for a long time.

For example, the resolution tends to be limited not only by an image processing system, a photoreceptor, and a system for light exposure, but also by the particle diameter and distribution of toners, but it is a serious technical problem to use small-diameter toners effectively and reliably in the steps of charging, development, transfer, fixation and cleaning.

To solve these problems, it is necessary to develop a carrier for uniformly charging the small-diameter toner, design of a charging blade and a charging roll, a development system for achieving higher image density without background stain, a transfer system for realizing accurate transfer at high efficiency, a fixing system for various kinds of paper compatible with the small-diameter toner, and a cleaning system for removing the small-diameter toner completely from the surface of a photoreceptor or an intermediate transfer material (transfer material) to realize stable image qualities.

For improving uniformity of a single image and for solving defects, it is important to regulate uniformity of the development performance of a developing agent in an image forming system. A highly durable developing agent with less dependence on environments such as temperature and humidity, which shows stable charging in continuous printing of several thousands copies of uniform images and keeps stable and uniform development, is necessary for meeting the demand for maintainance of image qualities in the market of printing.

As an electrophotographic photoreceptor for the development system, on the other hand, a photoreceptor using an easily producible, organic photoconductive material as a photosensitive layer is proposed and practically used. The photoconductive material is classified roughly into positive hole transporting one and charge transporting one, and as the organic photoconductive material, the positive hole transporting material can easily achieve higher performance, and thus a negatively charged laminated photoreceptor using an positive hole transporting material in a charge transporting layer laminated on the surface of a charge generating layer is widely used.

In the charge transporting layer, polycyclic aromatic compounds such as anthracene and pyrene, nitrogen-containing heterocyclic compounds such as carbazole and imidazole, hydrazone derivatives, stilbene derivatives, triphenyl amine derivatives, tetraphenyl benzidine derivatives etc. are used as the charge transporting materials, and as the materials, compounds having a large number of aliphatic double bonds in addition to aromatic rings are generally used to improve charge transportation. However, such aliphatic double bonds are easily oxidized, and in particular, the surface of the photoreceptor is very liable to oxidized with strongly oxidizing ozone, nitrogen oxides etc. upon corona discharge etc., resulting in a change in potential, sensitivity etc. to deteriorate the performance of the photoreceptor.

One the other hand, there are reported electrophotographic photoreceptors to which antioxidants, stabilizers etc., for example a compound having a triazine ring and a hindered phenol skeleton, trialkyl amine, an aromatic amine compound, an amine compound, an amide compound, and hindered amine or hindered amide compound are added to prevent oxidization and deterioration of the surfaces of the photoreceptors (see, for example, JP-A Nos. 62-105151, 63-4238, 63-216055, 3-172852 and 10-282696).

However, the toner used in visualization in the development step of visualizing the above electrostatic latent image is blended usually with external additives, for example inorganic metal oxides such as silica and titania for the purpose of improving and regulating powdery flowability, charging etc. or with similar inorganic metal oxides as internal additives for the purpose of improving fixation, or with magnetic powders such as ferrite especially in the case where the toner is a magnetic toner, so that these metal oxides collide with and adhere to the photoreceptor at the time of development thereby shaving the surface layer of the photoreceptor. Further, the toner, inorganic metal oxides etc. remaining on the surface of the photoreceptor in the cleaning step are pushed by a blush or a blade against the surface of the photoreceptor, thereby further shaving the surface layer of the photoreceptor. The surface layer of the photoreceptor undergoes gradual oxidation and abrasion repeatedly, resulting in a deterioration in the performance of the photoreceptor. This tendency is significant particularly in the filed of graphic arts where the amount of the toner used at one time is high.

Improvement in the abrasion resistance of the charge transporting layer on the surface of the photoreceptor is attempted by usually incorporating not only the charge transporting material but also a binder resin such as polycarbonate resin, polyacrylate resin and polyester resin, and by further providing the surface of the charge transporting layer with a surface protective layer of e.g. a polysiloxane compound having relatively high hardness (see, for example, JP-A Nos. 2001-154390, 2002-62777 and 2002-221886). However, inorganic metal oxides used as external additives on the toner surface are usually fine particles of 20 nm or less having higher hardness than the binder resin and the surface protective layer, so that durability can be improved to a certain degree but is not fundmentally improved at present.

Further, there is a method wherein the adhesion property of external additives to the toner is controlled to regulate the amount of the free external additives for the purpose of improving the durability of the photoreceptor, or the adhesion strength of external additives to the surface of the toner is increased to a certain degree to prevent the external additives from becoming spent (see, for example, JP-A Nos. 9-179467 and 2002-62683). However, this method leads to a reduction in the original effect of the external additives of improving the flowability of the toner, thus causing problems such as blocking of the toner in a development device.

As the transfer system, an electrostatic transfer system is generally used in electrophotography at present, but in the case of a color image using a toner image thickened by overlapping colors, optimization for precisely regulating the behavior of the toner in an electric field is necessary in the toner material and in the transfer system in order to prevent image deterioration due to the toner scattered during transfer. As the transfer system, there are a system of directly transferring a toner image on a photosensitive drum onto a recording material such as paper and a system of transferring an image via an intermediate transfer material (transfer material).

Generally, the intermediate transfer material comprises a circulating endless belt, a part of which contacts with a photosensitive drum and another part of which contacts with a transfer member etc. in an image forming device. In transfer via the intermediate transfer material, a toner image formed on the surface of the photosensitive drum is transferred at a primary transfer position onto the intermediate transfer material, and the toner image transferred onto the surface of the intermediate transfer material is then delivered by a circulating belt onto a secondary transfer position and transferred at the secondary transfer position onto a recording material such as paper.

The material of the endless belt used as the intermediate transfer material includes, for example polycarbonate resin, polyvinylidene fluoride resin, polyalkylene phthalate resin and an electroconductive material mixed with resin, and as the material excellent in mechanical characteristics, thermosetting polyimide materials are proposed (see, for example, JP-A No. 63-311263).

However, the surface of these resins is generally low in strength and liable to be abraded or scarred. In particular, fine particles of metal oxides such as silica, titania etc. are added as external additives to the surface of the toner, and by transfer of the toner from the photoreceptor at the time of primary transfer to the intermediate transfer material, the surface of the intermediate transfer material is scratched by the external additives. Even if scratches generated in each transfer may be very small, the scratches are enlarged by repeated transfer, resulting in problems such as uneven transfer, streaks and insufficient image density at the time of transfer. Since the amount of a toner consumed particularly in the field of graphic arts is large and the amount of the toner transferred in each transfer is also large, the surface of the intermediate transfer material is liable to be further abraded and scratched.

On the other hand, a toner obtained by the conventional kneading-pulverizing process wherein thermoplastic resin together with a pigment, a charging regulator, a releasing agent etc. is melted, kneaded, cooled, finely pulverized and classified, has an indefinite shape and an indefinite surface structure, and depending on the ability of the used materials to be pulverized and conditions of the pulverizing step, the shape and surface structure of the toner are slightly changed, thereby making intentional regulation of the shape and surface structure difficult. Further, the toner obtained in the kneading-pulverizing process is one having a storage of elastic modulus, which will be described below, at 160° C. (G'(160)) of 700 Pa or higher.

Accordingly, there is demand for an image forming method free of defects in images with excellent durability of a photoreceptor to solve the problems described above.

SUMMARY OF THE INVENTION

That is, the object of the present invention is to solve the problems in the prior art.

An object of the invention is to provide an image forming method wherein the surface of a photoreceptor in the steps of charging, development, transfer and cleaning is prevented from being abraded and oxidized by metal oxide particles, typically external additives present in the inside and/or the surface of a toner, thus decreasing a reduction in the performance of the photoreceptor, such as a change in potential, sensitivity etc.

Another object of the invention is to provide an image forming method wherein the surface of an intermediate transfer material is prevented from being abraded and scratched by metal oxide particles, typically external additives present in the inside and/or the surface of a toner, thus decreasing a reduction in transfer performance such as uneven transfer, reduction in image density, streaks etc.

Under these circumstances, the present inventors made extensive study, and, as a result, they found that a photoreceptor whose surface contains a compound having an unsaturated double bond, or a transfer belt, in which abrasion and scratching on the surface thereof might be problematic, can be combined with a toner having specific shape factor and storage of elastic modulus, to solve the problems described above, and the invention is thereby completed.

That is:

A first aspect of the invention is concerned with an image forming method (U) comprising a step of developing an electrostatic latent image formed on an electrophotographic photoreceptor with a toner for electrostatic latent image development containing a binder resin and a colorant, wherein the surface of the electrophotographic photoreceptor contains a compound having an unsaturated double bond, the surface of the toner for electrostatic latent image development has at least one kind of particles selected from metal oxide particles and metal nitride particles, and the toner for electrostatic latent image development is a toner for electrostatic latent image development having a shape factor of 110 to 140 and containing a binder resin obtained by polymerizing a polymerizable monomer having a vinyl double bond, and the storage of elastic modulus at 160° C. (G'(160)) of the toner for electrostatic latent image development is in the following range:

$$80\ \text{Pa} \leqq G'(160) \leqq 620\ \text{Pa}.$$

A second aspect of the invention is to provide the image forming method (U) wherein the total amount of the metal oxide particles and/or metal nitride particles added is 0.1 to 10% by mass relative to the toner, and the ratio of metal oxide particles and/or metal nitride particles having a particle size of no more than 0.03 μm relative to the total amount of the metal oxide particles and/or metal nitride particles is in the following range:

$$0.01 \leqq (\text{amount of particles having a particle size of 0.03 μm or less})/(\text{total amount of metal oxide particles and/or metal nitride particles}) \leqq 0.8.$$

A third aspect of the invention is to provide the image forming method (U) wherein the toner for electrostatic latent image development makes use of colored toner particles prepared by mixing a resin particle dispersion having 1 μm or less resin particles dispersed therein with a colorant dispersion having a colorant dispersed therein, aggregating the resin particles and the colorant to form aggregated toner particles, and coalescing the resulting aggregated particles by heating to a temperature of higher than a glass transition temperature of the resin.

A fourth aspect of the invention is to provide the image forming method (U) wherein the toner for electrostatic latent image development further comprises at least one releasing agent.

A fifth aspect of the invention is to provide the image forming method (U) wherein the toner for electrostatic latent image development comprises at least one releasing agent, and the content of the releasing agent contained in the toner for electrostatic latent image development is in the range of 0.5 to 50% by mass.

A sixth aspect of the invention is to provide the image forming method (U) wherein the average particle diameter of the toner for electrostatic latent image development is 3 to 9 μm.

A seventh aspect of the invention is to provide the image forming method (U) wherein the particle-size distribution of the toner for electrostatic latent image development is 1.3 or less.

An eighth aspect of the invention is to provide the image forming method (U) wherein the polymerizable monomer having a vinyl double bond has a carboxyl group.

A ninth aspect of the invention is to provide the image forming method (U) wherein the compound having an unsaturated double bond on the surface of the electrophotographic photoreceptor has at least one kind of structures shown in the formulae (1) to (5):

(1)

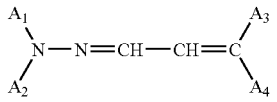

(2)

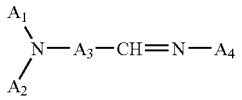

(3)

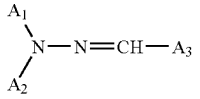

(4)

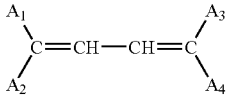

(5)

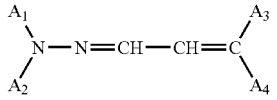

wherein $A_1$, $A_2$, $A_4$ and $A_5$ each independently represent a hydrogen atom, a $C_{1-6}$ alkyl group, an alkenyl group, a halogen atom, a methoxy group, an ethoxy group, a phenyl group, a naphthyl group, an anthracenyl group, a phenanthryl group, a pyrenyl group, a perylenyl group, a naphthcenyl group, a biphenyl group, a benzyl group, a pyridyl group or a carbazolyl group, each of which may have a substituent group, and $A_3$ represents an alkylene group which may have a substituent group.

A tenth aspect of the invention is to provide the image forming method (U) wherein the compound having an unsaturated double bond on the surface of the electrophotographic photoreceptor has at least one kind of structures shown in the formulae (1) to (5), and the electrophotographic photoreceptor further comprises an antioxidant.

An eleventh aspect of the invention is to provide the image forming method (U) wherein the compound having an unsaturated double bond on the surface of the electrophotographic photoreceptor has at least one kind of structures shown in the formulae (1) to (5), and the compound having an unsaturated double bond on the surface of the electrophotographic photoreceptor is a charge transporting material.

A twelfth aspect of the invention is to provide the image forming method (U) wherein the compound having an unsaturated double bond on the surface of the electrophotographic photoreceptor has at least one kind of structures shown in the formulae (1) to (5), the compound having an unsaturated double bond on the surface of the electrophotographic photoreceptor is a charge transporting material, and the ratio by mass of the charge transporting material to the binder resin (charge transporting material/binder resin) in the charge transporting layer is in the range of 0.08 to 6.

A thirteenth aspect of the invention is to provide an image forming method (U) wherein the compound having an unsaturated double bond on the surface of the electrophotographic photoreceptor has at least one kind of structures shown in the formulae (1) to (5), and the thickness of the charge generating layer included in the electrophotographic photoreceptor is 0.1 to 10 μm.

A fourteenth aspect of the invention is to provide an image forming method (U) wherein the compound having an unsaturated double bond on the surface of the electrophotographic photoreceptor has at least one kind of structure shown in the formulae (1) to (5), and the thickness of the charge transporting layer included in the electrophotographic photoreceptor is 5 to 30 μm.

A fifteenth aspect of the invention is concerned with an image forming method (V) comprising at least the steps of forming an electrostatic latent image on the surface of an electrostatic latent image bearing body, developing the electrostatic latent image with a toner for electrostatic latent image development containing a binder resin and a colorant to form a toner image, transferring the toner image onto the surface of a transfer material, and thermally fixing the toner image, wherein the surface of the electrostatic latent image bearing body comprises a compound having an unsaturated double bond, the toner for electrostatic latent image development comprises a binder resin obtained by polymerizing a polymerizable monomer having a vinyl double bond, has at least one kind of particles selected from metal oxide particles and metal nitride particles on the surface of the toner and has shape factor SF1 in the range of 110 to 140, and the storage of elastic modulus at 160° C. (G'(160)) of the toner for electrostatic latent image development is in the following range:

$$80\ \text{Pa} \leqq G'(160) \leqq 620\ \text{Pa}.$$

A sixteenth aspect of the invention is to provide the image forming method (V) wherein the Vickers hardness of the surface of the transfer material is in the range of 5HV0.30 to 1000HV0.30.

A seventeenth aspect of the invention is to provide the image forming method (V) wherein the transfer material has a multi-layer structure.

An eighteenth aspect of the invention is to provide the image forming method (V) wherein the transfer material comprises inorganic fillers.

A nineteenth aspect of the invention is to provide the image forming method (V) wherein the surface of the transfer material further comprises a compound having a functional group containing a fluorine atom.

A twentieth aspect of the invention is to provide the image forming method (V) wherein the surface of the transfer material further comprises a silicone material.

In the invention, it is preferred that the total amount of the metal oxide particles and/or metal nitride particles added is 0.1 to 10% by mass based on the amount of the toner, and the ratio of 0.03 μm or smaller metal oxide particles and/or metal nitride particles to the total metal oxide particles and/or metal nitride particles is in the following range:

$$0.01 \leqq (\text{amount of 0.03 μm or smaller particles})/(\text{total amount of metal oxide and/or metal nitride particles}) \leqq 0.8.$$

Preferably, the compound having an unsaturated double bond contained in the surface of the electrostatic latent image bearing body has at least one kind of structures shown in the formulae (1) to (5) below, and the electrostatic latent image bearing body comprises an antioxidant.

(1)

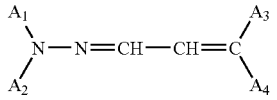

(2)

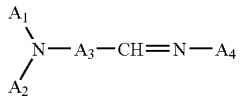

(3)

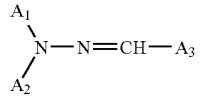

(4)

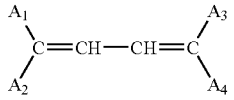

(5)

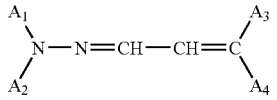

wherein $A_1$, $A_2$, $A_4$ and $A_5$ may be the same or different and each represent a hydrogen atom, a $C_{1-6}$ alkyl group, an alkenyl group, a halogen atom, a methoxy group, an ethoxy group, a phenyl group, a naphthyl group, an anthracenyl group, a phenanthryl group, a pyrenyl group, a perylenyl group, a naphthcenyl group, a biphenyl group, a benzyl group, a pyridyl group or a carbazolyl group, each of which may have a substituent group, and $A_3$ represents an alkylene group which may have a substituent group.

Preferably, the toner for electrostatic latent image development makes use of toner particles prepared by mixing a resin particle dispersion having 1 μm or smaller resin particles dispersed therein with a colorant dispersion having a colorant dispersed therein, aggregating the resin particles and the colorant to form aggregated toner particles, and coalescing the resulting aggregated particles by heating to a temperature which is higher than the glass transition temperature of the resin.

Preferably, the toner for electrostatic latent image development comprises at least one releasing agent, and the volume average particle diameter of the toner for electrostatic latent image development is preferably in the range of 3 to 9 μm. Preferably, the polymerizable monomer having a vinyl double bond has a carboxyl group.

The transfer material preferably has a multi-layer structure of at least two layers, and preferably comprises inorganic fillers.

The surface of the transfer material preferably has a compound containing at least one of a monofluoromethyl group, a difluoromethyl group, a trifluoromethyl group, a monofluoromethylene group and a difluoromethylene group, and the surface of the transfer material preferably has a compound containing at least one of dimethyl silicone, diphenyl silicone and methyl phenyl silicone.

An image forming method comprising a step of developing an electrostatic latent image formed on an electrophotographic photoreceptor with a toner for electrostatic latent image development containing a binder resin and a colorant, wherein the surface of the electrophotographic photoreceptor contains a compound having an unsaturated double bond, the surface of the toner for electrostatic latent image development has at least one kind of metal oxide particles and/or metal nitride particles, and the toner for electrostatic latent image development is a toner for electrostatic latent image development having a shape factor of 110 to 140 and containing a binder resin obtained by polymerizing a polymerizable monomer having a vinyl double bond, and the storage of elastic modulus at 160° C. (G' (160)) of the toner for electrostatic latent image development is in the following range:

$$80 \leqq \text{Pa } G'(160) \leqq 620 \text{ Pa}.$$

The above-described image forming method wherein the total amount of the metal oxide particles and/or metal nitride particles added is 0.1 to 10% by weight relative to the toner, and the ratio of metal oxide particles and/or metal nitride particles having a particle size of no more than 0.03 μm relative to the total amount of the metal oxide particles and/or metal nitride particles is in the following range:

0.01≦(amount of particles having a particle size of 0.03 μm or less)/(total amount of metal oxide particles and/or metal nitride particles)≦0.8.

The above-described image forming method wherein the compound having an unsaturated double bond on the surface of the electrophotographic photoreceptor has at least one kind of structure selected from the structures represented by the following general formulae (1) to (5) and the electrophotographic photoreceptor further comprises an antioxidant.

In the general formulae 1 to 5, $A_1$, $A_2$, $A_4$ and $A_5$ each may be the same or different, and each represent a hydrogen atom, a $C_{1-6}$ alkyl group, an alkenyl group, a halogen atom, a methoxy group, an ethoxy group, a phenyl group, a naphthyl group, an anthracenyl group, a phenanthryl group, a pyrenyl group, a perylenyl group, a naphthcenyl group, a biphenyl group, a benzyl group, a pyridyl group or a carbazolyl group, each of which may have a substituent group. $A_3$ represents an alkylene group which may have a substituent group.

General formula (1)

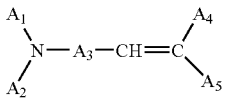

General formula (2)

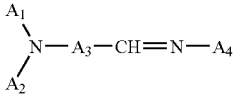

General formula (3)

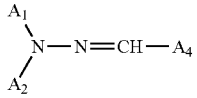

General formula (4)

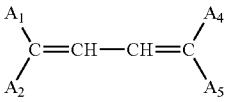

-continued

General formula (5)

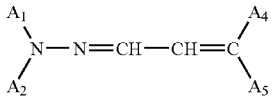

DETAILED DESCRIPTION OF THE INVENTION

Figure 1:
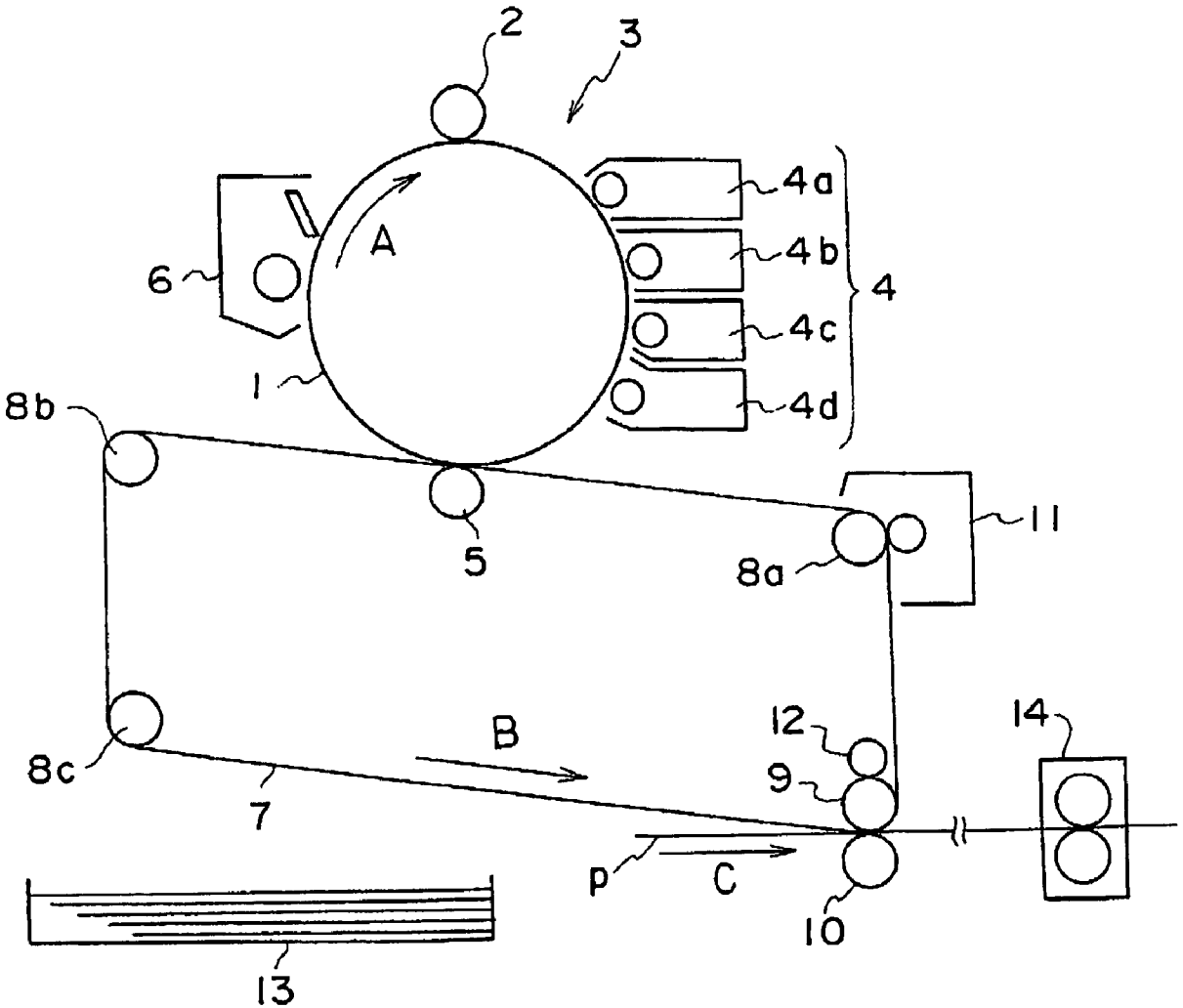
FIG. 1 is an illustration showing one example of the image forming device used in the present invention.

Hereinafter, the present invention is described in more detail.

The image forming method of the invention comprises at least the steps of forming an electrostatic latent image on the surface of an electrostatic latent image bearing body, developing the electrostatic latent image with a toner for electrostatic latent image development containing a binder resin and a colorant to form a toner image, transferring the toner image onto the surface of a transfer material, and thermally fixing the toner image, wherein the surface of the electrostatic latent image bearing body comprises a compound having an unsaturated double bond, the toner for electrostatic latent image development comprises a binder resin obtained by polymerizing a polymerizable monomer having a vinyl double bond, has at least one kind of metal oxide particles and/or metal nitride particles on the surface of the toner and has shape factor SF1 in the range of 110 to 140, and the storage of elastic modulus at 160° C. (G'(160)) of the toner for electrostatic latent image development is in the following range:

$$80 \text{ Pa} \leqq G'(160) \leqq 620 \text{ Pa}$$

That is, scratches on the surface of the photoreceptor caused by adhesion of the toner to the surface of the photoreceptor in the development step, and/or scratches generated by pushing, with a blush or a blade, metal oxides etc., which are external additives remaining on the surface of the photoreceptor, in the cleaning step are prevented by regulating the shape of the toner and storage of elastic modulus at 160° C., whereby the surface of the photoreceptor is prevented from being oxidized in the steps of charging and transfer, thereby providing an image forming method with less deterioration in the performance of the photoreceptor, such as a change in the potential and sensitivity of the photoreceptor.

Generally, in the step of developing, with toners, an electrostatic latent image formed on the surface of the photoreceptor after the charging step and the light exposure step for visualization, the toner particles visualize the electrostatic latent image by moving from the surface of a development roll or by moving from a magnetic brush. When the toners contact with the surface of the photoreceptor, metal oxides as external additives are present sandwiched between the surface of the photoreceptor and the surface of the toner. The hardness of the metal oxides is generally high, and the surface of the photoreceptor is scratched by the metal oxides. When repeated development is carried out, for example, in an electrophotographic process, scratches generated in one development process are slight, but are enlarged in repeated development, to abrade the surface of the photoreceptor. This tendency is particularly significant in the field of graphic arts where the amount of the toner developed at one time is large. Particularly when a compound having an aliphatic unsaturated double bond is used as the charge transporting material in the photoreceptor, properties such as potential stability and high sensitivity can be easily achieved, but in the steps of charging, transfer etc., the aliphatic double bond is easily oxidized. Particularly in the situation where the surface of the photoreceptor is easily abraded, oxidation easily proceeds to reduce the potential and sensitivity of the photoreceptor.

The present inventors have found that these problems can be solved by regulating the shape and storage of elastic modulus at 160° C. of the toner.

That is, the area that one toner particle having shape factor SF1 in the range of 110 to 140 can contact is larger, and, as described above, the pressure exerted per metal oxide particle as the external additives sandwiched between the photoreceptor and the toner can be reduced. Further, the storage of elastic modulus at 160° C. of the toner is regulated in the range of 80 to 620 Pa, whereby the metal oxides as external additives sandwiched when the surface of the photoreceptor contacts with the toner, are embedded in the toner and thus hardly scratch the surface of the photoreceptor. Accordingly, the metal oxides do not remain on the surface of the photoreceptor so that also in the cleaning step after transfer, scratches due to the metal oxides are not generated, and the reduction in the performance of the photoreceptor as described above can be inhibited.

-Electrophotographic Photoreceptor (Electrostatic Latent Image Bearing Body)-

First, the electrophotographic photoreceptor used in the invention is described. The surface of the photoreceptor in the invention contains a compound having an unsaturated double bond. The phrase "surface of the photoreceptor contains a compound having an unsaturated double bond" means that at least the outermost layer of the photoreceptor contains the compound.

Hereinafter, the compound having an unsaturated double bond, contained in the surface of the photoreceptor, is described.

The unsaturated double bond in the compound is not particularly limited insofar as it is a double bond other than that constituting an aromatic ring such as a phenyl group, a naphthyl group and an anthranyl group. The aromatic ring has double bonds owing to π electrons in the constituent ring. However, because such double bonds are mutually conjugated, a 6-memberred ring constituting a phenyl group, for example, is relatively stable against oxidation because of its structure having 6 single and half (1.5) bonds instead of 3 single bonds and 3 double bonds. On the other hand, aliphatic double bonds do not have such an effect, and are thus liable to be oxidized.

In the compounds represented by the formulae (1) to (5), for example if $A_3$ in the compound of the formula (1) is an aromatic ring, there can be a certain effect attributable to conjugation brought about by depolarization of the adjacent phenyl group. However, the aromatic ring donates electrons generally by pushing electrons towards other functional groups, and thus the aliphatic unsaturated double bond is more liable to be oxidized. Even if the electron donation of the aromatic ring is regulated to a certain degree by allowing the phenyl group to be substituted by an electron-withdrawing functional group such as a halogen or a nitro group, the aliphatic unsaturated double bond undergoes oxidation more easily than the aromatic unsaturated double bond. Accordingly, the invention is directed to a photoreceptor whose surface contains the compound having an unsaturated double bond.

The compound having an unsaturated double bond used in the invention is preferably a compound having at least one of the structures shown in the formulae (1) to (5) in order to achieve excellent charge transportability. Specifically, there are Compounds 1-1 to 1-16, 2-1 to 2-4,3-1 to 3-16,4-1 to 4-2, and 5-1 to 5-5 as follows.

Compound 1-1

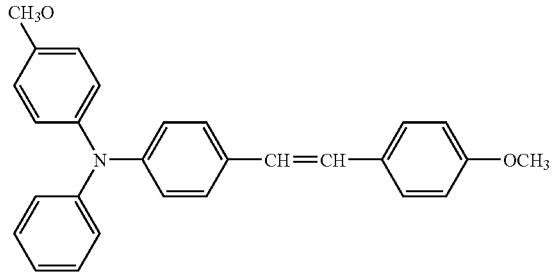

Compound 1-2

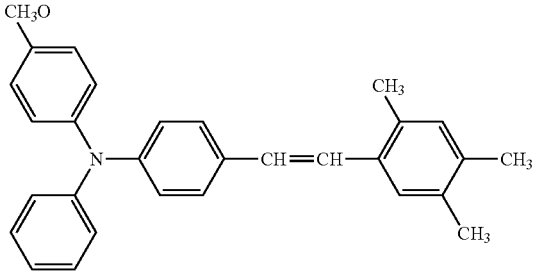

Compound 1-3

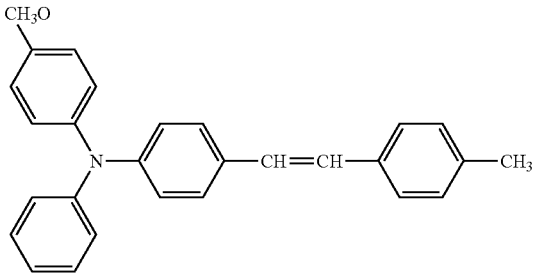

Compound 1-4

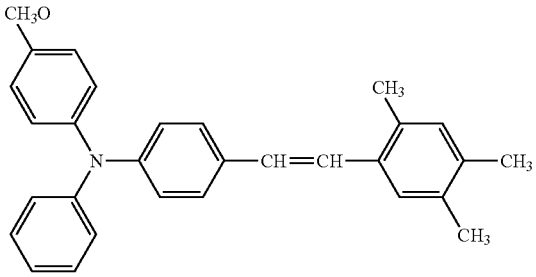

Compound 1-5

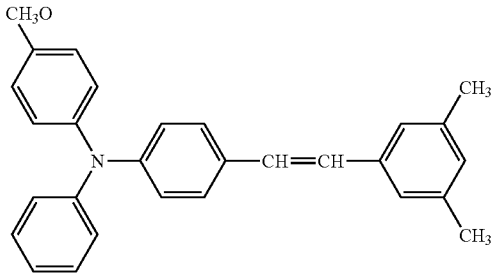

-continued
Compound 1-6
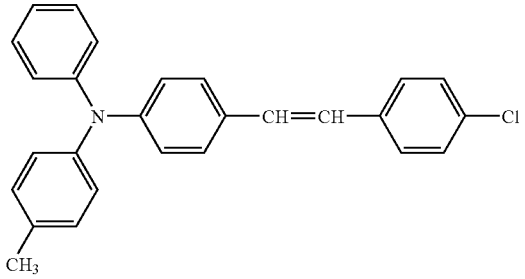
Compound 1-7
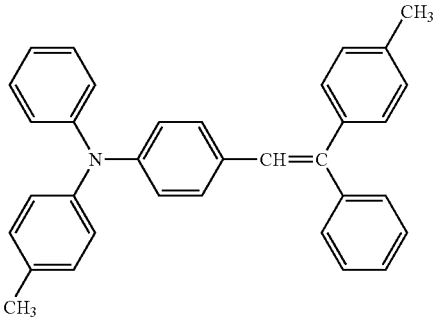
Compound 1-8
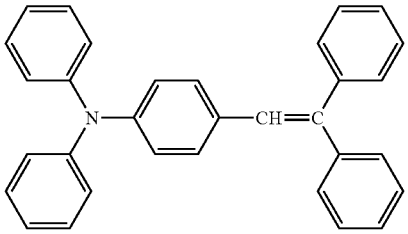
Compound 1-9
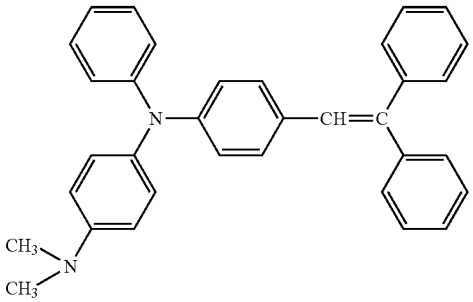
Compound 1-10
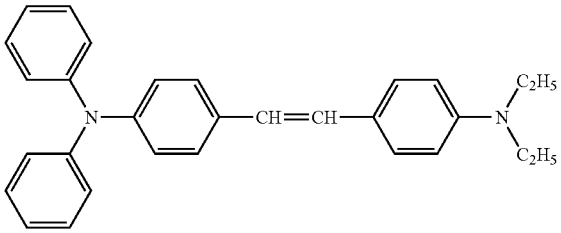
-continued
Compound 1-11
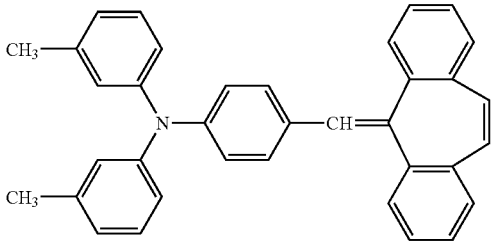
Compound 1-12
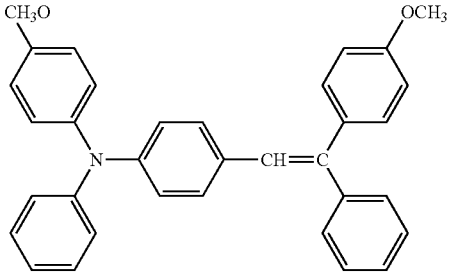
Compound 1-13
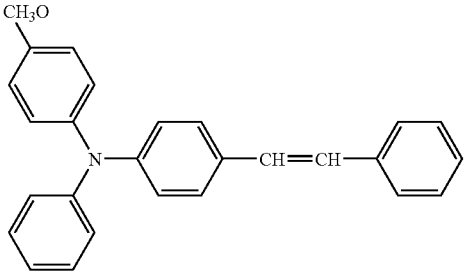
Compound 1-14
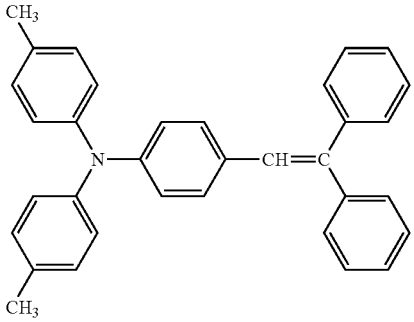
Compound 1-15
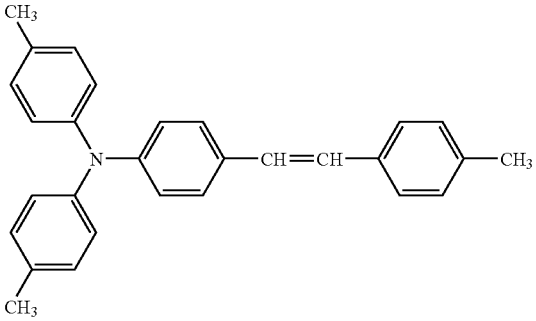

-continued
Compound 1-16
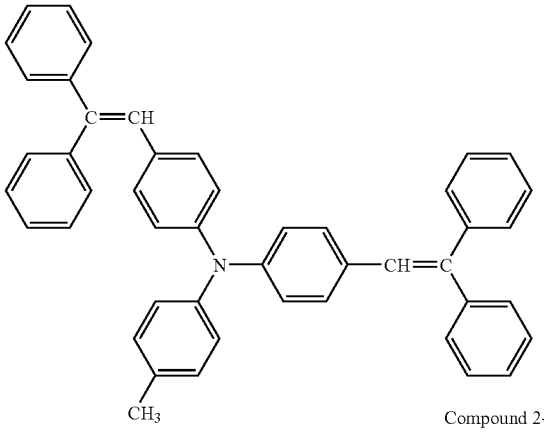
Compound 2-1
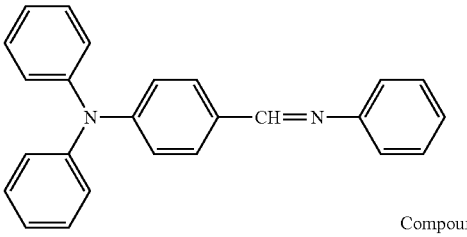
Compound 2-2
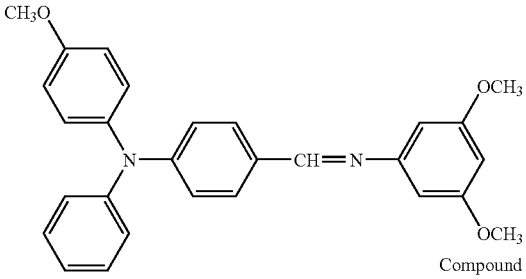
Compound 2-3
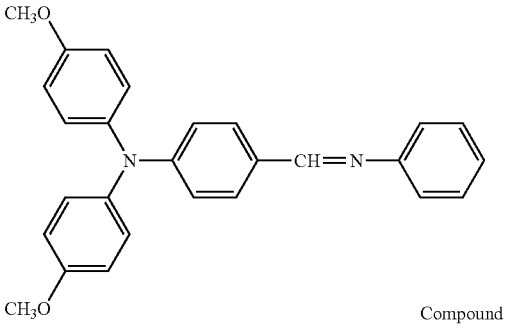
Compound 2-4
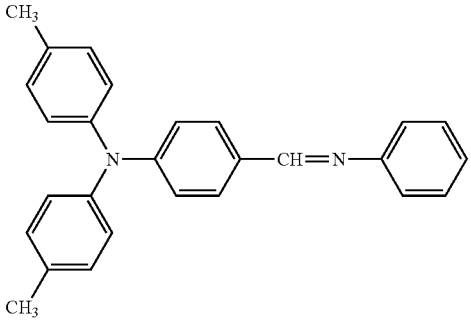
-continued
Compound 3-1
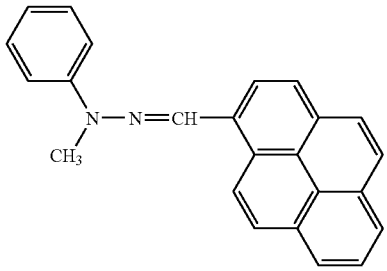
Compound 3-2
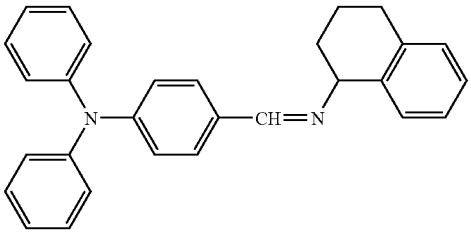
Compound 3-3
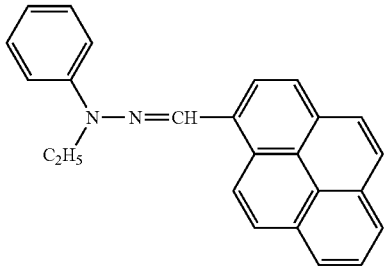
Compound 3-4
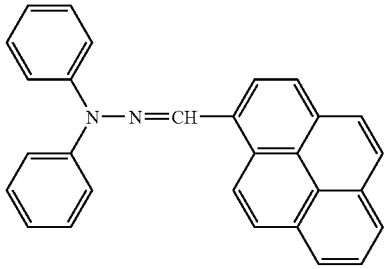
Compound 3-5
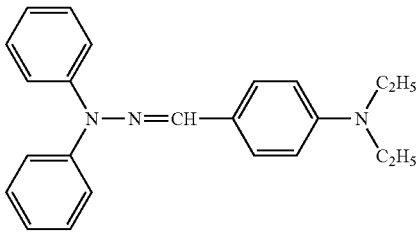
Compound 3-6
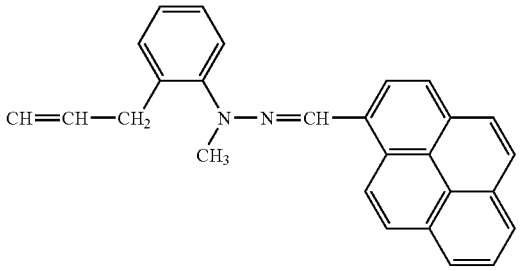

-continued
Compound 3-7
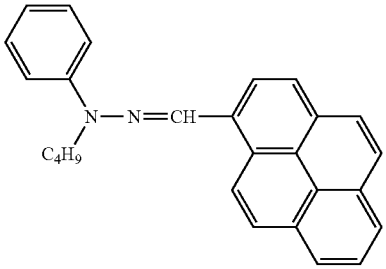
Compound 3-8
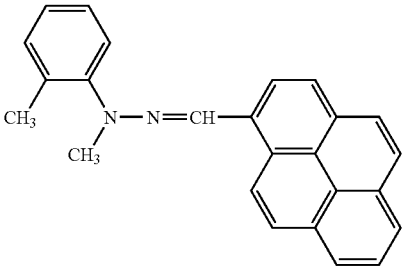
Compound 3-9
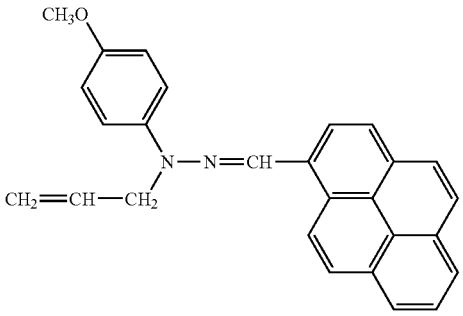
Compound 3-10
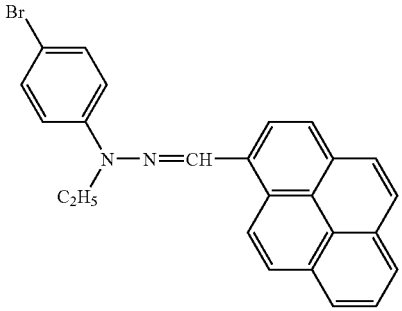
Compound 3-11
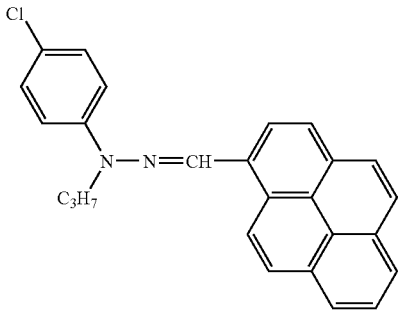
-continued
Compound 3-12
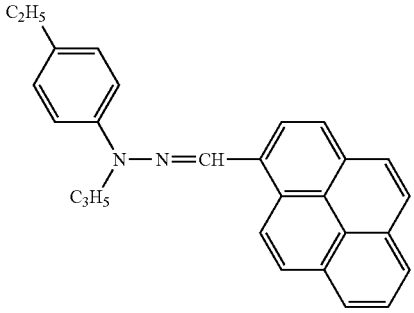
Compound 3-13
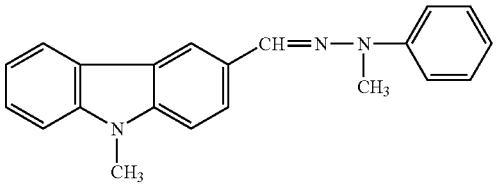
Compound 3-14
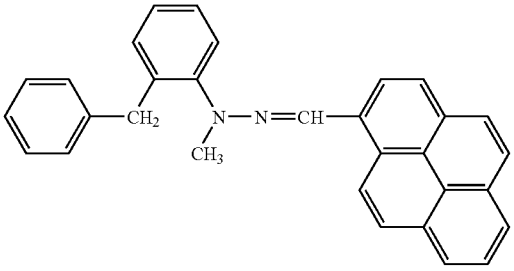
Compound 3-15
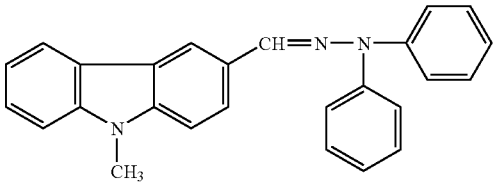
Compound 3-16
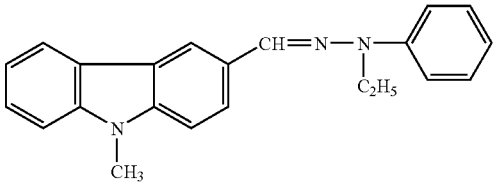
Compound 4-1
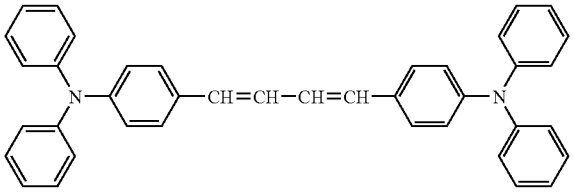

-continued

Compound 4-2

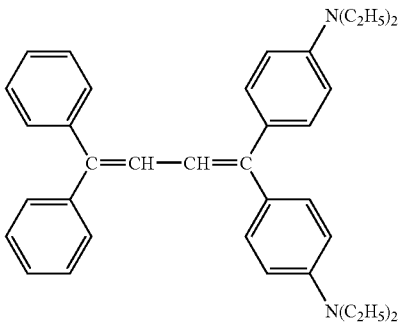

Compound 5-1

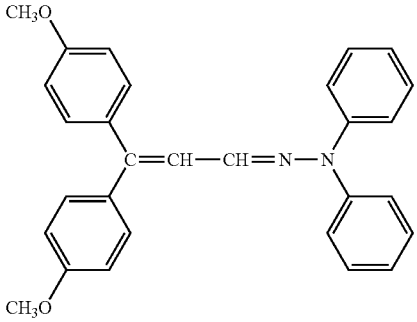

Compound 5-2

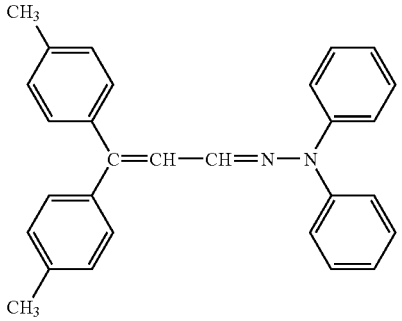

Compound 5-3

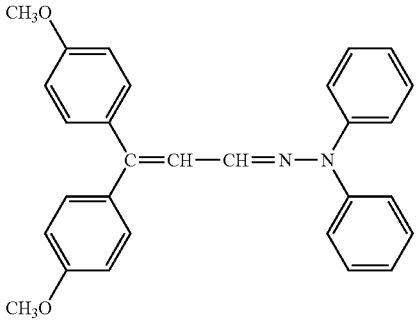

Compound 5-4

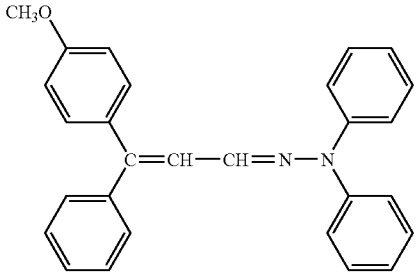

-continued

Compound 5-5

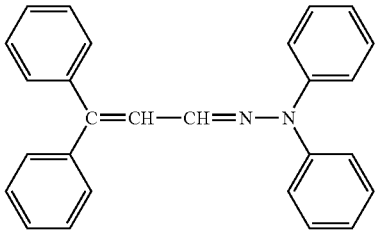

Among these compounds, Compounds 1-1 to 1-16 and Compounds 3-1 to 3-16 represented by the formula (1) or (3) are preferred from the viewpoint of excellent potential stability and sensitivity of the surface of the photoreceptor, and Compounds 1-1 to 1-10 and Compounds 3-1 and 3-14 are more preferred from the same viewpoint.

These compounds may be used alone or as a mixture of two or more thereof.

The compound having an unsaturated double bond is contained in, for example, the charge transporting layer formed as the outermost layer of the photoreceptor.

For example, the charge transporting material used in the charge transporting layer includes not only compounds having the structures shown in the formulae (1) to (5) but also carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylene diamine derivatives, stilbene derivatives, benzidine derivatives, poly-N-vinyl carbazole, poly-1-vinyl pyrene, poly-9-vinyl anthracene etc., and these compounds may be used as a mixture with compounds having the structures of the formulae (1) to (5).

The charge transporting layer is obtained usually by mixing a binder resin with the charge transporting material. The usable binder resins includes solvent-soluble resins such as polycarbonate resin, polyacrylate resin, polyester resin, polystyrene resin, styrene-acrylic resin, styrene-acrylonitrile resin and polyvinyl butyral resin. Among these, the polycarbonate resin is superior in abrasion resistance, adhesion etc.

The charge transporting layer is formed by dissolving the binder resin and the charge transporting body (including the compound having an unsaturated double bond) in an organic solvent, applying the solution onto the surface of e.g. a charge generating layer formed on the surface of an electroconductive support such as Al by dipping the surface in the solution so that a layer having a predetermined thickness is formed, and then drying the organic solvent. Accordingly, the organic solvent should have the capability of dissolving the binder resin and the charge transporting material to a suitable concentration, and suitable volatility. As a matter of course, organic solvents which are easily handled and having low toxicity and ignitability, are preferable.

Suitable organic solvents are varied depending on the binder resin used, and when polycarbonate resin is used as the binder resin, the organic solvent usable include, for example, aromatic hydrocarbons such as toluene and xylene; ketones such as acetone, methyl ethyl ketone, diethyl ketone and cyclohexanone; alcohols such as methanol, ethanol and propanol; halogen-containing hydrocarbons such as methylene chloride, 1,2-dichloroethane and trichloroethane; aliphatic alkyl esters such as ethyl acetate and butyl acetate; and tetrahydrofuran, 1,4-dioxane, 1,3-dioxolane, pyridine and ethylamine. These organic solvents may be used alone or as a mixture of two or more thereof.

The ratio by mass of the charge transporting material to the binder resin (charge transporting body/binder resin) in the charge transporting layer is preferably in the range of about 0.08 to 6, more preferably 0.15 to 4, still more preferably in the range of 0.2 to 1.5. When the ratio by mass is less than 0.08, the ratio of the charge transporting material in the charge transporting layer is low, thus failing to achieve necessary potential and sensitivity. Further, a mass ratio of higher than 6 is not preferred because the film strength of the charge transporting layer cannot be maintained.

A basic example of the photoreceptor used in the image forming method of the invention has the following structure. That is, the photoreceptor employs, as a photosensitive layer, a laminated photoreceptor produced by providing a charge generating layer containing at least the charge generating material on the surface of an electroconductive support and then providing a charge transporting layer containing at least the binder resin and the charge transporting material on the surface of the charge generating layer. In this case, the charge transporting layer serves as the outermost layer of the photoreceptor.

The electroconductive support used for the photoreceptor in the invention is not particularly limited insofar as it has a volume resistivity of not higher than $1\times10^{10}$ Ωcm. Specific examples of the electroconductive support include films or plastics coated by vapor deposition with metals such as aluminum, nickel, chrome, nichrome, copper, silver, gold, platinum and iron or metal oxides such as tin oxide and indium oxide, and tubes produced from metal plates such as aluminum, an aluminum alloy and nickel and surface-treated by cutting, polishing etc.

The charge generating layer used in the photoreceptor in the invention is not particularly limited insofar as it is made of a material containing the charge generating material and capable of being formed into a layer.

As the charge generating material, a known material can be used without particular limitation. The charge generating material can be classified into inorganic and organic materials.

Specific examples of the inorganic materials include selenium such as crystalline selenium and amorphous selenium, selenium-containing compounds such as selenium-tellurium, selenium-tellurium-halogen, selenium-arsenic, and amorphous silicon, and the amorphous silicon may be doped with atoms such as boron and phosphorus.

As the organic-based material, a known material can be used. Specific examples thereof include phthalocyanine-based pigments such as metal phthalocyanine and non-metal phthalocyanine, for example chlorogallium phthalocyanine, hydroxy gallium phthalocyanine etc., azulenium salt pigments, squaric acid methine pigments, azo pigments having a carbazole skeleton, a diphenylamine skeleton, a dibenzothiophene skeleton, a fluorenone skeleton, an oxadiazole skeleton, a bisstilbene skeleton, a distyryl oxadiazole skeleton or a distyryl carbazole skeleton, perylene-based pigments, antharquinone-based pigments, polycyclic quinone-based pigments, quinoneimine-based pigments, diphenylmethane- and triphenylmethane-based pigments, benzoquinone- and naphthoquinone-based pigments, cyanine-based pigments, azomethine-based pigments, indigoid-based pigments, bisbenzimidazole-based pigments and the like.

Among these charge generating materials, the organic materials are preferred in respect of easiness of the process, and phthalocyanine-based pigments such as metal-containing phthalocyanine and metal-free phthalocyanine, for example chlorogallium phthalocyanine, hydroxy gallium phthalocyanine etc. and azo pigments having a carbazole skeleton, a diphenylamine skeleton, a dibenzothiophene skeleton, a fluorenone skeleton, an oxadiazole skeleton, a bisstilbene skeleton, a distyryl oxadiazole skeleton or a distyryl carbazole skeleton are preferred in preparation of the photoreceptor of the invention.

These charge generating materials may be used alone or as a mixture of two or more thereof.

The charge generating layer may contain a binder resin if necessary from the viewpoint of easy formation of the layer, the strength of the layer, etc. The binder resin includes polystyrene, acrylic resin, styrene-acrylic resin, polyamide, polyimide, polyamide imide, polyurethane, epoxy resin, polycarbonate resin, polyketone, polyester, polybutyl butyral, polyvinyl formal, polyvinyl ketone, polyvinyl carbazole, phenol resin, melamine resin, silicone resin, phenoxy resin, styrene-acrylonitrile resin, ABS resin etc. Among these resins, polycarbonate resin and silicone resin are used preferably from the viewpoint of easy coating etc. These resins may be used alone or as a mixture of two or more thereof.

The ratio of the charge generating material to the binder resin in the charge generating layer, that is, the (charge generating material/binder resin) ratio by mass, is preferably in the range of 0.03 to 5, more preferably in the range of 0.1 to 3, still more preferably in the range of 0.15 to 2, in order to exhibit sufficient performance of the charge generating layer. A ratio outside the above range is not preferred because if the mass ratio is less than 0.03, the amount of the charge generating material is low and the amount of generated charges is insufficient, while if the mass ratio is higher than 5, the amount of the binder is low and thus the adhesion of the charge generating layer is lowered.

The respective layers of the laminated photoreceptor can be formed by known methods such as roll coating, bar coating, dip coating and spray coating. Among these methods, dip coating and spray coating are used preferably from the viewpoint of uniform thickness of each layer and stability in the production process.

The thickness of the charge generating layer is preferably in the range of 0.1 to 10 μm, more preferably in the range of 0.3 to 8 μm, still more preferably in the range of 0.5 to 5 μm. The thickness of the charge transporting layer is preferably in the range of 3 to 50 μm, more preferably in the range of 10 to 40 μm, still more preferably in the range of 15 to 30 μm, and when the thickness of each layer is in the above range, the photoreceptor excellent in charge potential and sensitivity and superior in film strength and durability can be obtained.

In the photoreceptor used in the image forming method of the invention, an undercoating layer can be provided between the electroconductive support and the charge generating layer for the purpose of improvement in the adhesion of the electroconductive support to the charge generating layer, improvement in the coating ability of the charge generating layer, reduction in residual potential, etc.

Components constituting the undercoating layer are generally polymeric materials having a coatability. Specific examples of the polymeric materials include thermoplastic resins such as polyacrylate ester derivatives, polyvinyl acetate, polyvinyl alcohol, polyvinyl formal, polyvinyl butyral, polyester, polycarbonate, polyamide and polyimide, and thermosetting resins such as epoxy resin, melamine resin, phenol resin and urethane resin.

Among these resins, thermoplastic resins such as polycarbonate, polyester and polyvinyl butyral are preferred from the viewpoint of film formability on the electroconductive support and adhesion to the charge generating layer. These resins may be used alone or as a mixture of two or more thereof. Further, two or more resins may be applied respectively to form a plurality of undercoating layers.

The undercoating layer can be formed by dissolving the polymeric material in an organic solvent, for example an alcohol such as 2-propanol and 1-butanol, a ketone such as methyl ethyl ketone and cyclohexanone, a halogenated hydrocarbon such as dichloroethane and chlorobenzene or an ether such as tetrahydrofuran and oxane, and then applying the solution onto the electroconductive support by a method such as dip coating or spray coating followed by heat treatment to remove the organic solvent.

For the purpose of improvement in the adhesion of the undercoating layer to the electroconductive support, improvement in the strength of the undercoating layer, improvement in the adhesion thereof to the charge generating layer and/or easiness of the coating step in formation of the charge generating layer, the undercoating layer may use acrylic acid derivatives such as 2-hydroxyethyl methacrylate and glycidyl methacrylate, silane coupling agents such as tetramethoxy silane, 3-aminopropyl trimethoxy silane and methacryloxy propyl trimethoxy silane and/or titanate coupling agents, aluminate coupling agents, and crosslinking monomers such as metal alkoxides in combination with the polymeric material.

The thickness of the undercoating layer is preferably in the range of 0.1 to 10 μm, more preferably in the range of 0.3 to 7 μm, still more preferably in the range of 0.5 to 5 μm. A thickness outside of the above range is not preferred because when the thickness is less than 0.1 μm, there is no effect of the undercoating layer on reduction of residual potential, etc., and when the thickness exceeds 10 μm, the uniformity of the coating is deteriorated.

The photoreceptor used in the invention can make use of an antioxidant for the purpose of preventing oxidation of the layers constituting the photoreceptor to maintain the performance of the photoreceptor.

The antioxidant used in the invention is not particularly limited, and known antioxidants can be used. Specific examples of such antioxidants include monophenols such as 2,6-di-t-butyl-p-cresol, butyrated hydroxy anisole, 2,6-di-t-butyl-4-ethyl phenol and stearyl-β-(3,5-di-t-butyl-4-hydroxyphenyl) propionate, bisphenols such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol) and 4,4'-butylidenebis-(3-methyl-6-t-butylphenol), polymeric phenols such as 1,1,3-tris-(2-methyl-4-hydroxy-5-t-butylphenyl) butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester and tocophenol, paraphenylene diamines such as N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine and N,N'-dimethyl-N,N'-di-t-butyl-p-phenylene diamine, hydroquinones such as 2,5-di-t-octyl hydroquinone, 2,6-didodecyl hydroquinone, 2-dodecyl hydroquinone, 2-dodecyl-5-chlorohydroquinone, 2-t-octyl-5-methyl hydroquinone and 2-(2-octadecenyl)-5-methyl hydroquinone, organosulfur compounds such as dilauryl-3,3'-thiodipropionate, distearyl-3,3'-thiodipropionate and ditetradecyl-3,3'-thiodipropionate, organophosphorus compounds such as triphenyl phosphine, tri(nonylphenyl)phosphine, tri(dinonylphenyl) phosphine, tricresyl phosphine and tri(2,4-dibutylphenoxy) phosphine.

Among these, the monophenols and bisphenols are more preferred, and the monophenols are still more preferred in the viewpoint of maintaining the performance of the photoreceptor.

These may be used alone or as a mixture of two or more thereof. Further, the antioxidant is usually added to the charge transporting layer in the photoreceptor, but may be added to the charge generating layer. When a protective layer is used on the surface of the charge transporting layer, the antioxidant may be added to the protective layer as described later.

For the purpose of preventing oxidation and abrasion of the surface of the photoreceptor used in the invention, the photoreceptor may be provided with a protective layer made of a hard coating material such as thermosetting silicone, phenol resin or melamine resin. In this case, the protective layer serves as a surface layer, and the above-described compound having an unsaturated double bond is contained in this protective layer.

-Toner for Electrostatic Latent Image Development-

Now, the toner for electrostatic latent image development used in the image forming method of the invention is described.

Generally, toner is charged by contacting with a charging sleeve or a charging blade in the case of a one-component developing agent or by contacting with a charging member such as carriers in the case of a two-component developing agent. In this case, the contact area is a protruded portion of the toner. Since the binder resin is generally an insulating material, it is estimated that the protruded region of the toner is charged at the highest level. When the toner is contacted with the surface of the photoreceptor in a development step, it is reasonably considered that the highly charged protruded region of the toner first contacts with the photoreceptor.

When the toner is produced in the kneading-pulverizing process, the toner shape can virtually not be regulated, and the majority of toners have a shape factor SF1 of higher than 140. When the kneaded and pulverized toner is used in development, the protruded portion of the toner collides first with the photoreceptor, and thus the contact area between the toner and the surface of the photoreceptor is so small that the metal oxides such as external additives present in the protruded portion receive excessive pressure, to scratch the surface of the photoreceptor or to stick into the surface of the photoreceptor, thus permitting the external additives to remain.

On the other hand, a toner having SF1 in the range of 110 to 140 has a shape without the protruded region described above, or a shape having round corners with the protruded region if any is not so sharp as that of the toner produced in the kneading-pulverizing process. Even if the toner collides with the photoreceptor as described above, the contact area between them is broader than that in the case of the kneaded and pulverized toner, and therefore the external additives present between the surface of the photoreceptor and the toner receive less pressure and hardly scratch the surface of the photoreceptor.

Accordingly, the toner for electrostatic latent image development used in the invention should have a shape whose shape factor SF1 is in the range of 110 to 140.

The shape factor SF1 is determined as follows: A photomicrograph of toners scattered on a slide glass is incorporated via a video camera into a LUZEX image analysis unit, and the maximum lengths and projected areas of 50 or more toner particles are determined, and the shape factor SF1 is expressed by the average of (maximum length of toner)$^2$/(projected area of toner)$\times(\pi/4)\times100$.

Insofar as particles having shape factor SF1 in the range of 110 to 140 can be produced, the process for producing the toner for electrostatic latent image development used in the invention is not particularly limited, but is particularly preferably an emulsion-polymerization aggregation process. The emulsion-polymerization aggregation process comprises a step in which a resin particle dispersion having resin particles with a particle diameter of no larger than 1 μm dispersed therein is mixed with a colorant dispersion having a colorant dispersed therein, etc., to aggregate the resin particles and the colorant thus achieving the desired diameter of toner particles (also referred to hereinafter as "aggregation step") and a step in which the aggregated particles are coalesced by heating the particles to a temperature higher than the glass transition temperature of the resin particles to form toner particles (also referred to hereinafter as "coalescence step").

In the aggregation step, the respective particles of a mixture composed of the resin particle dispersion, the colorant dispersion, and a releasing agent dispersion if necessary, are aggregated to form aggregated particles. The aggregated particles are formed by heteroaggregation etc., and for the purpose of stabilization of the aggregated particles and regulation of particle size/particle size distribution, an ionic surfactant having opposite polarity to that of the aggregated particles, or a charged mono- or higher valent compound such as a metal salt, is added.

In the coalescence step, the resin particles in the aggregated particles are coalesced at a temperature higher than their glass transition temperature, and the aggregated particles is changed from an indefinite to spherical shape. The shape factor SF1 of the aggregated particles is initially 150 or more, but is decreased as the particles become spherical, and the shape factor SF1 can be regulated by terminating heating of the toner when the desired shape factor is reached. Thereafter, the aggregated particles are separated from the aqueous medium and washed and dried in accordance with the necessity, to give toner particles.

As the process for producing the toner for electrostatic latent image development used in the invention, a suspension polymerization process can also be preferably used. The suspension polymerization process is a process wherein colorant particles, releasing agent particles etc. together with polymerizable monomers are suspended in an aqueous medium containing, if necessary, a suspension stabilizer etc. and then dispersed in desired particle size and particle size distribution, the polymerizable monomers are polymerized by a means such as heating, and the resulting polymer is separated from the aqueous medium, and washed and dried in accordance with the necessity, to form toner particles.

The toner for electrostatic latent image development used in the invention should have storage of elastic modulus at 160° C. (G'(160)) in the range of 80 to 620 Pa. By doing so, the external additives upon collision of the toner with the photoreceptor are embedded in the toner, thereby preventing metal oxides as the external additives from scratching the surface of the photoreceptor or from remaining thereon.

Generally, the particle diameter of the metal oxides as external additives is as small as no bigger than 0.03 μm, and the metal oxides receive excessive pressure upon collision with the photoreceptor, to evolve very low heat. The present inventors estimated that even if this heat which may be very low, a very small contact area between the toner surface and the metal oxides etc. is heated instantly to a temperature higher than the glass transition temperature of the binder resin, whereby the additives are embedded in the toner, and they found that this embedding is related to the storage of elastic modulus of the toner at 160° C.

As described above, the storage of elastic modulus at 160° C. (G'(160)) of the toner should be in the range of 80 to 620 Pa, preferably in the range of 100 to 500 Pa, more preferably in the range of 150 to 400 Pa.

A storage of elastic modulus (G'(160)) of less than 80 Pa is not preferred because the metal oxides etc. on the toner surface are embedded in the toner particles by stirring in a development device, or the toner particles themselves collapse under stirring. When the storage of elastic modulus is higher than 620 Pa, the toner becomes harder, and thus the metal oxides etc. are not embedded in the toner particles, thus failing to achieve the effect of the invention.

The storage of elastic modulus of the toner in the invention was measured by forming the toner for electrostatic latent image development into tablets, then setting the tablet between parallel plates of 20 mm in diameter and vibrating it at a frequency of 6.28 rad/sec. after normal force was set at 0 in a viscoelasticity measuring instrument (ARES manufactured by Rheometric Scientific FE). The measurement temperature was 100 to 190° C., and the strain was 1%. The measurement interval was 120 sec., and after the measurement was initiated, the temperature increasing rate was 1° C./min., and the storage of elastic modulus at 160° C. was determined.

The toner having storage of elastic modulus (G'(160)) in the range of 80 to 620 Pa in the invention is obtained by regulating the amount of a polymerization initiator to reduce the molecular weight of the resulting resin or by reducing the glass transition temperature. When the emulsion aggregation process is used, the desired toner can be obtained by suitably selecting the type and amount of the aggregating agent. The conventional kneading-pulverizing process is not preferred because the resulting toner has a storage of elastic modulus (G'(160)) of 700 Pa or more.

The toner having storage of elastic modulus (G'(160)) in the range of 80 to 620 Pa can be obtained by regulating the polymerization degree and glass transition temperature of the resin in the toner. More specifically, the weight average molecular weight Mw of the resin is regulated in the range of 20000 to 35000, and the glass transition temperature in the range of 50 to 55° C. In this case, the amounts of a polymerization initiator and a chain transfer agent have a significant effect on regulation of the molecular weight, and generally the molecular weight is decreased by increasing the amounts of the polymerization initiator and the chain transfer agent.

For regulating storage of elastic modulus (G'(160)) in the above range by regulating the molecular weight of the resin in the above range, it is preferred that the amount of the polymerization initiator is decreased while the amount of the chain transfer agent is increased. This is because the majority of the chain transfer agents generally cause a reduction in the viscosity of the resin, whereas the polymerization initiator remains in molecular terminals to increase the viscosity of the resin.

Alternatively, the preferred storage of elastic modulus (G'(160)) can also be achieved by introducing some functional groups having a relatively long carbon chain into side chains of the resin molecules. The functional groups cause slight steric hindrance among the molecular chains and/or in the molecular chain itself to reduce the interaction among the molecular chains, whereby the storage of elastic modulus (G'(160)) can be regulated in the preferred range.

As the functional group, an aliphatic functional group containing 6 or more carbon atoms is preferably used. Specifically, preferred examples include alkyl groups such as hexyl, cyclohexyl, heptyl, octyl, nonyl, butyl, lauryl, cetyl, stearyl, oleyl and behenyl, alkylene groups, and alicyclic hydrocarbon groups such as a cholesteryl group.

As polymerizable monomers having these functional groups, unsaturated fatty esters are preferably used, and specific examples thereof include hexyl acrylate, hexyl methacrylate, 2-ethylhexyl acrylate, 2-ethylhexyl methacrylate, butyl acrylate, butyl methacrylate, stearyl acrylate, stearyl methacrylate, behenyl acrylate, behenyl methacrylate etc.

These may be used alone or as a mixture of two or more thereof.

The preferable content of the polymerizable monomers is varied depending on the length of functional groups, but is preferably in the range of 0.1 to 5% by mass, more preferably 0.3 to 3% by mass, relative to the total amount of the polymerizable monomers. The content is still more preferably in the range of 0.5 to 2% by mass.

A content outside of the above range is not preferred because when the content is less than 0.1% by mass, the effect of the polymerizable monomer added is hardly achieved, while when the content is higher than 5% by mass, the glass transition temperature is simultaneously lowered and thus the shelf stability of the resulting toner may be lowered.

The toner for electrostatic latent image development used in the invention should contain a binder resin obtained by polymerizing polymerizable monomers having vinyl double bonds. In the invention, the toner showing less change in viscosity against heat is superior in easy regulation of embedding of metal oxides into the toner surface.

Generally, metal oxides etc. on the toner surface have certain particle-size distribution, and as described above, metal oxide particles having a larger particle diameter evolve higher heat upon collision of the toner with the photoreceptor, but the contact area of the metal oxides with the toner is also higher so that with the slight heat, a temperature higher than the glass transition temperature is hardly obtained. That is, the particles having a larger diameter tend to be hardly embedded in the toner surface. The above resin obtained by polymerizing polymerizable monomers having vinyl double bonds is preferred in that the difference in embedding due to the particle diameters of the metal oxides etc. can be reduced.

Specific examples of the vinyl polymerizable monomers include homopolymers or copolymers of styrene or styrene derivatives such as parachlorostyrene and α-methylstyrene; homopolymers or copolymers of esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; homopolymers or copolymers of vinyl nitriles such as acrylonitrile and methacrylonitrile; homopolymers or copolymers of vinyl ethers such as vinyl methyl ether and vinyl isobutyl ether; homopolymers or copolymers of vinyl methyl ketone, vinyl ethyl ketone, vinyl isopropenyl ketone etc.; and homopolymers or copolymers of olefins such as ethylene, propylene, butadiene and isoprene.

These resins may be used alone or as a mixture of two or more thereof.

From the viewpoint of regulation of the glass transition temperature, the polymer used is preferably a copolymer, and the copolymer used in the invention is a resin obtained by copolymerizing a combination of monomers giving homopolymers significantly different in glass transition temperature while regulating the monomer composition such that the glass transition temperature is in the preferred range described above.

Among copolymers obtained by copolymerizing the above vinyl polymerizable monomers, it is preferred to use copolymers obtained by copolymerizing styrene and styrene derivatives such as p-chlorostyrene and α-methylstyrene; and combinations of short-chain alkyl acrylates such as methyl acrylate and methyl methacrylate and n-propyl acrylate, n-butyl acrylate, lauryl acrylate, 2-ethylhexyl acrylate, n-propyl methacrylate, lauryl methacrylate and 2-ethylhexyl methacrylate.

Insofar as the binder resin contains the resin described above, the binder resin may also employ other resins. Specifically, the other resins include, but are not limited to, silicone resin such as methyl silicone and methyl phenyl silicone, polyesters containing bisphenol, glycol etc., epoxy resin, polyurethane resin, polyamide resin, cellulose resin, polyether resin, polycarbonate resin etc.

The ratio of the other resins to the resin(s) obtained by polymerizing the polymerizable monomer(s) having a vinyl double bond is preferably in the range of 0 to 50% by mass, more preferably in the range of 1 to 30% by mass, still more preferably in the range of 2 to 20% by mass. When the ratio is higher than 50% by mass, the effect of the resin obtained by polymerizing the polymerizable monomer having a vinyl double bond is decreased so that the effect of the invention may not be achieved.

The colorant used in the toner for electrostatic latent image development in the invention preferably contains at least one selected from cyan, magenta, yellow and black pigments. These colorants may be used alone or as a mixture of two or more pigments of the same type. Further, a mixture of two or more pigments of different types may also be used.

The colorant includes, for example, pigments such as chrome yellow, Hansa yellow, benzidine yellow, threne yellow, quinoline yellow, permanent orange GTR, pyrazolone orange, vulcan orange, watch young red, permanent red, brilliant carmine 3B, brilliant carmine 6B, Dupont oil red, pyrazolone red, lithol red, rhodamine B lake, lake red C, rose Bengal, aniline blue, ultramarine blue, chalco oil blue, methylene blue chloride, phthalocyanine blue, phthalocyanine green, malachite green oxalate, farness black, channel black, acetylene black, thermal black and lamp black as well as dyestuffs of acridine type, xanthene type, azo type, benzoquinone type, azine type, anthraquinone type, dioxazine type, thiazine type, azomethine type, indigo type, thioindigo type, phthalocyanine type, aniline black type, polymethine type, triphenyl methane type, diphenyl methane type, thiazole type and xanthene type.

In production of the toner for electrostatic latent image development used in the image forming method in the invention, a surfactant can be used for example for the purpose of stabilization of the dispersion in the suspension polymerization process and stabilization of the resin particle dispersion, the colorant dispersion and the releasing agent dispersion in the emulsion-polymerization aggregation process.

The surfactant includes, for example, anionic surfactants such as sulfate esters, sulfonates, phosphate esters, and soap; cationic surfactants such as amine salts and quaternary ammonium salts; and nonionic surfactants such as polyethylene glycol, alkyl phenol ethylene oxide adducts and polyvalent alcohols. Among these, the ionic surfactants are preferred, and the anionic surfactants and cationic surfactants are more preferred.

In the toner in the invention, since the anionic surfactant generally has a high dispersing ability and is excellent in dispersing resin particles and colorants, the anionic surfactant is advantageously used as a surfactant for dispersing the releasing agent.

The nonionic surfactant is used preferably in combination with the anionic or cationic surfactant described above. The surfactants may be used alone or as a mixture of two or more thereof.

Specific examples of the anionic surfactant include aliphatic soaps such as potassium laurate, sodium oleate, and sodium castor oil; sulfate esters such as octyl sulfate, lauryl sulfate, lauryl ether sulfate and nonyl phenyl ether sulfate; sodium alkyl sulfonates such as lauryl sulfonate, dodecyl benzene sulfonate, trisisopropyl naphthalene sulfonate, and dibutyl naphthalene sulfonate; sulfonates such as naphthalene sulfonate/formalin condensates, monooctyl sulfosuccinate, dioctyl sulfosuccinate, lauric amide sulfonate and olefic amide sulfonate; phosphate esters such as lauryl phosphate, isopropyl phosphate and nonyl phenyl ether phosphate; dialkyl sulfosuccinates such as sodium dioctyl sulfosuccinate; and sulfosuccinates such as disodium lauryl sulfosuccinate.

Specific examples of the cationic surfactant include amine salts such as laurylamine hydrochloride, stearylamine hydrochloride, oleylamine acetate, stearylamine acetate and stearylaminopropylamine acetate, and quaternary ammonium salts such as lauryl trimethyl ammonium chloride, dilauryl dimethyl ammonium chloride, distearyl dimethyl ammonium chloride, distearyl dimethyl ammonium chloride, lauryl dihydroxyethyl methyl ammonium chloride, oleyl bispolyoxy ethylene methyl ammonium chloride, lauroyl aminopropyl dimethyl ethyl ammonium ethosulfate, lauroyl aminopropyl dimethyl hydroxyethyl ammonium perchlorate, alkyl benzene trimethyl ammonium chloride and alkyl trimethyl ammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate and polyoxyethylene oleate; alkyl amines such as polyoxyethylene lauryl aminoether, polyoxyethylene stearyl aminoether, polyoxyethylene oleyl aminoether, polyoxyethylene soybean aminoether and polyoxyethylene tallow aminoether; alkyl amides such as polyoxyethylene lauric amide, polyoxyethylene stearic amide and polyoxyethylene oleic amide; vegetable oil ethers such as polyoxyethylene castor oil ether and polyoxyethylene rapeseed oil ether; alkanol amides such as lauric acid diethanol amide, stearic acid diethanol amide and oleic acid diethanol amide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The content of the surfactant in each dispersion may be in such a range that the effect of the invention is not deteriorated, and the content is generally low and specifically in the range of about 0.01 to 10% by mass, more preferably in the range of 0.05 to 5% by mass, still more preferably in the range of 0.1 to 2% by mass. A content outside of the above range is not preferred because when the content is less than 0.01% by mass, the respective dispersions, that is, the resin particle dispersion, the colorant dispersion and the releasing agent dispersion become instable, to cause problems such as aggregation and release of specific particles during aggregation due to a difference in stability among the particles, while when the content is greater than 10% by mass, the particle size distribution is broadened or the particle diameter is hardly regulated. Generally, a toner dispersion having a large particle diameter produced by suspension polymerization is stable even if the surfactant is used in a small amount.

The dispersion stabilizer used in the suspension polymerization process can be water-sparingly-soluble and hydrophilic inorganic fine powder. The usable inorganic fine powder include silica, alumina, titania, calcium carbonate, magnesium carbonate, tricalcium phosphate (hydroxyapatite), clay, diatomaceous earth, bentonite etc. Among these, calcium carbonate and tricalcium phosphate are preferred in respect of easiness of formation and removal of fine particles thereof.

Further, aqueous polymers that are solid at ordinary temperature can also be used. Specifically, cellulose compounds such as carboxymethyl cellulose and hydroxypropyl cellulose, and polyvinyl alcohol, gelatin, starch, arabic gum etc. can be used.

A crosslinking agent may be added if necessary to the binder resin in the invention.

Specific examples of such crosslinking agents include aromatic polyvinyl compounds such as divinyl benzene and divinyl naphthalene; polyvinyl esters of aromatic polyvalent carboxylic acids, such as divinyl phthalate, divinyl isophthalate, divinyl terephthalate, divinyl homophthalate, divinyl/trivinyl trimesate, divinyl naphthalene dicarboxylate and divinyl biphenyl carboxylate; divinyl esters of nitrogen-containing aromatic compounds, such as divinyl pyridine dicarboxylate; vinyl esters of unsaturated heterocyclic carboxylic acids, such as vinyl pyromucate, vinyl furan carboxylate, vinyl pyrrole-2-carboxylate and vinyl thiophene carboxylate; (meth)acrylates of linear polyvalent alcohols, such as butane diol methacrylate, hexane diol acrylate, octane diol methacrylate, decane diol acrylate and dodecane diol methacrylate; (meth)acrylate of branched, substituted polyvalent alcohols, such as neopentyl glycol dimethacrylate and 2-hydroxy-1,3-diacryloxy propane; polyethylene glycol di(meth)acrylate, polypropylene polyethylene glycol di(meth)acrylate; and polyvinyl esters of polyvalent carboxylic acids, such as divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, divinyl docecane diacid ester and divinyl brassylate.

In the invention, these crosslinking agents may be used alone or as a mixture of two or more thereof. To achieve the preferred range of storage of elastic modulus at 160° C. (G'(160)), the crosslinking agents in the invention are preferably (meth)acrylates of linear polyvalent alcohols, such as butane diol methacrylate, hexane diol acrylate, octane diol methacrylate, decane diol acrylate and dodecane diol methacrylate; (meth)acrylates of branched, substituted polyvalent alcohols, such as neopentyl glycol dimethacrylate and 2-hydroxy-1,3-diacryloxypropane; and polyethylene glycol di(meth)acrylate, polypropylene polyethylene glycol di(meth)acrylate etc.

The content of the crosslinking agent is preferably in the range of 0.05 to 5% by mass, more preferably in the range of 0.1 to 1.0% by mass, relative to the total amount of the polymerizable monomers.

The resin used in the toner in the invention can be produced by radical polymerization of the polymerizable monomers.

The radical polymerization initiator used in the invention is not particularly limited. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pertriphenyl acetate tert-butylhydroperoxide, tert-butyl performate, tert-butyl peracetate, tert-butyl perbenzoate, tert-butyl perphenylacetate, tert-butyl permethoxyacetate and tert-butyl per-N-(3-tolyl)carbaminate, azo compounds such as 2,2'-azobispropane, 2,2'-dichloro-2,2'-azobispropane, 1,1'-azo(methylethyl) diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methyl valeronitrile, dimethyl 4,4'-azobis-4-cyanovalerate, 2,2'-azobis-2,4-dimethyl valeronitrile, 1, 1'-azobiscyclohexane nitrile, 2,2'-azobis-2-propyl butyronitrile, 1,1'-azobis-1-chlorophenyl ethane, 1,1'-azobis-1-cyclohexane carbonitrile, 1,1'-azobis-1-cycloheptane nitrile, 1,1'-azobis-1-phenyl ethane, 1,1'-azobiscumene, ethyl 4-nitrophenylazobenzylcyanoacetate, phenyl azodiphenyl methane, phenyl azotriphenyl methane, 4-nitrophenyl azotriphenyl methane, 1,1'-azobis-1,2-diphenyl ethane, poly (bisphenol A-4,4'-azobis-4-cyanopentanoate) and poly(tetraethylene glycol-2,2'-azobisisobutyrate), 1,4-bis (pentaethylene)-2-tetrazene, 1,4-dimethoxycarbonyl-1,4-diphenyl-2-tetrazene, etc.

When the emulsion-polymerization aggregation process is used in production of the toner in the invention, toner particles can be prepared by aggregation caused by a change in pH in the aggregation step. Simultaneously, an aggregating agent may be added for stable and rapid aggregation of the particles or for obtaining the aggregated particles having a narrower particle size distribution.

The aggregation agent preferably has mono- or higher valent charge, and specific examples thereof include the above-mentioned water-soluble surfactants such as ionic surfactants and nonionic surfactants, acids such as hydrochloric acid, sulfuric acid, nitric acid, acetic acid and oxalic acid, inorganic acid metal salts such as magnesium chloride, sodium chloride, aluminum sulfate, calcium sulfate, ammonium sulfate, aluminum nitrate, silver nitrate, copper sulfate and sodium carbonate, aliphatic or aromatic acid metal salts such as sodium acetate, potassium formate, sodium oxalate, sodium phthalate and potassium salicylate, metal salts of phenols, such as sodium phenolate, amino acid metal salts, and inorganic acid salts of aliphatic or aromatic amines, such as triethanol amine hydrochloride and aniline hydrochloride.

In consideration of the stability of the aggregated particles, the stability of the aggregating agent against heat or with time, and removability thereof during washing, the aggregating agent is preferably a metal salt of inorganic acid in respect of performance and usability. Specific examples thereof include metal salts of inorganic acids, such as magnesium chloride, sodium chloride, aluminum sulfate, calcium sulfate, ammonium sulfate, aluminum nitrate, silver nitrate, copper sulfate and sodium carbonate.

Though the amount of the aggregating agent added is varied depending on its charge, and the amount is small in any cases, for example 3% by mass or less in the case of the monovalent aggregating agent, 1% by mass or less in the case of the bivalent one, 0.5% by mass or less in the case of the trivalent one. Because the amount of the aggregating agent is preferably lower, the compound of higher valence is preferably used.

A releasing agent can be added to the toner used in the image forming method of the invention. By adding the releasing agent, the toner can be released from a fixing member without applying silicone oil onto a fixing device, and the fixing device does not require an oil feeder and can thus be down-sized and light-weighted.

When the emulsion aggregation coalescence process or the suspension polymerization process is used in production of the toner in the invention, it is estimated that at the time of aggregation and coalescence in the emulsion-polymerization aggregation process or at the time of dispersion in the suspension polymerization, the generally hydrophobic releasing agent is incorporated into the particles and thus hardly occurs on the surfaces of the particles, and as described above, the resin containing a large amount of carboxyl groups having a higher glass transition temperature is present on the surfaces of the particles, thus facilitating formation of the particles. In the conventional kneading-pulverizing process, on the other hand, a large amount of the releasing agent is present on the surfaces of the particles at the time of pulverization, thus causing disadvantages such as easy coalescence of the particles.

Specific examples of the releasing agent include low-molecular polyolefins such as polyethylene, polypropylene and polybutene; silicones having a softening point; fatty amides such as oleic amide, erucic amide, ricinoleic amide and stearic amide; vegetable wax such as carnauba wax, rice wax, candelilla wax, Japan wax and jojoba oil; animal wax such as beeswax; mineral and petroleum wax such as montan wax, ozokerite, seresin, paraffin wax, microcrystalline wax and Fischer-Tropsch wax; ester waxes of higher fatty acids and higher alcohols, such as stearyl stearate and behenyl behenate; ester waxes of higher fatty acids and monovalent or polyvalent lower alcohols, such as butyl stearate, propyl oleate, glyceride monostearate, glyceride distearate and pentaerythritol tetrabehenate; ester waxes composed of higher fatty acids and polyvalent alcohol polymers, such as diethylene glycol monostearate, dipropylene glycol distearate, diglyceride distearate and triglyceride tetrastearate; sorbitan higher fatty ester waxes such as sorbitan monostearate; and cholesterol higher fatty ester waxes such as cholesteryl stearate.

These releasing agents may be used alone or as a mixture of two or more thereof.

The amount of the releasing agent added is preferably in the range of 0.5 to 50% by mass, more preferably in the range of 1 to 30% by mass, more preferably in the range of 5 to 15% by mass, relative to the whole of the toner particles. When the amount is less than 0.5% by mass, the effect of the releasing agent is not sufficient, and when the amount is higher than 50% by mass, charging is readily influenced or the toner is easily broken in a development device, and the releasing agent is made spent by the carrier, and thus there appear not only influences such as easy drop in charging but also insufficient exudation of the releasing agent from the color toner onto the surface of an image at the time of fixation to permit the releasing agent to remain on the image, thus deteriorating transparency in some cases.

The toner for electrostatic latent image development used in the invention should have at least one kind of metal oxide particles and/or metal nitride particles on the surface of the toner. These metal oxide and metal nitride particles can improve the fluidity of the toner and achieve sharp charging among the particles, to improve the qualities of an image at the time of development.

Specific examples of the metal oxide particles include silica, titania, zinc oxide, strontium oxide, aluminum oxide, calcium oxide, magnesium oxide, cerium oxide or composite oxides thereof, and the metal nitride particles include silicon nitride, aluminum nitride, titanium nitride, zinc nitride, calcium nitride, magnesium nitride and cerium nitride. Among these, silica and titania are used preferably from the viewpoint of the particle diameter, particle-size distribution and productivity.

The average particle diameter of the metal oxide or metal nitride particles, in terms of primary particle diameter, is preferably in the range of 1 to 40 nm, more preferably in the range of 5 to 20 nm.

These metal oxide and metal nitride particles may be used alone or as a mixture of two or more thereof. The amount of these particles added to the toner is not particularly limited, but preferably these particles are used in the range of 0.1 to 10% by mass. More specifically, these particles are used in the range of 0.2 to 8% by mass.

When the amount thereof added is less than 0.1% by mass, the effect of the metal oxides etc. added is hardly achieved, and thus the flowability of the powdery toner is deteriorated, to cause problems such as blocking in a development device. When the amount is higher than 10% by mass, the external additives in a free form are increased, and thus the surface of the photoreceptor is abraded and scratched more easily.

Depending on the ratio of metal oxide and metal nitride particles having diameters of 0.03 μm or smaller to the total metal oxide and metal nitride particles, the toner for electrostatic latent image development used in the invention undergoes a change in various characteristics such as powdery flowability and transferability in addition to embedding property upon collision of the toner with the photoreceptor as the effect of the invention. Generally, when the amount of metal oxide and metal nitride particles having a smaller diameter is high, the flowability of the powdery toner is improved, while the transferability thereof is deteriorated. On the other hand, when the amount of metal oxide and metal nitride particles having a smaller diameter is low, the transferability is improved, but the flowability of the toner is deteriorated.

The ratio of metal oxide and metal nitride particles of no larger than 0.03 μm in diameter to the total metal oxide and metal nitride particles is preferably in the range of 1 to 70% by mass, more preferably in the range of 5 to 65% by mass, still more preferably in the range of 8 to 60% by mass, in order to achieve good balance among the characteristics of the toner.

A ratio outside of the above range is not preferred because when the ratio is less than 1% by mass, the flowability of the toner is deteriorated to cause problems such as blocking in a development device, and when the ratio is higher than 70% by mass, the surface of the photoreceptor is easily abraded and scratched.

These metal oxide and metal nitride particles may be subjected to surface modification such as treatment for rendering them hydrophobic or hydrophilic. As the means of surface modification, conventionally known methods can be used. Specifically, there is coupling treatment with silane, titanate or aluminate.

The coupling agent used in coupling treatment is not particularly limited, and preferred examples include silane coupling agents such as methyl trimethoxy silane, phenyl trimethoxy silane, methyl phenyl dimethoxy silane, diphenyl dimethoxy silane, vinyl trimethoxy silane, γ-aminopropyl trimethoxy silane, γ-chloropropyl trimethoxy silane, γ-bromopropyl trimethoxy silane, γ-glycidoxy propyl trimethoxy silane, γ-mercaptopropyl trimethoxy silane, γ-ureidopropyl trimethoxy silane, fluoroalkyl trimethoxy silane and hexamethyl disilazane, titanate coupling agents and aluminate coupling agents.

In the invention, it is possible to add not only the resin, the colorant and the releasing agent but also other components (particles) such as internal additives, a charge regulator, organic particles, a lubricant and an abrasive material if necessary.

The internal additives include magnetic materials, for example metals such as ferrite, magnetite, reduced iron, cobalt, manganese and nickel, alloys thereof, or compounds including such metals, and can be used in such an amount that the charging properties of the toner are not deteriorated.

The charging regulator is not particularly limited, but when a color toner is particularly used, a colorless or light-colored charging regulator can be preferably used. For example, dyes composed of complexes of a quaternary ammonium salt compound, a Nigrosine compound, aluminum, iron and chrome, and triphenyl methane-based pigments can be mentioned.

The organic particles include, for example, every kind of particles used usually as external additives on the surfaces of toners such as vinyl resin, polyester resin and silicone resin. These inorganic or organic particles can be used as a flowability aid, a cleaning aid etc.

The lubricant includes, for example, fatty amides such as ethylene bisstearic amide and oleic amide, and fatty acid metal salts such as zinc stearate and calcium stearate.

The abrasive material includes, for example, silica, alumina and cerium oxide mentioned above.

When the resin, the colorant and the releasing agent are mixed, the content of the colorant may be 50% by mass or less, more preferably in the range of 2 to 40% by mass.

The content of the other components may be in such a range that the object of the invention is not hindered, and generally the content is very low, specifically in the range of 0.01 to 5% by mass, preferably in the range of 0.5 to 2% by mass.

The dispersing medium in the resin particle dispersion, the colorant dispersion, the releasing agent dispersion and the dispersion of other components is for example an aqueous medium.

The aqueous dispersion includes, for example, water such as distilled water and ion-exchanged water, alcohol etc. These may be used alone or as a mixture of two or more thereof.

The surface area of the toner for electrostatic latent image development in the invention is not particularly limited, and can be used in such a range as to be used for usual toners. Specifically, when the BET method is used, the surface area is preferably in the range of 0.5 to 10 $m^2/g$, more preferably 1.0 to 7 $m^2/g$, still more preferably 1.2 to 5 $m^2/g$, further still more preferably 1.2 to 3 $m^2/g$.

The particle size of the toner for electrostatic latent image development in the invention, in terms of volume average particle diameter, is preferably in the range of 3 to 9 μm, more preferably in the range of 4 to 8 μm, still more preferably in the range of 4.5 to 7.5 μm. When the particle size is less than 3 μm, the weight of the toner is so low that upon collision of the toner with the photoreceptor, the force of embedding the metal oxides into the toner surface is low, and as a result, the metal oxides may undesirably remain on the surface of the photoreceptor. When the particle size is greater than 9 μm, the resulting image may be undesirably inferior in reproduction of thin lines at the time of development.

The particle-size distribution of the toner in the invention can be expressed in terms of particle-size distribution indicator GSD. The GSD can be expressed in the following equation.

$$GSD=[(d16/d50)+(d50/d84)]/2$$

wherein d16, d50 and d84 indicate the diameters of 16%, 50% and 84% of the whole toner particles respectively in the order of from large to small particles, and there is the following numerical relationship: d16>d50>d84. Toner particles having smaller GSD are those having more uniform particle sizes. The GSD can be calculated from number-average particle diameter or volume average particle diameter, either of which can be used to calculate the GSD of the toner in the invention.

The GSD is preferably in the range of 1.3 or less, more preferably 1.27 or less, still more preferably 1.25 or less. When the GSD is higher than 1.3, image qualities are deteriorated while fine powders are increased, and thus the metal oxides remain undesirably on the surface of the photoreceptor as described above.

In the invention, inorganic particles such as calcium carbonate and barium sulfate and resin particles such as vinyl resin, polyester resin and silicone resin may be added onto the surface of the obtained toner for electrostatic latent image development in a dry state under application of shearing force. These inorganic particles and resin particles function as external additives such as flowability aids or cleaning aids.

In the invention, the absolute value of charge of the toner for electrostatic latent image development is preferably in the range of 10 to 40 μC/g, more preferably in the range of 15 to 35 μC/g. When the charging is less than 10 μC/g, background blemish readily occurs, while when charging is higher than 40 μC/g, image density is readily lowered.

The ratio of the charge in summer to the charging in winter (charge in summer/charge in winter) of the toner for electrostatic latent image development is preferably in the range of 0.5 to 1.5, more preferably in the range of 0.7 to 1.3. When the ratio is outside of the preferred range, the dependence of the toner on environments is high, and the toner is poor in charging stability, and is not preferred in practical use.

-Electrostatic Latent Image Developing Agent-

Insofar as the electrostatic latent image developing agent contains the toner for electrostatic latent image development in the invention, the developing agent is not particularly limited in the invention, and can use a suitable composition depending on the object. The electrostatic latent image developing agent in the invention is a one-component electrostatic latent image developing agent when the toner for electrostatic latent image development is used alone or a two-component electrostatic latent image developing agent when the toner is used in combination with a carrier.

When a carrier is used, the carrier is not particularly limited, and a carrier known per se can be used. Examples thereof include known carriers such as resin-coated carriers described in JP-A Nos. 62-39879 and 56-11461 etc.

Examples of the carrier include resin-coated carriers. Examples of the core particles of the carriers include usual iron powders or powders formed from ferrite or magnetite, and the volume average particle diameter thereof is preferably in the range of 30 to 200 μm.

The coating resin for the resin-coated carriers includes, for example, homopolymers or copolymers of monomers such as styrene or derivatives thereof such as p-chlorostyrene and α-methyl styrene; α-methylene fatty monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryl derivatives such as dimethylaminoethyl methacrylate; vinyl nitriles such as acrylonitrile and methacrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; and vinyl type fluorine-containing monomers such as vinylidene fluoride, tetrafluoroethylene and hexafluoroethylene; silicone resins such as methyl silicone, methyl phenyl silicone etc.; polyesters containing bisphenol, glycol etc.; epoxy resin, polyurethane resin, polyamide resin, cellulose resin, polyether resin, polycarbonate resin etc. These resins may be used alone or as a mixture of two or more thereof. The amount of the coating resin is preferably in the range of 0.1 to 10 parts by mass, more preferably 0.5 to 3.0 parts by mass, relative to 100 parts by mass of the core particles.

For production of the carrier, a heating kneader, a heating Henschel mixer, an UM mixer etc. can be used. Depending on the amount of the coating resin, a heated fluidized rolling bed, a heated kiln etc. can be used.

The mixing ratio of the toner for electrostatic latent image development in the invention to the carrier in the electrostatic latent image developing agent is not particularly limited, and can be suitably determined depending on the object.

The invention comprises a step of transferring a toner image formed on the surface of the electrostatic latent image bearing body to the surface of a transfer material, wherein the transfer material is preferably a transfer belt having a surface of Vickers hardness in the range of 5HV0.30 to 1000HV0.30.

That is, the abrasion and/or scratching of the surface of the intermediate transfer material (transfer material) upon adhesion of the toner to the surface of the intermediate transfer material in the transfer step is prevented by regulating the Vickers hardness of the surface of the intermediate transfer material, the shape of the toner, and the storage of elastic modulus of the toner at 160° C. By preventing the deterioration in the surface of the intermediate transfer material in the transfer step, it is possible to provide an image forming method having less image defect such as streaks generated in an image, reduction in image density and reduction in the ability to reproduce thin lines.

In the transfer step using the intermediate transfer material, a toner image formed on the surface of the photoreceptor is transferred generally to the surface of the intermediate transfer material. When the toner is contacted with the intermediate transfer material in the transfer step, metal oxides as external additives such as silica and titania occur in a sandwiched form between the surface of the intermediate transfer material and the surface of the toner in the same manner as upon allowing the photoreceptor to contact with the toner as described above. The hardness of the metal oxides is generally so high that the surface of the intermediate transfer material composed of a resin is scratched. When transfer is carried out repeatedly in the electrophotographic process, scratching in each transfer step is slight, but is enlarged by repeated transfer, thus abrading the surface of the intermediate transfer material. This tendency is particularly significant in the field of graphic arts where the amount of toners developed at one time is high.

Accordingly, the image-forming method using the intermediate transfer material system may not provide final images with stable high qualities by merely reducing scratches on the surface of the photoreceptor as described above.

The present inventors found that this problem can be solved by regulating the Vickers hardness of the surface of the intermediate transfer material, the shape of the toner, and the storage of elastic modulus at 160° C. of the toner.

That is, when a transfer belt having a surface of Vickers hardness in the range of 5HV0.30 to 1000HV0.30 is used as the intermediate transfer material, the pressure exerted on the external additives present on the surface of the toner subjected to repeated transfer can be suitably reduced, and one particle of the toner having shape factor SF1 in the range of 110 to 140 can contact with a greater area on the surface of the intermediate transfer material, and the pressure exerted per metal oxide on external additives sandwiched between the intermediate transfer material and the toner can be reduced as described above. Further, by regulating the storage of elastic modulus of the toner at 160° C. in the range of 80 to 620 Pa, the metal oxides as external additives sandwiched upon allowing the toner to contact with the surface of the intermediate transfer material, are embedded in the toner and hardly scratch the surface of the intermediate transfer material. Accordingly, the metal oxides do not remain on the surface of the intermediate transfer material so that in the cleaning step after transfer, the intermediate transfer material is not scratched by the metal oxides, thus preventing the reduction in the performance of the intermediate transfer material as described above.

-Transfer Belt (Transfer Material)-

The transfer belt used in the invention is described. The transfer belt is not particularly limited insofar as it has a surface of Vickers strength in the range of 5HV0.30 to 1000HV0.30.

The Vickers hardness of the surface of the intermediate transfer material in the invention depends to a certain degree on the characteristics of the transfer belt as the intermediate transfer material. When a resin easily deformable is used as an endless belt, it undergoes significant driving deformation due to circulation of the intermediate transfer material. As a result, the toner image transferred to the surface of a recording material is easily distorted. Simultaneously, the surface of the intermediate transfer material is easily abraded and scratched by the external additives on the surface of the toner. Further, when a hardly deformable resin is used as the endless belt, uneven transfer easily occurs due to a difference in the amount of the toner per unit area at the time of transfer. Specifically, in portions where the amount of the toner is lower, the distance(s) between the photoreceptor and the intermediate transfer material and/or the intermediate transfer material and the recording material is/are longer to make transfer(s) difficult, and the density in this region is lowered. This tendency is particularly significant in the field of graphic arts where the amount of the toner used is high.

Accordingly, a resin suitably deformed is used as the intermediate transfer material, and the Vickers strength necessary for the surface of the resin is preferably in the range of 5HV0.30 to 1000HV0.30, more preferably in the range of 10HV0.30 to 900HV0.30, still more preferably in the range of 50HV0.30 to 700HV0.30, in order to achieve the effect of the invention.

When the Vickers strength is less than 5HV0.30, abrasion and scratching due to the external additives occur easily, while when it is higher than 1000HV0.30, uneven transfer occurs easily.

The Vickers hardness can be measured by a method JIS-Z2244, and for example, the above-mentioned 5HV0.30 indicates that the Vickers hardness is 5 when tested under a loading of 0.30 N.

Specific examples of the material of the intermediate transfer material in the invention include polycarbonate, polyalkylene phthalate, polyvinyl chloride, polyimide, polyamide, polyamide imide and blended resins thereof. Among these, polycarbonate and thermosetting polyimide are used preferably because of excellent mechanical strength.

The intermediate transfer material in the invention may be a single-layer structure, or a multi-layer structure of two or more layers. In the case of the multi-layer structure, a resin belt, which is easily deformed by driving to cause distorted toner images as described above, is provided with an external layer and/or an inner layer, whereby driving deformation can be controlled, and by forming a resin of high Vickers hardness mainly as the external layer, the abrasion and scratching of the surface of the intermediate transfer material can be regulated, and the reduction in the performance of the intermediate transfer material as described above can be easily controlled, and simultaneously the resin material can be selected from various materials in a broader range.

Inorganic fillers may be added to the intermediate transfer material in the invention. When inorganic fillers are dispersed in the resin, the resin generally tends to hardly undergo driving deformation depending on the size of the dispersion, and thus the abrasion and scratching of the surface of the intermediate transfer material can be regulated, and the reduction in the performance of the intermediate transfer material as described above can be easily controlled, and simultaneously the resin material can be selected from various materials in a broader range.

Specific examples of the inorganic fillers include, for example, carbon-based fillers such as carbon black, graphite, carbon fiber, activated carbon and charcoal; powdery, flaky or fibrous metal fillers of metals such as aluminum, silver, copper, iron, nickel, zinc and stainless steel; metal oxide-based fillers such as zinc oxide, tin oxide, iron oxide, copper oxide, titanium oxide, aluminum oxide, indium oxide, zirconium oxide, silicon oxide, antimony-doped tin oxide, tin-doped indium oxide and tin oxide-coated titanium oxide; metal sulfide-based fillers such as molybdenum disulfide; and calcium carbonate, magnesium carbonate, barium carbonate, aluminum hydroxide, magnesium hydroxide, magnesium oxide, barium sulfate, talc, hydrotalcite, kaolinite, clay, zeolite, montmorilonite, bentonite, worastonite, diatomaceous earth, potassium titanate, boron fiber, glass fiber, glass beads, glass balloon and boron nitride.

Preferred among those described above are carbon-based fillers such as carbon black, graphite, carbon fiber, activated carbon and charcoal; powdery, flaky or fibrous metal fillers of metals such as aluminum, silver, copper, iron, nickel, zinc and stainless steel; metal oxide-based fillers such as zinc oxide, tin oxide, iron oxide, copper oxide, titanium oxide, aluminum oxide, indium oxide, zirconium oxide, silicon oxide, antimony-doped tin oxide, tin-doped indium oxide and tin oxide-coated titanium oxide, among which carbon black, aluminum oxide, titanium oxide and silicone oxide are more preferred for their higher effect on the deformation of the resin caused by driving.

These inorganic fillers may be used alone or as a mixture of a plurality of fillers. When a mixture of a plurality of fillers is used, organic fillers such as polyethylene, poly (methyl methacrylate), polystyrene, polyvinyl chloride, polypropylene and pulp may be used.

Preferably, the surface of the intermediate transfer material in the invention has a compound having a functional group containing a fluorine atom. By allowing a fluorine atom to be present on the surface, the surface energy can be lowered to reduce the adhesion of foreign matters such as non-transferred toner remaining on the surface of the transfer belt. Accordingly, the residual materials on the surface of the transfer belt can be reduced, and abrasion and scratching can be controlled.

Specific examples of the functional group containing a fluorine atom include a monofluoromethyl group, a difluoromethyl group, a trifluoromethyl group, a monofluoromethylene group and a difluoromethylene group, and one of these groups may be present on the surface of the transfer belt, or a plurality of groups may be present.

Specific examples of compounds having these functional groups include homopolymers such as polytetrafluoroethylene, polyvinylidene fluoride, polytrifluoroethylene and polyvinyl fluoride; copolymers such as an ethylene-tetrafluoroethylene copolymer, an ethylene-vinylidene fluoride copolymer, a tetrafluoroethylene-hexafluoropropylene copolymer, a tetrafluoroethylene-perfluoroalkyl vinyl ether copolymer; and rubber such as a vinylidene fluoride-chlorotrifluoroethylene copolymer, a vinylidene fluoride-hexafluoropropylene copolymer, a vinylidene fluoride-hexafluoropropylene-tetrafluoroethylene copolymer, and a tetrafluoroethylene-propylene copolymer.

Among these, polyvinylidene fluoride, polyvinyl fluoride, an ethylene-tetrafluoroethylene copolymer and an ethylene-vinylidene fluoride copolymer are preferred from the viewpoint of the effect of reducing the surface energy of the intermediate transfer material and the adhesion property of the intermediate transfer material.

More preferably, the surface of the intermediate transfer material in the invention contains a silicone material. Even though the silicone material is resin, this material is excellent in coatability, and can maintain certain hardness and simultaneously lower the surface energy. Accordingly, abrasion resistance against finely divided particles of high hardness such as external additives can be improved to a certain degree. Further, foreign matters can be prevented from adhering to the surface of the intermediate transfer material, and thus abrasion resistance can be improved and scratching can be prevented.

As a specific example, the silicone material is preferably a compound containing at least one of dimethyl silicone, diphenyl silicone and methyl phenyl silicone. These materials are used preferably as resin, but may be applied as silicone oil. Further, these silicone materials may be simultaneously used. Modified silicone produced by modifying these silicone materials with epoxy resin, polyester resin, acrylic resin, urethane resin and rosin can also be used.

As described above, the toner for electrostatic latent image development comprising the binder resin obtained by polymerizing a polymerizable monomer having a vinyl double bond, having at least one kind of metal oxide particles and/or metal nitride particles on the surface of the toner, having shape factor SF1 in the range of 110 to 140, and having storage of elastic modulus at 160° C. (G'(160)) in the predetermined range is used in the invention, so that even in the transfer step using the transfer belt, the effect on the above-described photoreceptor is brought about, and the abrasion and scratching of the surface of the transfer belt with the external additives hardly occur.

When the transfer belt is used in the invention, the amount of the metal oxides and/or metal nitrides added to the toner is preferably in the range of 0.1 to 10% by mass. The amount is more preferably in the range of 0.2 to 8% by mass, still more preferably in the range of 0.5 to 6% by mass.

When the addition amount is less than 0.1% by mass, the effect of the metal oxides added is hardly achieved, and the flowability of the powdery toner is deteriorated, thus causing problems such as blocking in a development device. When the amount is higher than 10% by mass, the external additives in a free form are increased, and thus the abrasion and scratching of the surface of the transfer belt undesirably occur more easily.

When the transfer belt is used in the invention, there is brought about a change in various properties such as developing ability in addition to the embedding property at the time of collision of the toner with the intermediate transfer material as the effect of the invention, depending on the ratio of 0.03 μm or smaller metal oxide and metal nitride particles to the total metal oxide and/or metal nitride particles. Generally, when the amount of the metal oxides having a smaller diameter is high, the flowability of the powdery toner is improved, while the abrasion and scratching of the surface of the intermediate transfer material easily occur during transfer. On the other hand, when the amount of the metal oxides having a smaller diameter is low, the transferability is improved, but the flowability of the toner is deteriorated.

The ratio of 0.03 μm or less metal oxide particles to the total metal oxides is preferably in the range of 1 to 80% by mass, more preferably in the range of 5 to 65% by mass, still more preferably in the range of 10 to 50% by mass, in order to achieve good balance among the characteristics of the toner.

A ratio outside of the above range is not preferred because when the ratio is less than 1% by mass, the flowability of the toner is deteriorated to cause problems such as blocking in a development device, and when the ratio is higher than 80% by mass, the surface of the photoreceptor is easily abraded and scratched.

Now, the respective steps of the image forming method of the invention are described.

The step of forming an electrostatic latent image in the invention is a step in which an electrostatic latent image bearing body whose surface is uniformly charged is exposed to light by a means of light exposure such as a laser optical system or LED arrays, to form an electrostatic latent image. In the image forming method of the invention, the light exposure system is not particularly limited.

The method of forming a toner image in the invention is a step in which a developing agent bearing body having a developing agent layer containing at least the toner formed thereon is contacted with or made close to the surface of the electrostatic latent image bearing body, whereby toner particles are allowed to adhere to the electrostatic latent image on the surface of the electrostatic latent image bearing body, to form a toner image on the surface of the electrostatic latent image bearing body. The development system can make use of a known system, and the development system using the two-component developing agent used in the invention includes a cascade system and a magnetic brush system. In the image forming method of the invention, the development system is not particularly limited.

The transfer step in the invention is a step of transferring the toner image formed on the surface of the electrostatic latent image bearing body onto a transfer material to form a transfer image. It is preferred in formation of a full-color image that toners of each color are primarily transferred onto an intermediate transfer drum or a transfer belt as the intermediate transfer material (transfer material) and then secondarily transferred onto a recording material such as paper. From the viewpoint of general usability of paper and high image qualities, it is preferred that color toner images of respective colors are temporarily transferred onto the intermediate transfer material and then transferred all at once onto a recording material.

As the transfer unit for transferring the toner image from the photoreceptor onto a paper or the intermediate transfer material, Corotron can be used. Corotron is effective as a means of uniformly charging a paper, but requires a high-voltage power source because high voltage in the order of kV should be applied to charge the paper as a recording material to a predetermined degree. Because ozone is generated upon corona discharge to deteriorate rubber parts and the photoreceptor, it is preferred to employ a contact transfer system wherein an electroconductive transfer roll made of an elastic material is abutted on the electrostatic latent image bearing body, to transfer a toner image to a paper.

In the image forming method of the invention, the transfer material used is preferably a transfer belt as described above, but the transfer device is not particularly limited.

The thermally fixing step in the invention is a step in which the toner image transferred onto the surface of the recording material is fixed with a fixing device. The fixing device is preferably a thermally fixing device using a heat roll. The thermally fixing device is composed of e.g. a fixing roller including a heater lamp for heating in the inside of a cylindrical core metal and a releasing layer, which is a heat resistant resin coating layer or a heat resistant rubber coating layer, on the periphery of the heater lamp, as well as a pressure roller or a pressure belt abutted on the fixing roller and comprising a heat resistant elastic layer on the periphery of a cylindrical core metal or on the surface of a belt-shaped base material. The process of fixing the non-fixed toner image is carried out by allowing a recording material having a non-fixed toner image formed thereon to pass between the fixing roller and the pressure roller or the pressure belt and fixing the toner image by heat-melting the binder resin, the additives etc. in the toner.

In the image forming method of the invention, the fixing system is not particularly limited.

As an example, the image forming device used preferably in the image forming method of the invention is shown in FIG. 1.

This device is provided around a photosensitive drum 1 with a charging device 2, an image writing means 3 such as laser light, a development device 4, a primary transfer device 5, a cleaning device 6 etc. along the direction shown by arrow A, and development units 4*a* to 4*d* in the development device 4 accommodate toners of each color such as black, yellow, magenta and cyan. A transfer belt 7 in contact with the photosensitive drum 1 and running between the photosensitive drum 1 and the primary transfer device 5 in the direction of arrow B is stretched by tension rolls 8*a*, 8*b*, 8*c* and a backup roll 9. The backup roll 9 and a bias roll 10 sandwich the transfer device 5, and the tension roll 8*a* and a belt cleaner 11 also sandwich the transfer device 5.

In FIG. 1, the site at which the primary transfer unit 5 presses the photosensitive drum 1 via the transfer belt 7 is a primary transfer region, and the site at which the bias roll 10 presses the backup roll 9 is a second transfer region. Then, a toner image is transferred from the transfer belt 7 onto a transfer paper P supplied from a paper feed tray 13 in the direction of arrow C to the secondary transfer region, and then transported to a fixing device 14 where the toner image is fixed.

In the image forming device, the developing agent used in the invention is used as an electrostatic latent image developing agent, whereby the abrasion and oxidation of the surface of the photoreceptor with the metal oxide particles as external additives in the toner or on the surface of the toner can be prevented in the steps of charging, development, transfer and cleaning, whereby deterioration in the performance of the photoreceptor, such as a change in potential and sensitivity can be reduced, and deterioration in performance such as abrasion and scratching of the surface of the transfer belt, uneven transfer, reduction in image density, and streaks, can be reduced, thereby stably forming an image of high qualities.

EXAMPLES

Hereinafter, the present invention is described in more detail by reference to Examples, but the invention is not limited to the Examples.

In the following description, the term "parts" refers to parts by mass.

<Methods of Measuring Characteristics>

First, the measurement method and evaluation method for the toners and the developing agents used in the Examples and Comparative Examples are described.

The average particle diameter of the toner was measured by a Coulter counter (TA2 type manufactured by Beckman Coulter, Inc.). Further, the glass transition temperature of the resin in resin particles and toner particles was measured at an increasing rate of 3° C./min. with a differential scanning calorimeter (DSC-50 manufactured by Shimadzu Corporation).

The average particle diameters of resin particles, colorant particles and releasing agent particles in the emulsion-polymerization aggregation process were determined by a laser diffractive particle-size distribution measuring instrument (LA-700 manufactured by Horiba, Ltd.). The molecular weight and molecular-weight distribution of resin particles and toner particles were determined by gel permeation chromatography (HLC-8120GPC manufactured by Tosoh Corporation).

The shape factor SF1 of the toner is expressed by the average of (maximum length of toner)$^2$/(projected area of toner)×(π/4)×100, and determined as follows: First, a photomicrograph of toners scattered on a slide glass was incorporated via a video camera into an image analysis unit, and 50 or more toner particles were used to determine (maximum length)$^2$/(projected area) ($ML^2/A$) of the toner particles, to calculate the average thereof. As the image analysis unit, a LUZEX image analysis unit (LUZEX Inc.) was used.

The storage of elastic modulus (G) in the invention was carried out by using a viscoelasticity measuring instrument (ARES manufactured by Rheometric Scientific F.E. Ltd.). First, the toner for electrostatic latent image development was formed into tablets, and the tablet was set between parallel plates of 20 mm in diameter and vibrated at a frequency of 6.28 rad/sec. after normal force was set at 0. The measurement temperature was 100° C. to 190° C., and the strain was 1%. The measurement interval was 120 sec., and after the measurement was initiated, the temperature was increased at the rate of 1° C./min., and the storage of elastic modulus at 160° C. was determined as G'(160).

<Preparation of Photoreceptor>

-Preparation of Photoreceptor (1)-

| | |
|---|---|
| X-type non-metal phthalocyanine | 1 part |
| Vinyl chloride/vinyl acetate copolymer (VMCH manufactured by Union Carbide) | 1 part |
| n-Butyl acetate (Wako Pure Chemical Industries, Ltd.) | 40 parts |

The above components were dispersed for 2 hours in a sand mill using glass beads of 1 mm in diameter, and the resulting dispersion was applied onto the surface of an aluminum pipe (diameter, 84 mm; length, 340 mm) by dipping the aluminum pipe in the dispersion, and dried at 100° C. for 10 minutes, to form a charge generating layer of 0.5 μm in thickness.

Then, a solution prepared by dissolving 1 part of the exemplified compound 1-14 and 1 part of poly(4,4-cyclohexylidenediphenylenecarbonate) resin in 6 parts of monochlorobenzene was applied onto the aluminum pipe having the charge generating layer formed thereon by dipping the aluminum pipe in the solution, and then dried at 135° C. for 1 hour to form a charge transporting layer of 20 μm in thickness to prepare the photoreceptor (1).

-Preparation of Photoreceptor (2)-

A photoreceptor (2) was prepared in the same manner as that in the case of the photoreceptor (1) except that the exemplified compound 3-3 was used as the charge transporting body in place of the exemplified compound 1-14.

-Preparation of Photoreceptor (3)-

A photoreceptor (3) was prepared in the same manner as that in the case of the photoreceptor (1) except that the exemplified compound 5-1 was used as the charge transporting body in place of the exemplified compound 1-14.

<Preparation of a Transfer Belt>

-Preparation of a Transfer Belt (1)-

| | |
|---|---|
| Polyimide varnish for heat-resistant coating (U varnish manufactured by Ube Industries, Ltd.) | 85 parts |
| Carbon black (Raven 1020 manufactured by Columbian Chemicals Company) | 15 parts |

The above components were heated and mixed by a known method, and formed into an endless belt (thickness, 400 μm; width, 310 mm) by centrifugal molding. Thereafter, a mixture of 20 parts of a methyl silicone-based resin coating (TSR1510 manufactured by GE Toshiba Silicones) and 80 parts of toluene (Wako Pure Chemical Industries, Ltd.) was applied onto one side of the endless belt by a known method and left at 120° C. for 2 hours to form a silicone resin layer. Further, 2 parts of a fluorine resin coating (Tough coat enamel manufactured by Daikin Industries, Ltd.) were applied by a known method onto the surface of the silicone resin layer of the endless belt and left at 120° C. for 1 hour to form a fluorine resin layer to give a transfer belt (1).

The Vickers hardness of the surface of the transfer belt (1) was 280HV0.30. When a section of this transfer belt was observed, it was confirmed that the belt comprised three distinct layers i.e. a polyimide varnish layer containing carbon black, a silicone resin layer and a fluorine resin layer. The thickness of the silicone resin layer was 5 to 8 μm, and the thickness of the fluorine resin layer was about 20 μm.

-Preparation of Transfer Belt (2)-

A transfer belt (2) was produced in the same manner as that in the case of the transfer belt (1) except that 80 parts of polyimide varnish and 20 parts of carbon black were used, and the fluorine resin coating after application was left at 150° C. for 2 hours.

The Vickers hardness of the surface of the transfer belt (2) was 11HV0.30. When a section of this transfer belt was observed, it was confirmed that the belt comprised three distinct layers i.e. a polyimide varnish layer containing carbon black, a silicone resin layer and a fluorine resin layer. The thickness of the silicone resin layer was 5 to 8 μm, and the thickness of the fluorine resin layer was about 20 μm.

-Preparation of Transfer Belt (3)-

A transfer belt (3) was produced in the same manner as that in the case of the transfer belt (1) except that 95 parts of polyimide varnish and 5 parts of carbon black were used, the step of applying the silicone resin coating was omitted, and the fluorine resin coating after application was left at 80° C. for 1 hour.

The Vickers hardness of the surface of the transfer belt (3) was 910HV0.30. When a section of this transfer belt was observed, it was confirmed that the belt comprised two distinct layers i.e. a polyimide varnish layer containing carbon black and a fluorine resin layer. The thickness of the fluorine resin layer was about 20 μm.

-Preparation of Transfer Belt (4)-

| | |
|---|---|
| Polyimide varnish for heat-resistant coating (U varnish manufactured by Ube Industries, Ltd.) | 85 parts |
| Carbon black (Raven 1020 manufactured by Columbian Chemicals Company) | 15 parts |
| Methyl silicon-based resin coating (TSR1510 manufactured by GE Toshiba Silicones) | 10 parts |

-continued

| | |
|---|---|
| Fluorine resin coating (Tough coat enamel manufactured by Daikin Industries, Ltd.) | 1 part |

The above components were heated and mixed in the same manner as in preparation of the transfer belt (1), and formed into an endless belt (thickness, 450 μm; width, 310 mm) by centrifugal molding to give a transfer belt (4).

The Vickers hardness of the surface of the transfer belt (4) was 330HV0.30. When a section of this transfer belt was observed, it was confirmed that the belt was composed of a single layer.

-Preparation of Transfer Belt (5)-

A transfer belt (5) was produced in the same manner as that in the case of the transfer belt (1) except that 100 parts of polyimide varnish was used without using carbon black, and the fluorine resin coating after application was left at 150° C. for 2 hours.

The Vickers hardness of the surface of the transfer belt (5) was 610HV0.30. When a section of this transfer belt was observed, it was confirmed that the belt comprised three distinct layers i.e. a polyimide varnish layer, a silicone resin layer and a fluorine resin layer. The thickness of the silicone resin layer was about 7 μm, and the thickness of the fluorine resin layer was about 20 μm.

-Preparation of Transfer Belt (6)-

A transfer belt (6) was produced in the same manner as that in the case of the transfer belt (1) except that the step of applying the silicone resin coating was omitted.

The Vickers hardness of the surface of the transfer belt (6) was 500HV0.30. When a section of this transfer belt was observed, it was confirmed that the belt comprised three distinct layers i.e. a polyimide varnish layer and a silicone resin layer, and the thickness of the silicone resin layer was about 6 μm.

-Preparation of Transfer Belt (7)-

A transfer belt (7) was produced in the same manner as for the transfer belt (1) except that the step of applying the silicone resin coating was omitted, and the fluorine resin coating after the application was left at 180° C. for 2 hours.

The Vickers hardness of the surface of the transfer belt (7) was 140HV0.30. When a section of this transfer belt was observed, it was confirmed that the belt comprised three distinct layers i.e. a polyimide varnish layer and a fluorine resin layer. The thickness of the fluorine resin layer was about 25 μm.

-Preparation of Transfer Belt (8)-

A transfer belt (8) was produced in the same manner as that in the case of the transfer belt (1) except that 4 parts of a silane coupling agent (SH6040 manufactured by Shin-Etsu Chemical Co., Ltd.) were added at the time of the formation of the endless belt, and the fluorine resin coating after the application was left at 180° C. for 2 hours.

The Vickers hardness of the surface of the transfer belt (8) was 2HV0.30. When a section of this transfer belt was observed, it was confirmed that the belt comprised three distinct layers i.e. a polyimide varnish layer, a silicone resin layer and a fluorine resin layer. The thickness of the silicone resin layer was about 9 μm, and the thickness of the fluorine resin layer was about 30 μm.

-Preparation of Transfer Belt (9)-

A transfer belt (9) was produced in the same manner as that in the case of the transfer belt (1) except that 70 parts of polyimide varnish and 15 parts of acrylic resin (BR-108 manufactured by Mitsubishi Rayon Co., Ltd.) were used in place of 85 parts of polyimide varnish at the time of the formation of the endless belt, and the fluorine resin coating after the application was left at 80° C. for 2 hours.

The Vickers hardness of the surface of the transfer belt (9) was 1170HV0.30. When a section of this transfer belt was observed, it was confirmed that the belt comprised three distinct layers i.e. a polyimide varnish/acrylic resin layer, a silicone resin layer and a fluorine resin layer. The thickness of the silicone resin layer was about 7 μm, and the thickness of the fluorine resin layer was about 20 μm.

<Preparation of Toner>

(Preparation of Each Dispersion)

-Preparation of Resin Particle Dispersion (1)-

| | |
|---|---|
| Styrene | 308 parts |
| n-Butyl acrylate | 89 parts |
| 2-Ethylhexyl acrylate | 3 parts |
| Acrylic acid | 10 parts |
| t-Dodecyl mercaptan | 10 parts |
| Divinyl benzene | 3 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 4 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (1).

Then, a part of the resin particle dispersion (1) was left on an oven at 80° C. to remove water, and when the characteristics of the residues were measured, the average particle diameter was 198 nm, the glass transition temperature was 52° C., and the weight average molecular weight was 27,000.

-Preparation of Resin Particle Dispersion (2)-

| | |
|---|---|
| Styrene | 308 parts |
| n-Butyl acrylate | 85 parts |
| Cyclohexyl methacrylate | 7 parts |
| Acrylic acid | 10 parts |
| t-Dodecyl mercaptan | 10 parts |
| Divinyl adipate | 2 parts |

A solution prepared by mixing the above-described components (all of which are manufactured by Wako Pure Chemical Industries, Ltd.) was dispersed and emulsified in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.)

in 580 parts of deionized water in a flask. The mixture was gently stirred for 10 minutes during which 50 parts of deionized water containing 6 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (2).

Then, a part of the resin particle dispersion (2) was left on an oven at 80° C. to remove water, and when the characteristics of the residues were measured, the average particle diameter was 190 nm, the glass transition temperature was 51° C., and the weight average molecular weight was 22,000.

-Preparation of Resin Particle Dispersion (3)-

| | |
|---|---|
| Styrene | 308 parts |
| n-Butyl acrylate | 80 parts |
| Methyl methacrylate | 12 parts |
| Acrylic acid | 10 parts |
| t-Dodecyl mercaptan | 10 parts |
| Divinyl adipate | 2 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 6 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (3).

Then, a part of the resin particle dispersion (3) was left on an oven at 80° C. to remove water, and when the characteristics of the residues were measured, the average particle diameter was 210 nm, the glass transition temperature was 54° C., and the weight average molecular weight was 33,000.

-Preparation of Resin Particle Dispersion (4)-

| | |
|---|---|
| Styrene | 360 parts |
| n-Butyl acrylate | 40 parts |
| Acrylic acid | 10 parts |
| t-Dodecyl mercaptan | 5 parts |
| Divinyl adipate | 4 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 5 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (4).

Then, a part of the resin particle dispersion (4) was left on an oven at 80° C. to remove water, and when the characteristics of the residues were measured, the average particle diameter was 201 nm, the glass transition temperature was 58° C., and the weight average molecular weight was 44,000.

-Preparation of Resin Particle Dispersion (5)-

| | |
|---|---|
| Styrene | 300 parts |
| n-Butyl acrylate | 40 parts |
| Lauryl methacrylate | 60 parts |
| Acrylic acid | 10 parts |
| t-Dodecyl mercaptan | 5 parts |

A solution prepared by mixing the above-described components (all of which are manufactured by Wako Pure Chemical Industries, Ltd.) was dispersed and emulsified in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water in a flask. The mixture was gently stirred for 10 minutes during which 50 parts of deionized water containing 10 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (5).

Then, a part of the resin particle dispersion (5) was left on an oven at 80° C. to remove water, and when the characteristics of the residues were measured, the average particle diameter was 215 nm, the glass transition temperature was 46° C., and the weight average molecular weight was 22,000.

-Preparation of Resin Particle Dispersion (6)-

| | |
|---|---|
| Styrene | 308 parts |
| n-Butyl acrylate | 87 parts |
| 2-Ethylhexyl acrylate | 5 parts |
| Acrylic acid | 10 parts |
| t-Dodecyl mercaptan | 10 parts |
| Divinyl adipate | 3 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 4 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (6).

Then, a part of the resin particle dispersion (6) was left on an oven at 80° C. to remove water, and when the characteristics of the residues were measured, the average particle diameter was 188 nm, the glass transition temperature was 52° C., and the weight average molecular weight was 29,000.

-Preparation of Resin Particle Dispersion (7)-

| | |
|---|---|
| Styrene | 308 parts |
| n-Butyl acrylate | 85 parts |
| Cyclohexyl acrylate | 3 parts |
| Acrylic acid | 7 parts |
| t-Dodecyl mercaptan | 6 parts |
| Divinyl adipate | 3 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 6 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (7).

Then, a part of the resin particle dispersion (7) was left on an oven at 80° C. to remove water, and when the characteristics of the residues were measured, the average particle diameter was 198 nm, the glass transition temperature was 51° C., and the weight average molecular weight was 36,000.

-Preparation of Resin Particle Dispersion (8)-

| | |
|---|---|
| Styrene | 308 parts |
| n-Butyl acrylate | 80 parts |
| Lauryl acrylate | 12 parts |
| Acrylic acid | 6 parts |
| t-Dodecyl mercaptan | 10 parts |
| Divinyl adipate | 2 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 8 parts of sodium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (8).

Then, a part of the resin particle dispersion (8) was left on an oven at 80° C. to remove water, and when the characteristics of the residues were measured, the average particle diameter was 200 nm, the glass transition temperature was 51° C., and the weight average molecular weight was 22,000.

-Preparation of Resin Particle Dispersion (9)-

| | |
|---|---|
| Styrene | 308 parts |
| n-Butyl acrylate | 80 parts |
| t-Dodecyl mercaptan | 10 parts |
| Divinyl benzene | 5 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 5 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (9).

Then, a part of the resin particle dispersion (9) was left on an oven at 80° C. to remove water, and when the characteristics of the residues were measured, the average particle diameter was 221 nm, the glass transition temperature was 52° C., and the weight average molecular weight was 30,000.

-Preparation of Resin Particle Dispersion (10)-

| | |
|---|---|
| Styrene | 300 parts |
| n-Butyl acrylate | 70 parts |
| Hexyl acrylate | 10 parts |
| Acrylic acid | 10 parts |
| t-Dodecyl mercaptan | 2 parts |

A solution prepared by mixing the above-described components (all of which are manufactured by Wako Pure Chemical Industries, Ltd.) was dispersed and emulsified in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water in a flask. The mixture was gently stirred for 10 minutes during which 50 parts of deionized water containing 5 parts of potassium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (10).

Then, a part of the resin particle dispersion (10) was left on an oven at 80° C. to remove water, and when the characteristics of the residues were measured, the average particle diameter was 226 nm, the glass transition temperature was 56° C., and the weight average molecular weight was 51,000.

-Preparation of Resin Particle Dispersion (11)-

| | |
|---|---|
| Styrene | 300 parts |
| n-Butyl acrylate | 50 parts |
| Stearyl acrylate | 30 parts |
| Acrylic acid | 6 parts |
| t-Dodecyl mercaptan | 5 parts |

A solution prepared by mixing the above-described components (all of which are manufactured by Wako Pure Chemical Industries, Ltd.) was dispersed and emulsified, in a flask, in a solution of 4 parts of a nonionic surfactant (Nonipole 8.5, Sanyo Chemical Industries, Ltd.) and 8 parts of an anionic surfactant (Neogen RK, Dai-ichi Kogyo Seiyaku Co., Ltd.) in 580 parts of deionized water. The mixture was gently stirred for 10 minutes during which 50 parts of deionized water containing 12 parts of sodium persulfate (Wako Pure Chemical Industries, Ltd.) dissolved therein were introduced into the mixture, then the atmosphere in the flask was replaced by nitrogen, the mixture in the flask was heated to 70° C. under stirring on an oil bath, and the emulsion polymerization was continued as such for 7 hours. Thereafter, the reaction solution was cooled to room temperature to prepare a resin particle dispersion (11).

Then, a part of the resin particle dispersion (11) was left on an oven at 80° C. to remove water, and when the characteristics of the residues were measured, the average particle diameter was 212 nm, the glass transition temperature was 50° C., and the weight average molecular weight was 18,000.

-Preparation of Colorant Dispersion (1)-

| | |
|---|---|
| Phthalocyanine pigment (PV FAST BLUE, Dainichiseika Color & Chemicals Mgf. Co., Ltd.): | 100 parts |
| Anionic surfactant (Neogen RK, Dai-ichi Kogyo Seiyaku Co., Ltd.): | 2.0 parts |
| Deionized water: | 250 parts |

The components described above were mixed, dissolved, and dispersed with a homogenizer (ULTRA-TURRAX T50 manufactured by IKA Co., Ltd.) to give a colorant dispersion (1) comprising the colorant (phthalocyanine pigment) dispersed therein.

-Preparation of Colorant Dispersion (2)-

| | |
|---|---|
| Magenta pigment (PR122, Dainichiseika Color & Chemicals Mgf. Co., Ltd.): | 80 parts |
| Anionic surfactant (Neogen RK, Dai-ichi Kogyo Seiyaku Co., Ltd.): | 1.5 parts |
| Deionized water: | 200 parts |

The components described above were mixed, dissolved, and dispersed with a homogenizer (ULTRA-TURRAX T50 manufactured by IKA Co., Ltd.) to give a colorant dispersion (2) comprising the colorant (magenta pigment) dispersed therein.

-Preparation of Colorant Dispersion (3)-

| | |
|---|---|
| Yellow pigment (PY180, Clariant (Japan) K. K.): | 60 parts |
| Anionic surfactant (Neogen RK, Dai-ichi Kogyo Seiyaku Co., Ltd.): | 2.0 parts |
| Deionized water: | 250 parts |

The components described above were mixed, dissolved, and dispersed with a homogenizer (ULTRA-TURRAX T50 manufactured by IKA Co., Ltd.) to give a colorant dispersion (3) comprising the colorant (yellow pigment) dispersed therein.

-Preparation of Colorant Dispersion (4)-

| | |
|---|---|
| Carbon black (Regal 330, Cabot Corporation): | 50 parts |
| Anionic surfactant (Neogen RK, Dai-ichi Kogyo Seiyaku Co., Ltd.): | 1.0 part |
| Deionized water: | 150 parts |

The components described above were mixed, dissolved, and dispersed with a homogenizer (ULTRA-TURRAX T50 manufactured by IKA Co., Ltd.) to give a colorant dispersion (4) comprising the colorant (carbon black) dispersed therein.

-Preparation of Releasing Agent Dispersion (1)-

| | |
|---|---|
| Polyethylene wax (Polywax 725, Toyo-Petrolite): | 80 parts |
| Anionic surfactant (Neogen RK, Dai-ichi Kogyo Seiyaku Co., Ltd.): | 1.0 part |
| Deionized water: | 120 parts |

The components described above were mixed, dissolved at 95° C. and dispersed with a homogenizer (ULTRA-TURRAX T50 manufactured by IKA Co., Ltd.) to give a releasing agent dispersion (1) comprising polyethylene wax dispersed therein.

-Preparation of Releasing Agent Dispersion (2)-

| | |
|---|---|
| Stearyl stearate (Riken Vitamin Co., Ltd.): | 80 parts |
| Anionic surfactant (Neogen RK, Dai-ichi Kogyo Seiyaku Co., Ltd.): | 1.0 part |
| Deionized water: | 120 parts |

The components described above were mixed, dissolved at 85° C. and dispersed with a homogenizer (ULTRA-TURRAX T50 manufactured by IKA Co., Ltd.) to give a releasing agent dispersion (2) comprising polyethylene wax dispersed therein.

-Preparation of Releasing Agent Dispersion (3)-

| | |
|---|---|
| Polyethylene wax (Polywax 500, Toyo-Petrolite): | 80 parts |
| Anionic surfactant (Neogen RK, Dai-ichi Kogyo Seiyaku Co., Ltd.): | 1.0 part |
| Deionized water: | 120 parts |

The components described above were mixed, dissolved at 95° C. and dispersed with a homogenizer (ULTRA-TURRAX T50 manufactured by IKA Co., Ltd.) to give a releasing agent dispersion (3) comprising polyethylene wax dispersed therein.

(Preparation of Toner for Electrostatic Latent Image Development (1))

-Aggregation Step-

| | |
|---|---|
| Resin particle dispersion (1) | 238.0 parts |
| Colorant dispersion (1) | 17.5 parts |
| Releasing agent particle dispersion (1) | 17.5 parts |
| Deionized water | 632.5 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, and the mixture was heated to 49° C. under stirring on a heating oil bath. After the dispersion was kept at 49° C. for 30 minutes, formation of aggregated particles having an average particle diameter of about 5.0 μm was confirmed by observation with an optical microscope. 59.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.6 μm was confirmed.

-Coalescence Step-

The pH of the aggregated particle dispersion was 2.9. Hence, the pH was adjusted to 7.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (1).

The volume average particle diameter of the resulting toner was 5.7 μm, the weight average molecular weight Mw was 27,000, and the shape factor SF1 was 122. The storage of elastic modulus at 160° C. (G'(160)) was 340 Pa. 2 parts of hydrophobic titanium oxide (T805, average particle diameter 0.021 μm, manufactured by Nippon Aerosil Co., Ltd.) and 10 parts of hydrophobic silica (RX50, average particle diameter 0.040 μm, manufactured by Nippon Aerosil Co., Ltd.) were added as external additives to 100 parts of the resulting toner particles (1) and mixed by a Henschel mixer to give a toner for electrostatic latent image development (1).

(Preparation of Toner for Electrostatic Latent Image Development (2))

-Aggregation Step-

| | |
|---|---|
| Resin particle dispersion (1) | 234.5 parts |
| Colorant dispersion (2) | 21.0 parts |
| Releasing agent particle dispersion (1) | 17.5 parts |
| Deionized water | 632.5 parts |
| Aluminum sulfate (Wako Pure Chemical Industries, Ltd.) | 1.5 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 49° C. under stirring on a heating oil bath and then kept at 49° C. for 30 minutes, and formation of aggregated particles having an average particle diameter of about 5.1 μm was confirmed by observation with an optical microscope. 59.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.7 μm was confirmed.

-Coalescence Step-

The pH of the aggregated particle dispersion was 2.9. Hence, the pH was adjusted to 7.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (2).

The volume average particle diameter of the resulting toner particles (2) was 5.8 μm, the Mw was 27,000, and the shape factor SF1 was 126. The storage of elastic modulus at 160° C. (G'(160)) was 320 Pa.

The same external additives were added to 100 parts of the resulting toner particles (2) in the same manner as in the case of the toner for electrostatic latent image development (1), to give a toner for electrostatic latent image development (2).

(Preparation of Toner for Electrostatic Latent Image Development (3))

-Aggregation Step-

| | |
|---|---|
| Resin particle dispersion (1) | 234.0 parts |
| Colorant dispersion (3) | 25.3 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 49° C. under stirring on a heating oil bath and then kept at 49° C. for 30 minutes, and formation of aggregated particles having an average particle diameter of about 5.0 μm was confirmed by observation with an optical microscope. 59.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.8 μm was confirmed.

-Coalescence Step-

The pH of the aggregated particle dispersion was 2.9. Hence, the pH was adjusted to 7.0 by gently adding a 0.5% by mass aqueous solution of sodium hydroxide (Wako Pure Chemical Industries, Ltd.), and the mixture was heated to 96° C. and kept at this temperature for 5 hours under stirring.

Thereafter, the pH in the container was adjusted to about 7, and the reaction product was filtered, then washed 4 times with 500 parts of deionized water and dried in a vacuum drying oven to give toner particles (3).

The volume average particle diameter of the resulting toner particles (3) was 5.9 μm, the Mw was 27,000, and the shape factor SF1 was 126. The storage of elastic modulus at 160° C. (G'(160)) was 330 Pa.

The same external additives were added in the same manner as in the toner for electrostatic latent image development (1) to 100 parts of the resulting toner particles (3) to give a toner for electrostatic latent image development (3).

(Preparation of Toner for Electrostatic Latent Image Development (4))

-Aggregation Step-

| | |
|---|---|
| Resin particle dispersion (1) | 238.0 parts |
| Colorant dispersion (4) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, and the mixture was heated to 49° C. under stirring on a heating oil bath. After the mixture was kept at 49° C. for 30 minutes, formation of aggregated particles having an average particle diameter of about 4.9 μm was confirmed by observation with an optical microscope. 59.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.6 μm was confirmed.

-Coalescence Step-

The pH of the aggregated particle dispersion was 2.9. Hence, the pH was adjusted to 7.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (4).

The volume average particle diameter of the resulting toner particles (4) was 5.9 μm, the Mw was 27,000, and the shape factor SF1 was 130. The storage of elastic modulus at 160° C. (G'(160)) was 380 Pa.

The same external additives were added to 100 parts of the resulting toner particles (4) in the same manner as in the case of the toner for electrostatic latent image development (1), to give a toner for electrostatic latent image development (4).

(Preparation of Toner for Electrostatic Latent Image Development (5))

-Aggregation Step-

| | |
|---|---|
| Resin particle dispersion (2) | 238.0 parts |
| Colorant dispersion (1) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 47° C. under stirring on a heating oil bath and then kept at 47° C. for 30 minutes, and formation of aggregated particles having an average particle diameter of about 4.9 μm was confirmed by observation with an optical microscope. 51.0 parts of the resin particle dispersion (2) were added gently to this aggregated particle dispersion and stirred under heating at 47° C. for 60 minutes while the pH was kept at 2.8, and when observed under an optical microscope, formation of aggregated particles having an average particle diameter of about 5.8 μm was confirmed.

-Coalescence Step-

The pH of the aggregated particle dispersion was 2.9. Hence, the pH was adjusted to 7.3 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (5).

The volume average particle diameter of the resulting toner was 6.1 μm, the Mw was 22,000, and the shape factor SF1 was 114. The storage of elastic modulus at 160° C. (G'(160)) was 100 Pa.

The same external additives were added to 100 parts of the resulting toner particles (5) in the same manner as in the case of the toner for electrostatic latent image development (1), to give a toner for electrostatic latent image development (5).

(Preparation of Toner for Electrostatic Latent Image Development (6))

-Aggregation Step-

| | |
|---|---|
| Resin particle dispersion (3) | 238.0 parts |
| Colorant dispersion (1) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 51° C. under stirring on a heating oil bath. After the mixture was kept at 51° C. for 30 minutes, formation of aggregated particles having an average particle diameter of about 4.8 μm was confirmed by observation with an optical microscope. 50.0 parts of the resin particle dispersion (3) were added gently to this aggregated particle dispersion and stirred under heating at 51° C. for 60 minutes while the pH was kept at 2.8, and when observed under an optical microscope, formation of aggregated particles having an average particle diameter of about 5.5 μm was confirmed.

-Coalescence Step-

The pH of the aggregated particle dispersion was 2.9. Hence, the pH was adjusted to 7.3 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (6).

The volume average particle diameter of the resulting toner particles (6) was 6.1 μm, the Mw was 33,000, and the shape factor SF1 was 135. The storage of elastic modulus at 160° C. (G'(160)) was 610 Pa.

The same external additives were added to 100 parts of the resulting toner particles (6) in the same manner as in the case of the toner for electrostatic latent image development (1), to give a toner for electrostatic latent image development (6).

(Preparation of Toner for Electrostatic Latent Image Development (7))

-Aggregation Step-

| | |
|---|---|
| Resin particle dispersion (1) | 238.0 parts |
| Colorant dispersion (1) | 17.5 parts |
| Releasing agent particle dispersion (2) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, and the mixture was heated to 49° C. under stirring on a heating oil bath. After the mixture was kept at 49° C. for 30 minutes, formation of aggregated particles having an average particle diameter of about 5.0 μm was confirmed by observation with an optical microscope. 51.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.6 μm was confirmed.

-Coalescence Step-

The pH of the aggregated particle dispersion was 2.9. Hence, the pH was adjusted to 7.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (7).

The volume average particle diameter of the resulting toner particles (7) was 6.0 μm, the Mw was 27,000, and the shape factor SF1 was 135. The storage of elastic modulus at 160° C. (G'(160)) was 240 Pa.

The same external additives were added to 100 parts of the resulting toner particles (7) in the same manner as in the case of the toner for electrostatic latent image development (1) to give a toner for electrostatic latent image development (7).

(Preparation of Toner for Electrostatic Latent Image Development (8))

-Aggregation Step-

| | |
|---|---|
| Resin particle dispersion (1) | 238.0 parts |
| Colorant dispersion (1) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 49° C. under stirring on a heating oil bath and then kept at 49° C. for 30 minutes, and formation of aggregated particles having an average particle diameter of about 5.1 μm was confirmed by observation with an optical microscope. 51.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.6 μm was confirmed.

-Coalescence Step-

The pH of the aggregated particle dispersion was 2.9. Hence, the pH was adjusted to 7.5 by gently adding a 0.5% by mass aqueous solution of sodium hydroxide (Wako Pure Chemical Industries, Ltd.), and the mixture was heated to 85° C. and kept at this temperature for 3 hours under stirring. Thereafter, the pH in the container was adjusted to about 7, and the reaction product was filtered, then washed 4 times with 500 parts of deionized water and dried in a vacuum drying oven to give toner particles (8).

The volume average particle diameter of the resulting toner particles (8) was 5.7 μm, the Mw was 27,000, and the shape factor SF1 was 149. The storage of elastic modulus at 160° C. (G'(160)) was 360 Pa.

The same external additives were added to 100 parts of the resulting toner particles (8) in the same manner as in the case of the toner for electrostatic latent image development (1), to give a toner for electrostatic latent image development (8).

(Preparation of Toner for Electrostatic Latent Image Development (9))

-Aggregation Step-

| | |
|---|---|
| Resin particle dispersion (1) | 238.0 parts |
| Colorant dispersion (1) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 49° C. under stirring on a heating oil bath. After the mixture was kept at 49° C. for 30 minutes, formation of aggregated particles having an average particle diameter of about 5.1 μm was confirmed by observation with an optical microscope. 51.0 parts of the resin particle dispersion (1) were added gently to this aggregated particle dispersion and stirred under heating at 49° C. for 60 minutes while the pH was kept at 2.8, and when observed under an optical microscope, formation of aggregated particles having an average particle diameter of about 5.6 μm was confirmed.

-Coalescence Step-

The pH of the aggregated particle dispersion was 2.9. Hence, the pH was adjusted to 5.4 by gently adding a 0.5% by mass aqueous solution of sodium hydroxide (Wako Pure Chemical Industries, Ltd.), and the mixture was heated to 96° C. and kept at this temperature for 12 hours under stirring. Thereafter, the pH in the container was adjusted to about 7, and the reaction product was filtered, then washed 4 times with 500 parts of deionized water and dried in a vacuum drying oven to give toner particles (9).

The volume average particle diameter of the resulting toner particles (9) was 5.7 μm, the Mw was 27,000, and the shape factor SF1 was 108. The storage of elastic modulus at 160° C. (G'(160)) was 320 Pa.

The same external additives were added to 100 parts of the resulting toner particles (9) in the same manner as in the case of the toner for electrostatic latent image development (1), to give a toner for electrostatic latent image development (9).

(Preparation of Toner for Electrostatic Latent Image Development (10))

-Aggregation Step-

| | |
|---|---|
| Resin particle dispersion (4) | 238.0 parts |
| Colorant dispersion (1) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 49° C. under stirring on a heating oil bath. After the mixture was kept at 49° C. for 30 minutes, formation of aggregated particles having an average particle diameter of about 5.1 μm was confirmed by observation with an optical microscope. 51.0 parts of the resin particle dispersion (4) were added gently to this aggregated particle dispersion and stirred under heating at 49° C. for 60 minutes while the pH was kept at 2.8, and when observed under an optical microscope, formation of aggregated particles having an average particle diameter of about 5.6 μm was confirmed.

-Coalescence Step-

The pH of the aggregated particle dispersion was 2.9. Hence, the pH was adjusted to 6.2 by gently adding an aqueous solution of sodium hydroxide (Wako Pure Chemical Industries, Ltd.) diluted at 0.5% by mass, and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (10).

The volume average particle diameter of the resulting toner particles (10) was 5.8 μm, the Mw was 44,000, and the shape factor SF1 was 134. The storage of elastic modulus at 160° C. (G'(160)) was 790 Pa.

The same external additives were added to 100 parts of the resulting toner particles (10) in the same manner as in the case of the toner for electrostatic latent image development (1), to give a toner for electrostatic latent image development (10).

(Preparation of Toner for Electrostatic Latent Image Development (11))

-Aggregation Step-

| | |
|---|---|
| Resin particle dispersion (5) | 238.0 parts |
| Colorant dispersion (1) | 17.5 parts |
| Releasing agent particle dispersion (1) | 17.5 parts |
| Deionized water | 630.0 parts |
| Aluminum sulfate (Wako Pure Chemical Industries, Ltd.) | 1.3 parts |

The above components were mixed and dispersed with a homogenizer (ULTRA-TURRAX T50 manufactured by IKA Co., Ltd.) in a round stainless steel flask, then the pH in the container was adjusted to pH 2.8, the mixture was heated to 48° C. under stirring on a heating oil bath. After the mixture was kept at 48° C. for 30 minutes, formation of aggregated particles having an average particle diameter of about 5.3 μm was confirmed by observation with an optical microscope. 51.0 parts of the resin particle dispersion (5) were added gently to this aggregated particle dispersion and stirred under heating at 48° C. for 60 minutes while the pH was kept at 2.8, and when observed under an optical microscope, formation of aggregated particles having an average particle diameter of about 5.9 μm was confirmed.

-Coalescence Step-

The pH of the aggregated particle dispersion was 2.9. Hence, the pH was adjusted to 7.6 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (11).

The volume average particle diameter of the resulting toner particles (11) was 6.2 μm, the Mw was 33,000, and the shape factor SF1 was 127. The storage of elastic modulus at 160° C. (G'(160)) was 65 Pa.

The same external additives were added to 100 parts of the resulting toner particles (11) in the same manner as in the case of the toner for electrostatic latent image development (1), to give a toner for electrostatic latent image development (11).

(Preparation of Toner for Electrostatic Latent Image Development (12))

30 parts of a phthalocyanine pigment (PV FAST BLUE manufactured by Dainichiseika Color & Chemicals Mgf. Co., Ltd.) and 30 parts of polyethylene wax (Polywax 725 manufactured by Toyo-Petrolite) were added to 40 parts of styrene-acrylic resin (Mw 32,000 manufactured by Soken Chemical & Engineering Co., Ltd.), and the mixture was melted and kneaded with a pressurizing kneader to give a resin mixture 1.

| | |
|---|---|
| Styrene | 189.5 parts |
| n-Butyl acrylate | 28.0 parts |
| 2-Ethylhexyl acrylate | 12.6 parts |
| tert-Lauryl mercaptan | 5.3 parts |
| 2,2'-Azobis-2-methyl valeronitrile (all of which are manufactured by Wako Pure Chemical Industries, Ltd.) | 1.8 parts |
| Resin mixture 1 | 50.0 parts |

The above components were stirred, melted, added to an aqueous medium composed of 30 parts of calcium carbonate dispersed in 600 parts of deionized water, and dispersed with a homogenizer (ULTRA-TURRAX T50 manufactured by IKA Co., Ltd.), and it was confirmed that oil droplets having an average particle diameter of 7.3 μm were present in the dispersion. This dispersion system was heated to 80° C. under passage of nitrogen and left for 5 hours to give particles by suspension polymerization. After cooling, 1 N hydrochloric acid (manufactured by Wako Pure Chemical Industries, Ltd.) was added dropwise thereto to adjust the pH to 2.2, and the dispersion was left for 1 hour. Thereafter, the pH in the container was adjusted to about 7, the reaction product was filtered, then washed 4 times with 500 parts of deionized water and dried in a vacuum drying oven to give toner particles (12).

The volume average particle diameter of the resulting toner particles (12) was 7.6 μm, the Mw was 51,000, and the shape factor SF1 was 134. The storage of elastic modulus at 160° C. (G'(160)) was 480 Pa.

The same external additives were added to 100 parts of the resulting toner particles (12) in the same manner as in the case of the toner for electrostatic latent image development (1), to give a toner for electrostatic latent image development (12).

(Preparation of Toner for Electrostatic Latent Image Development (13))

-Aggregation Step-

| | |
|---|---|
| Resin particle dispersion (6) | 237.0 parts |
| Colorant dispersion (1) | 17.5 parts |
| Releasing agent particle dispersion (3) | 17.5 parts |
| Deionized water | 632.5 parts |
| Aluminum sulfate (Wako Pure Chemical Industries, Ltd.) | 1.0 parts |

The above components were mixed and dispersed with a homogenizer (ULTRA-TURRAX T50 manufactured by IKA Co., Ltd.) in a round stainless steel flask, then the pH in the container was adjusted to pH 2.6, the mixture was heated to 48° C. under stirring on a heating oil bath. After the mixture was kept at 48° C. for 30 minutes, formation of aggregated particles having an average particle diameter of about 4.9 μm was confirmed by observation with an optical microscope. 60.0 parts of the resin particle dispersion (6) were added gently to this aggregated particle dispersion and stirred under heating at 50° C. for 60 minutes while the pH was kept at 2.6, and when observed under an optical microscope, formation of aggregated particles having an average particle diameter of about 5.4 μm was confirmed.

-Coalescence Step-

The pH of the aggregated particle dispersion was 2.6. Hence, the pH was adjusted to 5.8 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (13).

The volume average particle diameter of the resulting toner particles (13) was 5.6 μm, the Mw was 29,000, and the shape factor SF1 was 126. The storage of elastic modulus at 160° C. (G'(160)) was 410 Pa. 2 parts of hydrophobic titanium oxide (T805, average particle diameter 0.021 μm, manufactured by Nippon Aerosil Co., Ltd.) and 6 parts of hydrophobic silica (RX50, average particle diameter 0.040 μm, manufactured by Nippon Aerosil Co., Ltd.) were added to 600 parts of the toner particles (13) and mixed by a Henschel mixer to give a toner for electrostatic latent image development (13). The total amount of these external additives was 1.3% by mass, and the ratio of 0.03 μm or smaller particles to the total amount of the external additives was 0.25.

(Preparation of Toner for Electrostatic Latent Image Development (14))

-Aggregation Step-

| | |
|---|---|
| Resin particle dispersion (6) | 233.0 parts |
| Colorant dispersion (2) | 21.0 parts |
| Releasing agent particle dispersion (3) | 17.5 parts |
| Deionized water | 632.5 parts |
| Aluminum sulfate (Wako Pure Chemical Industries, Ltd.) | 1.1 parts |

The above components were mixed and dispersed with a homogenizer (ULTRA-TURRAX T50 manufactured by IKA Co., Ltd.) in a round stainless steel flask, then the pH in the container was adjusted to pH 2.6, the mixture was heated to 49° C. under stirring on a heating oil bath. After the mixture was kept at 50° C. for 30 minutes, formation of aggregated particles having an average particle diameter of about 5.0 μm was confirmed by observation with an optical microscope. 59.5 parts of the resin particle dispersion (6) were added gently to this aggregated particle dispersion and stirred under heating at 50° C. for 60 minutes while the pH was kept at 2.6, and when observed under an optical microscope, formation of aggregated particles having an average particle diameter of about 5.5 μm was confirmed.

-Coalescence Step-

The pH of the aggregated particle dispersion was 2.7. Hence, the pH was adjusted to 5.4 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (14).

The volume average particle diameter of the resulting toner particles (14) was 5.7 μm, the Mw was 29,000, and the shape factor SF1 was 128. The storage of elastic modulus at 160° C. (G'(160)) was 430 Pa.

The same external additives were added to 600 parts of the resulting toner particles (14) in the same manner as in the case of the toner for electrostatic latent image development (13), to give a toner for electrostatic latent image development (14).

(Preparation of Toner for Electrostatic Latent Image Development (15))

-Aggregation Step-

| | |
|---|---|
| Resin particle dispersion (6) | 232.0 parts |
| Colorant dispersion (3) | 25.3 parts |
| Releasing agent particle dispersion (3) | 17.5 parts |
| Deionized water | 630.0 parts |
| Aluminum sulfate (Wako Pure Chemical Industries, Ltd.) | 1.0 part |

The above components were mixed and dispersed with a homogenizer (ULTRA-TURRAX T50 manufactured by IKA Co., Ltd.) in a round stainless steel flask, then the pH in the container was adjusted to pH 2.7, the mixture was heated to 49° C. under stirring on a heating oil bath. After the mixture was kept at 49° C. for 30 minutes, formation of aggregated particles having an average particle diameter of about 5.0 μm was confirmed by observation with an optical microscope. 61.0 parts of the resin particle dispersion (6)

were added gently to this aggregated particle dispersion and stirred under heating at 49° C. for 60 minutes while the pH was kept at 2.7, and when observed under an optical microscope, formation of aggregated particles having an average particle diameter of about 5.8 μm was confirmed.

-Coalescence Step-

The pH of the aggregated particle dispersion was 2.7. Hence, the pH was adjusted to 5.8 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (15).

The volume average particle diameter of the resulting toner particles (15) was 5.9 μm, the Mw was 29,000, and the shape factor SF1 was 130. The storage of elastic modulus at 160° C. (G'(160)) was 390 Pa.

The same external additives were added to 600 parts of the resulting toner particles (15) in the same manner as in the case of the toner for electrostatic latent image development (13), to give a toner for electrostatic latent image development (15).

(Preparation of toner for electrostatic latent image development (16))

-Aggregation Step-

| | |
|---|---|
| Resin particle dispersion (6) | 239.0 parts |
| Colorant dispersion (4) | 17.5 parts |
| Releasing agent particle dispersion (3) | 17.5 parts |
| Deionized water | 630.0 parts |
| Aluminum sulfate (Wako Pure Chemical Industries, Ltd.) | 1.2 parts |

The above components were mixed and dispersed with a homogenizer (ULTRA-TURRAX T50 manufactured by IKA Co., Ltd.) in a round stainless steel flask, then the pH in the container was adjusted to pH 2.7, the mixture was heated to 49° C. under stirring on a heating oil bath. After the mixture was kept at 49° C. for 30 minutes, formation of aggregated particles having an average particle diameter of about 4.8 μm was confirmed by observation with an optical microscope. 58.0 parts of the resin particle dispersion (6) were added gently to this aggregated particle dispersion and stirred under heating at 49° C. for 60 minutes while the pH was kept at 2.7, and when observed under an optical microscope, formation of aggregated particles having an average particle diameter of about 5.5 μm was confirmed.

-Coalescence Step-

The pH of the aggregated particle dispersion was 2.8. Hence, the pH was adjusted to 5.9 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (16).

The volume average particle diameter of the resulting toner particles (16) was 5.6 μm, the Mw was 29,000, and the shape factor SF1 was 131. The storage of elastic modulus at 160° C. (G'(160)) was 380 Pa.

The same external additives were added to 600 parts of the resulting toner particles (16) in the same manner as in the case of the toner for electrostatic latent image development (13) to give a toner for electrostatic latent image development (16).

(Preparation of Toner for Electrostatic Latent Image Development (17))

-Aggregation Step-

The same composition as that of the toner for electrostatic latent image development (13) was used except that 1.7 parts of aluminum sulfate were used in the aggregation step in preparation of the toner for electrostatic latent image development (13).

The above composition was mixed and dispersed with a homogenizer (ULTRA-TURRAX T50 manufactured by IKA Co., Ltd.) in a round stainless steel flask, then the pH in the container was adjusted to pH 2.6, the mixture was heated to 45° C. under stirring on a heating oil bath. After the mixture was kept at 45° C. for 30 minutes, formation of aggregated particles having an average particle diameter of about 4.9 μm was confirmed by observation with an optical microscope. 60.0 parts of the resin particle dispersion (6) were added gently to this aggregated particle dispersion and stirred under heating at 45° C. for 60 minutes while the pH was kept at 2.6, and when observed under an optical microscope, formation of aggregated particles having an average particle diameter of about 5.3 μm was confirmed.

-Coalescence Step-

The pH of the aggregated particle dispersion was 2.6. Hence, the pH was adjusted to 6.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (17).

The volume average particle diameter of the resulting toner particles (17) was 5.5 μm, the Mw was 29,000, and the shape factor SF1 was 137. The storage of elastic modulus at 160° C. (G'(160)) was 650 Pa.

4 parts of hydrophobic titanium oxide (T805, average particle diameter 0.021 μm, manufactured by Nippon Aerosil Co., Ltd.) and 7 parts of hydrophobic silica (RX50, average particle diameter 0.040 μm, manufactured by Nippon Aerosil Co., Ltd.) were added to 600 parts of the toner particles (17) and mixed by a Henschel mixer to give a toner for electrostatic latent image development (17). The total amount of these external additives was 1.8% by mass, and the ratio of 0.03 μm or smaller particles to the total amount of the external additives was 0.36.

(Preparation of Toner for Electrostatic Latent Image Development (18))

-Aggregation Step-

The same composition as that of the toner for electrostatic latent image development (13) was used except that 0.5 part of aluminum sulfate and 5 parts of sodium chloride were used in place of 1.0 part of aluminum sulfate in the aggregation step in preparation of the toner for electrostatic latent image development (13).

The above composition was mixed and dispersed with a homogenizer (ULTRA-TURRAX T50 manufactured by IKA Co., Ltd.) in a round stainless steel flask, then the pH in the container was adjusted to pH 2.6, the mixture was heated to 49° C. under stirring on a heating oil bath. After the dispersion was kept at 49° C. for 30 minutes, formation of aggregated particles having an average particle diameter of about 4.8 μm was confirmed by observation with an optical microscope. 60.0 parts of the resin particle dispersion (6) were added gently to this aggregated particle dispersion and stirred under heating at 49° C. for 60 minutes while the pH was kept at 2.6, and when observed under an optical microscope, formation of aggregated particles having an average particle diameter of about 5.3 μm was confirmed.

-Coalescence Step-

The pH of the aggregated particle dispersion was 2.6. Hence, the pH was adjusted to 4.7 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (18).

The volume average particle diameter of the resulting toner particles (18) was 5.6 μm, the Mw was 29,000, and the shape factor SF1 was 115. The storage of elastic modulus at 160° C. (G'(160)) was 150 Pa.

5 parts of hydrophobic titanium oxide (T805, average particle diameter 0.021 μm, manufactured by Nippon Aerosil Co., Ltd.) and 2 parts of hydrophobic silica (RX50, average particle diameter 0.040 μm, manufactured by Nippon Aerosil Co., Ltd.) were added to 600 parts of the toner particles (18) and mixed by a Henschel mixer to give a toner for electrostatic latent image development (18). The total amount of these external additives was 1.2% by mass, and the ratio of 0.03 μm or smaller particles to the total amount of the external additives was 0.71.

(Preparation of Toner for Electrostatic Latent Image Development (19))

-Aggregation Step-

The same composition as that of the toner for electrostatic latent image development (13) was used except that the resin particle dispersion (7) was used in place of the resin particle dispersion (6) in the aggregation step in preparation of the toner for electrostatic latent image development (13).

The above composition was mixed and dispersed with a homogenizer (ULTRA-TURRAX T50 manufactured by IKA Co., Ltd.) in a round stainless steel flask, then the pH in the container was adjusted to pH 2.6, the mixture was heated to 48° C. under stirring on a heating oil bath. After the dispersion was kept at 48° C. for 30 minutes, formation of aggregated particles having an average particle diameter of about 4.8 μm was confirmed by observation with an optical microscope. 60.0 parts of the resin particle dispersion (7) were added gently to this aggregated particle dispersion and stirred under heating at 50° C. for 60 minutes while the pH was kept at 2.6, and when observed under an optical microscope, formation of aggregated particles having an average particle diameter of about 5.2 μm was confirmed.

-Coalescence Step-

The pH of the aggregated particle dispersion was 2.6. Hence, the pH was adjusted to 4.8 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (19).

The volume average particle diameter of the resulting toner particles (19) was 5.4 μm, the Mw was 36,000, and the shape factor SF1 was 133. The storage of elastic modulus at 160° C. (G'(160)) was 590 Pa.

The same external additives were added to 600 parts of the resulting toner particles (19) in the same manner as in the case of the toner for electrostatic latent image development (1), to give a toner for electrostatic latent image development (19).

(Preparation of Toner for Electrostatic Latent Image Development (20))

-Aggregation Step-

The same composition as that of the toner for electrostatic latent image development (13) was used except that the resin particle dispersion (8) and the releasing agent dispersion (2) were used in place of the resin particle dispersion (6) and the releasing agent dispersion (3) in the aggregation step in preparation of the toner for electrostatic latent image development (13).

The above composition was mixed and dispersed with a homogenizer (ULTRA-TURRAX T50 manufactured by IKA Co., Ltd.) in a round stainless steel flask, then the pH in the container was adjusted to pH 2.6, the mixture was heated to 48° C. under stirring on a heating oil bath. After the dispersion was kept at 48° C. for 30 minutes, formation of aggregated particles having an average particle diameter of about 5.1 μm was confirmed by observation with an optical microscope. 60.0 parts of the resin particle dispersion (8) were added gently to this aggregated particle dispersion and stirred under heating at 50° C. for 60 minutes while the pH was kept at 2.6, and when observed under an optical microscope, formation of aggregated particles having an average particle diameter of about 6.0 μm was confirmed.

-Coalescence Step-

The pH of the aggregated particle dispersion was 2.6. Hence, the pH was adjusted to 4.7 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (20).

The volume average particle diameter of the resulting toner particles (20) was 6.2 μm, the Mw was 22,000, and the shape factor SF1 was 118. The storage of elastic modulus at 160° C. (G'(160)) was 100 Pa.

The same external additives were added to 600 parts of the resulting toner particles (20) in the same manner as in the case of the toner for electrostatic latent image development (13), to give a toner for electrostatic latent image development (20).

(Preparation of Toner for Electrostatic Latent Image Development (21))

A toner for electrostatic latent image development (21) was obtained in the same manner as in production of the toner for electrostatic latent image development (13) except that 6 parts of hydrophobic titanium oxide (T805, average particle diameter 0.021 μm, manufactured by Nippon Aerosil Co., Ltd.) and 0.5 part of hydrophobic silica (RX50, average particle diameter 0.040 μm, manufactured by Nippon Aerosil Co., Ltd.) were added as the external additives to 600 parts of the toner particles (13). The total amount of these external additives was 1.1% by mass, and the ratio of 0.03 μm or smaller particles to the total amount of the external additives was 0.92.

(Preparation of Toner for Electrostatic Latent Image Development (22))

A toner for electrostatic latent image development (22) was obtained in the same manner as in production of the toner for electrostatic latent image development (13) except that 0.08 part of hydrophobic titanium oxide (T805, average particle diameter 0.021 μm, manufactured by Nippon Aerosil Co., Ltd.) and 11 parts of hydrophobic silica (RX50, average particle diameter 0.040 μm, manufactured by Nippon Aerosil Co., Ltd.) were added as the external additives to 600 parts of the toner particles (13). The total amount of these external additives was 1.8% by mass, and the ratio of 0.03 μm or smaller particles to the total amount of the external additives was 0.007.

(Preparation of Toner for Electrostatic Latent Image Development (23))

-Aggregation Step-

| | |
|---|---|
| Resin particle dispersion (6) | 250.0 parts |
| Colorant dispersion (1) | 17.5 parts |
| Deionized water | 632.5 parts |
| Aluminum sulfate (Wako Pure Chemical Industries, Ltd.) | 1.0 part |

The above components were mixed and dispersed with a homogenizer (ULTRA-TURRAX T50 manufactured by IKA Co., Ltd.) in a round stainless steel flask, then the pH in the container was adjusted to pH 2.6, the mixture was heated to 50° C. under stirring on a heating oil bath. After the mixture was kept at 50° C. for 30 minutes, formation of aggregated particles having an average particle diameter of about 4.9 μm was confirmed by observation with an optical microscope. 60.0 parts of the resin particle dispersion (6) were added gently to this aggregated particle dispersion and stirred under heating at 50° C. for 60 minutes while the pH was kept at 2.6, and when observed under an optical microscope, formation of aggregated particles having an average particle diameter of about 5.4 μm was confirmed.

-Coalescence Step-

The pH of the aggregated particle dispersion was 2.6. Hence, the pH was adjusted to 6.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (23).

The volume average particle diameter of the resulting toner particles (23) was 5.5 μm, the Mw was 29,000, and the shape factor SF1 was 121. The storage of elastic modulus at 160° C. (G'(160)) was 260 Pa.

3.3 parts of hydrophobic titanium oxide (T805, average particle diameter 0.021 μm, manufactured by Nippon Aerosil Co., Ltd.) and 5.2 parts of hydrophobic silica (RX50, average particle diameter 0.040 μm, manufactured by Nippon Aerosil Co., Ltd.) were added as the external additives to 600 parts of the toner particles (23) and mixed by a Henschel mixer to give a toner for electrostatic latent image development (23). The total amount of these external additives was 1.4% by mass, and the ratio of 0.03 μm or smaller particles to the total amount of the external additives was 0.39.

(Preparation of Toner for Electrostatic Latent Image Development (24))

-Aggregation Step-

The same composition as that of the toner for electrostatic latent image development (13) was used except that the amount of aluminum sulfate was 1.5 parts in the aggregation step in preparation of the toner for electrostatic latent image development (13).

The above composition was mixed and dispersed with a homogenizer (ULTRA-TURRAX T50 manufactured by IKA Co., Ltd.) in a round stainless steel flask, then the pH in the container was adjusted to pH 2.6, the mixture was heated to 58° C. under stirring on a heating oil bath. After the dispersion was kept at 58° C. for 50 minutes, formation of aggregated particles having an average particle diameter of about 8.6 μm was confirmed by observation with an optical microscope. 60.0 parts of the resin particle dispersion (6) were added gently to this aggregated particle dispersion and stirred under heating at 58° C. for 60 minutes while the pH was kept at 2.6, and when observed under an optical microscope, formation of aggregated particles having an average particle diameter of about 9.5 μm was confirmed.

-Coalescence Step-

The pH of the aggregated particle dispersion was 2.6. Hence, the pH was adjusted to 5.5 by gently adding a 0.5% by mass aqueous solution of sodium hydroxide (Wako Pure Chemical Industries, Ltd.), and the mixture was heated to 96° C. and kept at this temperature for 6 hours under stirring. Thereafter, the pH in the container was adjusted to about 7, and the reaction product was filtered, then washed 4 times with 500 parts of deionized water and dried in a vacuum drying oven to give toner particles (24).

The volume average particle diameter of the resulting toner particles (24) was 10.2 μm, the Mw was 29,000, and the shape factor SF1 was 129. The storage of elastic modulus at 160° C. (G'(160)) was 450 Pa.

1.6 parts of hydrophobic titanium oxide (T805, average particle diameter 0.021 μm, manufactured by Nippon Aerosil Co., Ltd.) and 3.2 parts of hydrophobic silica (RX50, average particle diameter 0.040 μm, manufactured by Nippon Aerosil Co., Ltd.) were added as the external additives to 600 parts of the toner particles (24) and mixed by a Henschel mixer to give a toner for electrostatic latent image development (24). The total amount of these external additives was 0.77% by mass, and the ratio of 0.03 μm or less particles to the total amount of the external additives was 0.33.

(Preparation of Toner for Electrostatic Latent Image Development (25))

-Aggregation Step-

The same composition as that of the toner for electrostatic latent image development (13) was used except that the amount of aluminum sulfate was 0.4 part in the aggregation step in preparation of the toner for electrostatic latent image development (13).

The above composition was mixed and dispersed with a homogenizer (ULTRA-TURRAX T50 manufactured by IKA Co., Ltd.) in a round stainless steel flask, then the pH in the container was adjusted to pH 2.9, the mixture was heated to 28° C. under stirring on a heating oil bath. After the dispersion was kept at 28° C. for 120 minutes, formation of aggregated particles having an average particle diameter of about 2.2 μm was confirmed by observation with an optical microscope. Further, the dispersion was stirred under heating at 28° C. for 120 minutes while the pH was kept at 2.9, and when observed under an optical microscope, formation of aggregated particles having an average particle diameter of about 2.4 μm was confirmed.

-Coalescence Step-

The pH of the aggregated particle dispersion was 2.9. Hence, the pH was adjusted to 7.0 by gently adding an aqueous solution of sodium hydroxide (Wako Pure Chemical Industries, Ltd.) diluted at 0.5% by mass, and the mixture was heated to 96° C. and kept at this temperature for 6 hours under stirring. Thereafter, the pH in the container was adjusted to about 7, and the reaction product was filtered, then washed 4 times with 500 parts of deionized water and dried in a vacuum drying oven to give toner particles (25).

The volume average particle diameter of the resulting toner particles (25) was 2.6 μm, the Mw was 29,000, and the shape factor SF1 was 115. The storage of elastic modulus at 160° C. (G'(160)) was 200 Pa. 6.2 parts of hydrophobic titanium oxide (T805, average particle diameter 0.021 μm, manufactured by Nippon Aerosil Co., Ltd.) and 18.3 parts of hydrophobic silica (RX50, average particle diameter 0.040 μm, manufactured by Nippon Aerosil Co., Ltd.) were added as the external additives to 300 parts of the toner particles (25) and mixed by a Henschel mixer to give a toner for electrostatic latent image development (25). The total amount of these external additives was 8.2% by mass, and the ratio of 0.03 μm or smaller particles to the total amount of the external additives was 0.25.

(Preparation of Toner for Electrostatic Latent Image Development (26))

-Aggregation Step-

| | |
|---|---|
| Resin particle dispersion (9) | 237.0 parts |
| Colorant dispersion (1) | 17.5 parts |
| Releasing agent dispersion (3) | 17.5 parts |
| Deionized water | 632.5 parts |
| Aluminum sulfate (Wako Pure Chemical Industries, Ltd.) | 1.0 part |

The above components were mixed and dispersed with a homogenizer (ULTRA-TURRAX T50 manufactured by IKA Co., Ltd.) in a round stainless steel flask, then the pH in the container was adjusted to pH 2.6, the mixture was heated to 48° C. under stirring on a heating oil bath. After the mixture was kept at 48° C. for 60 minutes, formation of aggregated particles having an average particle diameter of about 4.9 μm was confirmed by observation with an optical microscope. Further, the dispersion was stirred under heating at 49° C. for 30 minutes while the pH was kept at 2.6, and when observed under an optical microscope, formation of aggregated particles having an average particle diameter of about 5.3 μm was confirmed.

-Coalescence Step-

The pH of the aggregated particle dispersion was 2.6. Hence, the pH was adjusted to 5.5 by gently adding a 0.5% by mass aqueous solution of sodium hydroxide (Wako Pure Chemical Industries, Ltd.), and the mixture was heated to 96° C. and kept at this temperature for 6 hours under stirring. Thereafter, the pH in the container was adjusted to about 7, and the reaction product was filtered, then washed 4 times with 500 parts of deionized water and dried in a vacuum drying oven to give toner particles (26).

The volume average particle diameter of the resulting toner particles (26) was 5.6 μm, the Mw was 30,000, and the shape factor SF1 was 122. The storage of elastic modulus at 160° C. (G'(160)) was 500 Pa.

2.2 parts of hydrophobic titanium oxide (T805, average particle diameter 0.021 μm, manufactured by Nippon Aerosil Co., Ltd.) and 6.3 parts of hydrophobic silica (RX50, average particle diameter 0.040 μm, manufactured by Nippon Aerosil Co., Ltd.) were added as the external additives to 600 parts of the toner particles (26) and mixed by a Henschel mixer to give a toner for electrostatic latent image development (26). The total amount of these external additives was 1.4% by mass, and the ratio of 0.03 μm or smaller particles to the total amount of the external additives was 0.26.

(Preparation of Toner for Electrostatic Latent Image Development (27))

30 parts of a phthalocyanine pigment (PV FAST BLUE manufactured by Dainichiseika Color & Chemicals Mgf. Co., Ltd.) and 20 parts of carnauba wax were added to 40 parts of styrene-acrylic resin (Mw 32,000, manufactured by Soken Chemical & Engineering Co., Ltd.), and the mixture was melted and kneaded with a pressurizing kneader to give a resin mixture 2.

| | |
|---|---|
| Styrene | 189.5 parts |
| n-Butyl acrylate | 28.0 parts |
| 2-Ethylhexyl acrylate | 12.6 parts |
| tert-Lauryl mercaptan | 4.3 parts |
| 2,2'-Azobis-2-methyl valeronitrile (all of which are manufactured by Wako Pure Chemical Industries, Ltd.) | 2.0 parts |
| Resin mixture 2 | 50.0 parts |

The above components were stirred, melted, added to an aqueous medium composed of 25 parts of calcium carbonate dispersed in 600 parts of deionized water, and dispersed with a homogenizer (ULTRA-TURRAX T50 manufactured by IKA Co., Ltd.), and it was confirmed that oil droplets having an average particle diameter of 8.5 μm were present in the dispersion. This dispersion system was heated to 80° C. under passage of nitrogen and left for 5 hours to give particles by suspension polymerization. After cooling, 1 N hydrochloric acid (manufactured by Wako Pure Chemical Industries, Ltd.) was added dropwise thereto to adjust the pH to 2.2, and the dispersion was left for 1 hour. Thereafter, the pH in the container was adjusted to about 7, the reaction product was filtered, then washed 4 times with 500 parts of deionized water and dried in a vacuum drying oven to give toner particles (27).

The volume average particle diameter of the resulting toner particles (27) was 8.7 μm, the Mw was 38,000, and the shape factor SF1 was 137. The storage of elastic modulus at 160° C. (G'(160)) was 510 Pa. 2.1 parts of hydrophobic titanium oxide (T805, average particle diameter 0.021 μm, manufactured by Nippon Aerosil Co., Ltd.) and 9.1 parts of hydrophobic silica (RX50, average particle diameter 0.040 μm, manufactured by Nippon Aerosil Co., Ltd.) were added as the external additives to 600 parts of the toner particles (27) and mixed by a Henschel mixer to give a toner for electrostatic latent image development (27). The total amount of these external additives was 1.9% by mass, and the ratio of 0.03 μm or smaller particles to the total amount of the external additives was 0.19.

(Preparation of Toner for Electrostatic Latent Image Development (28))

-Aggregation Step-

The same composition as that of the toner for electrostatic latent image development (13) was used except that the amount of aluminum sulfate was 3.0 parts in the aggregation step in preparation of the toner for electrostatic latent image development (13).

The above composition was dispersed with a homogenizer (ULTRA-TURRAX T50 manufactured by IKA Co., Ltd.) in a round stainless steel flask, then the pH in the container was adjusted to pH 2.6, the mixture was heated to 45° C. under stirring on a heating oil bath. After the mixture was kept at 45° C. for 30 minutes, formation of aggregated particles having an average particle diameter of about 4.4 μm was confirmed by observation with an optical microscope. 60.0 parts of the resin particle dispersion (6) were added gently to this aggregated particle dispersion and stirred under heating at 45° C. for 60 minutes while the pH was kept at 2.6, and when observed under an optical microscope, formation of aggregated particles having an average particle diameter of about 4.8 μm was confirmed.

-Coalescence Step-

The pH of the aggregated particle dispersion was 2.6. Hence, the pH was adjusted to 7.0 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (28).

The volume average particle diameter of the resulting toner particles (28) was 4.9 μm, the Mw was 29,000, and the shape factor SF1 was 151. The storage of elastic modulus at 160° C. (G'(160)) was 550 Pa.

4.2 parts of hydrophobic titanium oxide (T805, average particle diameter 0.021 μm, manufactured by Nippon Aerosil Co., Ltd.) and 7.5 parts of hydrophobic silica (RX50, average particle diameter 0.040 μm, manufactured by Nippon Aerosil Co., Ltd.) were added as the external additives to 600 parts of the toner particles (28) and mixed by a Henschel mixer to give a toner for electrostatic latent image development (28). The total amount of these external additives was 2.0% by mass, and the ratio of 0.03 μm or smaller particles to the total amount of the external additives was 0.35.

(Preparation of Toner for Electrostatic Latent Image Development (29))

-Aggregation Step-

The same composition as that of the toner for electrostatic latent image development (13) was used except that 0.3 part of aluminum sulfate and 8 parts of sodium chloride were used in place of 1.0 part of aluminum sulfate in the aggregation step in preparation of the toner for electrostatic latent image development (13).

The above composition was dispersed with a homogenizer (ULTRA-TURRAX T50 manufactured by IKA Co., Ltd.) in a round stainless steel flask, then the pH in the container was adjusted to pH 2.6, the mixture was heated to 49° C. under stirring on a heating oil bath. After the mixture was kept at 49° C. for 30 minutes, formation of aggregated particles having an average particle diameter of about 4.7 μm was confirmed by observation with an optical microscope. 60.0 parts of the resin particle dispersion (6) were added gently to this aggregated particle dispersion and stirred under heating at 49° C. for 60 minutes while the pH was kept at 2.6, and when observed under an optical microscope, formation of aggregated particles having an average particle diameter of about 5.2 μm was confirmed.

-Coalescence Step-

The pH of the aggregated particle dispersion was 2.6. Hence, the pH was adjusted to 4.5 by gently adding a 0.5% by mass aqueous solution of sodium hydroxide (Wako Pure Chemical Industries, Ltd.), and the mixture was heated to 96° C. and kept at this temperature for 12 hours under stirring. Thereafter, the pH in the container was adjusted to about 7, and the reaction product was filtered, then washed 4 times with 500 parts of deionized water and dried in a vacuum drying oven to give toner particles (29).

The volume average particle diameter of the resulting toner particles (29) was 5.5 μm, the Mw was 29,000, and the shape factor SF1 was 108. The storage of elastic modulus at 160° C. (G'(160)) was 130 Pa. 4 parts of hydrophobic titanium oxide (T805, average particle diameter 0.021 μm, manufactured by Nippon Aerosil Co., Ltd.) and 3.3 parts of hydrophobic silica (RX50, average particle diameter 0.040 μm, manufactured by Nippon Aerosil Co., Ltd.) were added as the external additives to 600 parts of the toner particles (29) and mixed by a Henschel mixer to give a toner for electrostatic latent image development (29). The total amount of these external additives was 1.2% by mass, and the ratio of 0.03 μm or smaller particles to the total amount of the external additives was 0.55.

(Preparation of Toner for Electrostatic Latent Image Development (30))

-Aggregation Step-

The same composition as that of the toner for electrostatic latent image development (13) was used except that the resin particle dispersion (10) was used in place of the resin particle dispersion (6) in the aggregation step in preparation of the toner for electrostatic latent image development (13).

The above composition was dispersed with a homogenizer (ULTRA-TURRAX T50 manufactured by IKA Co., Ltd.) in a round stainless steel flask, then the pH in the container was adjusted to pH 2.6, the mixture was heated to 48° C. under stirring on a heating oil bath. After the mixture was kept at 48° C. for 30 minutes, formation of aggregated particles having an average particle diameter of about 5.5 μm was confirmed by observation with an optical microscope. 60.0 parts of the resin particle dispersion (10) were added gently to this aggregated particle dispersion and stirred under heating at 48° C. for 60 minutes while the pH was kept at 2.6, and when observed under an optical microscope, formation of aggregated particles having an average particle diameter of about 5.9 μm was confirmed.

-Coalescence Step-

The pH of the aggregated particle dispersion was 2.6. Hence, the pH was adjusted to 4.9 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (30).

The volume average particle diameter of the resulting toner particles (30) was 6.5 μm, the Mw was 51,000, and the shape factor SF1 was 136. The storage of elastic modulus at 160° C. (G'(160)) was 820 Pa.

The same external additives were added in the same manner as in the toner for electrostatic latent image development (13) to 600 parts of the resulting toner particles (30) to give a toner for electrostatic latent image development (30).

(Preparation of Toner for Electrostatic Latent Image Development (31))

-Aggregation Step-

The same composition as that of the toner for electrostatic latent image development (13) was used except that the resin particle dispersion (11) and the releasing agent dispersion (2) were used in place of the resin particle dispersion (6) and the releasing agent dispersion (3) in the aggregation step in preparation of the toner for electrostatic latent image development (13).

The above composition was dispersed with a homogenizer (ULTRA-TURRAX T50 manufactured by IKA Co., Ltd.) in a round stainless steel flask, then the pH in the container was adjusted to pH 2.6, the mixture was heated to 48° C. under stirring on a heating oil bath. After the mixture was kept at 48° C. for 30 minutes, formation of aggregated particles having an average particle diameter of about 5.8 μm was confirmed by observation with an optical microscope. 60.0 parts of the resin particle dispersion (11) were added gently to this aggregated particle dispersion and stirred under heating at 50° C. for 60 minutes while the pH was kept at 2.6, and when observed under an optical microscope, formation of aggregated particles having an average particle diameter of about 6.5 μm was confirmed.

-Coalescence Step-

The pH of the aggregated particle dispersion was 2.6. Hence, the pH was adjusted to 6.3 by gently adding a 0.5% by mass aqueous solution of sodium hydroxide (Wako Pure Chemical Industries, Ltd.), and the mixture was heated to 96° C. and kept at this temperature for 5 hours under stirring. Thereafter, the pH in the container was adjusted to about 7, and the reaction product was filtered, then washed 4 times with 500 parts of deionized water and dried in a vacuum drying oven to give toner particles (31).

The volume average particle diameter of the resulting toner particles (31) was 7.2 μm, the Mw was 18,000, and the shape factor SF1 was 116. The storage of elastic modulus at 160° C. (G'(160)) was 68 Pa.

The same external additives were added to 600 parts of the resulting toner particles (31) in the same manner as in the case of the toner for electrostatic latent image development (13), to give a toner for electrostatic latent image development (31).

<Preparation of Electrostatic Latent Image Developing Agent>

Together with 400 parts of toluene, 100 parts of ferrite particles (volume average particle diameter 50 μm, manufactured by POWDERTECH CORP.) and 2.4 parts of styrene-methyl methacrylate copolymer resin (BR-52, molecular weight of 85000, manufactured by Mitsubishi Rayon Co., Ltd.) were introduced into a pressurizing kneader, stirred and mixed at ordinary temperature for 15 minutes, and heated to 70° C. under stirring at reduced pressure, and the toluene was distilled away, and the system was cooled and classified with a 105 μm sieve to give ferrite carriers (resin-coated carriers).

The ferrite carriers were mixed with the toners for electrostatic latent image development (1) to (31) respectively to prepare electrostatic latent image developing agents (1) to (31) in a two-component system in which the toner concentration was 7% by mass.

Example 1

As a machine for evaluation, Vivace 400 modified machine manufactured by Fuji Xerox Co., Ltd. was loaded with the photoreceptor (1) as a photoreceptor. The electrostatic latent image developing agent (1) was used as the developing agent, and the resulting image was evaluated.

The Vivace 400 modified machine is an image forming device comprising an electrostatic latent image bearing body, charging means for charging the surface of the electrostatic latent image bearing body, electrostatic latent image-forming means of forming an electrostatic latent image on the charged surface of the electrostatic latent image bearing body, a development device, which contains the developing agent composed of the toner and carrier, for developing the electrostatic latent image with a layer of the developing agent formed on the surface of the developing agent-bearing body, to form a toner image on the surface of the electrostatic latent image bearing body, transfer means of transferring the toner image to an intermediate transfer material, and a cleaning means in cleaning blade system.

For evaluation of the image, image density was regulated such that the amount of the toner transferred onto a recording paper was 4.0 g/m$^2$, and every time 2000 copies were made, the summer environment (room temperature 30° C./humidity 85% RH) and the winter environment (room temperature 10° C./humidity 15% RH) were alternately repeated, and every time 10000 copies were made, a letter image with 5% image area was output and evaluated for reproduction of thin lines, background fogging and other image defects with the naked eye. 30000 copies were produced in total.

The evaluation results of the shape factor of the toner used in this example, the storage of elastic modulus at 160° C. (G'(160)), reproduction of thin lines, background fogging and other image defects in the initial copy, the 10000th, 20000th and 30000th copies with the naked eye are shown in Tables 1, 2 and 3.

Example 2

A copying test was conducted in the same manner as in Example 1 except that the electrostatic latent image developing agent (2) was used in place of the electrostatic latent image developing agent (1), and the same evaluation was conducted.

The results are shown in Tables 1, 2 and 3.

Example 3

A copying test was conducted in the same manner as in Example 1 except that the electrostatic latent image developing agent (3) was used in place of the electrostatic latent image developing agent (1), and the same evaluation was conducted.

The results are shown in Tables 1, 2 and 3.

Example 4

A copying test was conducted in the same manner as in Example 1 except that the electrostatic latent image developing agent (4) was used in place of the electrostatic latent image developing agent (1), and the same evaluation was conducted.

The results are shown in Tables 1, 2 and 3.

Example 5

A copying test was conducted in the same manner as in Example 1 except that the electrostatic latent image developing agent (5) was used in place of the electrostatic latent image developing agent (1), and the same evaluation was conducted.

The results are shown in Tables 1, 2 and 3.

Example 6

A copying test was conducted in the same manner as in Example 1 except that the electrostatic latent image developing agent (6) was used in place of the electrostatic latent image developing agent (1), and the same evaluation was conducted.

The results are shown in Tables 1, 2 and 3.

Example 7

A copying test was conducted in the same manner as in Example 1 except that the electrostatic latent image developing agent (7) was used in place of the electrostatic latent image developing agent (1), and the same evaluation was conducted.

The results are shown in Tables 1, 2 and 3.

Example 8

A copying test was conducted in the same manner as in Example 1 except that the photoreceptor (2) was used in place of the photoreceptor (1), and the same evaluation was conducted.

The results are shown in Tables 1, 2 and 3.

Example 9

A copying test was conducted in the same manner as in Example 2 except that the photoreceptor (2) was used in place of the photoreceptor (1), and the same evaluation was conducted.

The results are shown in Tables 1, 2 and 3.

Example 10

A copying test was conducted in the same manner as in Example 3 except that the photoreceptor (2) was used in place of the photoreceptor (1), and the same evaluation was conducted.

The results are shown in Tables 1, 2 and 3.

Example 11

A copying test was conducted in the same manner as in Example 4 except that the photoreceptor (2) was used in place of the photoreceptor (1), and the same evaluation was conducted.

The results are shown in Tables 1, 2 and 3.

Example 12

A copying test was conducted in the same manner as in Example 1 except that the photoreceptor (3) was used in place of the photoreceptor (1), and the same evaluation was conducted.

The results are shown in Tables 1, 2 and 3.

Example 13

A copying test was conducted in the same manner as in Example 2 except that the photoreceptor (3) was used in place of the photoreceptor (1), and the same evaluation was conducted.

The results are shown in Tables 1, 2 and 3.

Example 14

A copying test was conducted in the same manner as in Example 3 except that the photoreceptor (3) was used in place of the photoreceptor (1), and the same evaluation was conducted.

The results are shown in Tables 1, 2 and 3.

Example 15

A copying test was conducted in the same manner as in Example 4 except that the photoreceptor (3) was used in place of the photoreceptor (1), and the same evaluation was conducted.

The results are shown in Tables 1, 2 and 3.

Example 16

A copying test was conducted in the same manner as in Example 1 except that the electrostatic latent image developing agent (12) was used in place of the electrostatic latent image developing agent (1), and the same evaluation was conducted.

The results are shown in Tables 1, 2 and 3.

Comparative Example 1

A copying test was conducted in the same manner as in Example 1 except that the electrostatic latent image developing agent (8) was used in place of the electrostatic latent image developing agent (1), and the same evaluation was conducted.

The results are shown in Tables 1, 2 and 3.

Example 2

A copying test was conducted in the same manner as in Example 1 except that the electrostatic latent image developing agent (9) was used in place of the electrostatic latent image developing agent (1), and the same evaluation was conducted.

The results are shown in Tables 1, 2 and 3.

Example 3

A copying test was conducted in the same manner as in Example 1 except that the electrostatic latent image developing agent (10) was used in place of the electrostatic latent image developing agent (1), and the same evaluation was conducted.

The results are shown in Tables 1, 2 and 3.

Example 4

A copying test was conducted in the same manner as in Example 1 except that the electrostatic latent image developing agent (11) was used in place of the electrostatic latent image developing agent (1), and the same evaluation was conducted.

The results are shown in Tables 1, 2 and 3.

TABLE 1

| | Photo-receptor | Developing agent | Shape factor SF1 | Average particle diameter (μm) | G'(160)(Pa) |
|---|---|---|---|---|---|
| Example 1 | (1) | (1) | 122 | 5.7 | 340 |
| Example 2 | (1) | (2) | 126 | 5.8 | 320 |
| Example 3 | (1) | (3) | 126 | 5.9 | 330 |
| Example 4 | (1) | (4) | 130 | 5.9 | 380 |
| Example 5 | (1) | (5) | 114 | 6.1 | 100 |
| Example 6 | (1) | (6) | 135 | 6.1 | 610 |
| Example 7 | (1) | (7) | 135 | 6.0 | 240 |
| Example 8 | (2) | (1) | 122 | 5.7 | 340 |

TABLE 1-continued

| | Photo-receptor | Developing agent | Shape factor SF1 | Average particle diameter (μm) | G'(160)(Pa) |
|---|---|---|---|---|---|
| Example 9 | (2) | (2) | 126 | 5.8 | 320 |
| Example 10 | (2) | (3) | 126 | 5.9 | 330 |
| Example 11 | (2) | (4) | 130 | 5.9 | 380 |
| Example 12 | (3) | (1) | 122 | 5.7 | 340 |
| Example 13 | (3) | (2) | 126 | 5.8 | 320 |
| Example 14 | (3) | (3) | 126 | 5.9 | 330 |
| Example 15 | (3) | (4) | 130 | 5.9 | 380 |
| Example 16 | (1) | (12) | 134 | 7.6 | 480 |
| Comparative Example 1 | (1) | (8) | 149 | 5.7 | 270 |
| Comparative Example 2 | (1) | (9) | 108 | 5.7 | 270 |
| Comparative Example 3 | (1) | (10) | 134 | 5.8 | 790 |
| Comparative Example 4 | (1) | (11) | 127 | 6.2 | 650 |

TABLE 2

| | Thin line reproduction | | | | Background fogging | | | |
|---|---|---|---|---|---|---|---|---|
| | Initial copy | 10000th copy | 20000th copy | 30000th copy | Initial copy | 10000th copy | 20000th copy | 30000th copy |
| Example 1 | good | good | good | good | none | none | none | none |
| Example 2 | good | good | good | good | none | none | none | none |
| Example 3 | good | good | good | good | none | none | none | none |
| Example 4 | good | good | good | good | none | none | none | none |
| Example 5 | good | good | good | good | none | none | none | none |
| Example 6 | good | good | deteriorated very slightly | deteriorated slightly | none | none | very slight | slight |
| Example 7 | good | good | good | deteriorated very slightly | none | none | none | very slight |
| Example 8 | good | good | good | good | none | none | none | none |
| Example 9 | good | good | good | good | none | none | none | none |
| Example 10 | good | good | good | good | none | none | none | none |
| Example 11 | good | good | good | good | none | none | none | none |
| Example 12 | good | good | good | good | none | none | none | none |
| Example 13 | good | good | good | good | none | none | none | none |
| Example 14 | good | good | good | good | none | none | none | none |
| Example 15 | good | good | good | good | none | none | none | none |
| Example 16 | good | good | deteriorated very slightly | deteriorated slightly | none | none | none | very slight |
| Comparative Example 1 | good | deteriorated | deteriorated | deteriorated | none | fogged | fogged | fogged |
| Comparative Example 2 | good | Experiment was terminated after slight deterioration. | | | fogged | Experiment was terminated due to significant fogging. | | |
| Comparative Example 3 | good | good | deteriorated slightly | deteriorated | none | fogged | fogged | fogged |
| Comparative Example 4 | good | deteriorated slightly | deteriorated | deteriorated | none | fogged | fogged | fogged |

TABLE 3

| | Other image defects | | | |
|---|---|---|---|---|
| | Initial copy | 10000th copy | 20000th copy | 30000th copy |
| Example 1 | none | none | none | none |
| Example 2 | none | none | none | none |
| Example 3 | none | none | none | none |
| Example 4 | none | none | none | none |
| Example 5 | none | none | generation of very slight streaks | generation of slight streaks |
| Example 6 | none | very slight reduction in density | very slight reduction in density | slight reduction in density |
| Example 7 | none | none | none | none |
| Example 8 | none | none | none | none |

TABLE 3-continued

| | Other image defects | | | |
|---|---|---|---|---|
| | Initial copy | 10000th copy | 20000th copy | 30000th copy |
| Example 9 | none | none | none | none |
| Example 10 | none | none | none | none |
| Example 11 | none | none | none | none |
| Example 12 | none | none | none | none |
| Example 13 | none | none | none | none |
| Example 14 | none | none | none | none |
| Example 15 | none | none | none | none |
| Example 16 | none | none | none | generation of very slight thin lines |
| Comparative Example 1 | none | generation of numberless thin lines | generation of numberless thin lines | generation of numberless thin lines |
| Comparative Example 2 | generation of streaks | terminated | | |
| Comparative Example 3 | none | generation of numberless thin lines | generation of numberless thin lines | generation of numberless thin lines |
| Comparative Example 4 | none | reduction in density | reduction in density | reduction in density |

From the results of Tables 1, 2 and 3, the followings are evident. That is, the toner in the invention could be used to provide an image forming method excellent in reproduction of thin lines without background fogging and other image defects.

On the other hand, in Comparative Examples 1 and 3, numberless scratches were confirmed on the surface of the photoreceptor, and simultaneously background fogging was observed due to reduction in the potential of the surface of the photoreceptor. It is estimated that these scratches are caused by the external additives on the surface of the photoreceptor upon collision of the toner with the surface of the photoreceptor, resulting in a reduction in performance by oxidation of the charge transporting layer, and the effect of the invention is not achieved. Further, in Comparative Example 2, streaks, which are considered to be attributable to insufficient cleaning, occurred in the initial copy and thus evaluation was terminated. In Comparative Example 4, the breakage of the toner was observed in the development device. Thus, it is estimated that the toner became spent on the surface of the carrier, and as the charging was reduced, the substantially developed toner was reduced, thus causing background fogging and lower density.

Example 17

As a machine for evaluation, the Vivace 400 modified machine manufactured by Fuji Xerox Co., Ltd. was loaded with the photoreceptor (1), the transfer belt (1) as an intermediate transfer material and the electrostatic latent image developing agent (13) as a developing agent, and the resulting image was evaluated.

For evaluation of the image, copying was conducted under the same conditions as in Example 1, and every time 10000 copies were made, a letter image with 5% image area and a wholly solid image were output to evaluate reproduction of thin lines, uneven transfer and other image defects with the naked eye. At the same time, the evaluation was conducted with respect to scratches on the surface of the transfer belt. 30000 copies were produced in total.

The evaluation results of the Vickers hardness of the surface of the transfer belt used in this example, the shape factor SF1 of the toner, the storage of elastic modulus at 160° C. (G'(160)), the amount of external additives, the ratio of 0.03 μm or smaller particles, scratches on the surface of the transfer belt, reproduction of thin lines, uneven transfer, and image density in the initial copy, the 10000th, 20000th and 30000th copies are shown in Tables 4, 5 and 6.

Example 18

A copying test was conducted in the same manner as in Example 17 except that the electrostatic latent image developing agent (14) was used in place of the electrostatic latent image developing agent (13), and the same evaluation was conducted.

The results are shown in Tables 4, 5 and 6.

Example 19

A copying test was conducted in the same manner as in Example 17 except that the electrostatic latent image developing agent (15) was used in place of the electrostatic latent image developing agent (13), and the same evaluation was conducted.

The results are shown in Tables 4, 5 and 6.

Example 20

A copying test was conducted in the same manner as in Example 17 except that the electrostatic latent image developing agent (16) was used in place of the electrostatic latent image developing agent (13), and the same evaluation was conducted.

The results are shown in Tables 4, 5 and 6.

Example 21

A copying test was conducted in the same manner as in Example 17 except that the transfer belt (2) was used in place of the transfer belt (1), and the same evaluation was conducted.

The results are shown in Tables 4, 5 and 6.

Example 22

A copying test was conducted in the same manner as in Example 17 except that the transfer belt (3) was used in place of the transfer belt (1), and the same evaluation was conducted.

The results are shown in Tables 4, 5 and 6.

Example 23

A copying test was conducted in the same manner as in Example 17 except that the electrostatic latent image developing agent (17) was used in place of the electrostatic latent image developing agent (13), and the same evaluation was conducted.

The results are shown in Tables 4, 5 and 6.

Example 24

A copying test was conducted in the same manner as in Example 17 except that the electrostatic latent image developing agent (18) was used in place of the electrostatic latent image developing agent (13), and the same evaluation was conducted.

The results are shown in Tables 4, 5 and 6.

Example 25

A copying test was conducted in the same manner as in Example 17 except that the electrostatic latent image developing agent (19) was used in place of the electrostatic latent image developing agent (13), and the same evaluation was conducted.

The results are shown in Tables 4, 5 and 6.

Example 26

A copying test was conducted in the same manner as in Example 17 except that the electrostatic latent image developing agent (20) was used in place of the electrostatic latent image developing agent (13), and the same evaluation was conducted.

The results are shown in Tables 4, 5 and 6.

Example 27

A copying test was conducted in the same manner as in Example 17 except that the electrostatic latent image developing agent (21) was used in place of the electrostatic latent image developing agent (13), and the same evaluation was conducted.

The results are shown in Tables 4, 5 and 6.

Example 28

A copying test was conducted in the same manner as in Example 17 except that the electrostatic latent image developing agent (22) was used in place of the electrostatic latent image developing agent (13), and the same evaluation was conducted.

The results are shown in Tables 4, 5 and 6.

Example 29

A copying test was conducted in the same manner as in Example 17 except that the transfer belt (4) was used in place of the transfer belt (1), and the same evaluation was conducted.

The results are shown in Tables 4, 5 and 6.

Example 30

A copying test was conducted in the same manner as in Example 17 except that the transfer belt (5) was used in place of the transfer belt (1), and the same evaluation was conducted.

The results are shown in Tables 4, 5 and 6.

Example 31

A copying test was conducted in the same manner as in Example 17 except that the transfer belt (6) was used in place of the transfer belt (1), and the same evaluation was conducted.

The results are shown in Tables 4, 5 and 6.

Example 32

A copying test was conducted in the same manner as in Example 17 except that the transfer belt (7) was used in place of the transfer belt (1), and the same evaluation was conducted.

The results are shown in Tables 4, 5 and 6.

Example 33

A copying test was conducted in the same manner as in Example 17 except that the electrostatic latent image developing agent (27) was used in place of the electrostatic latent image developing agent (13), and the same evaluation was conducted.

The results are shown in Tables 4, 5 and 6.

Example 34

A copying test was conducted in the same manner as in Example 17 except that the electrostatic latent image developing agent (23) was used in place of the electrostatic latent image developing agent (13), and at the time of fixation, silicone oil was applied onto the fixing roll, and the same evaluation was conducted.

The results are shown in Tables 4, 5 and 6.

Example 35

A copying test was conducted in the same manner as in Example 17 except that the electrostatic latent image developing agent (24) was used in place of the electrostatic latent image developing agent (13), and the same evaluation was conducted.

The results are shown in Tables 4, 5 and 6.

Example 36

A copying test was conducted in the same manner as in Example 17 except that the electrostatic latent image developing agent (25) was used in place of the electrostatic latent image developing agent (13), and the same evaluation was conducted.

The results are shown in Tables 4, 5 and 6.

Example 37

A copying test was conducted in the same manner as in Example 17 except that the electrostatic latent image developing agent (26) was used in place of the electrostatic latent image developing agent (13), and the same evaluation was conducted.

The results are shown in Tables 4, 5 and 6.

Comarative Example 5

A copying test was conducted in the same manner as in Example 17 except that the transfer belt (8) was used in place of the transfer belt (1), and the same evaluation was conducted.

The results are shown in Tables 4, 5 and 6.

Comparative Example 6

A copying test was conducted in the same manner as in Example 17 except that the transfer belt (9) was used in place of the transfer belt (1), and the same evaluation was conducted.

The results are shown in Tables 4, 5 and 6.

Comparative Example 7

A copying test was conducted in the same manner as in Example 17 except that the electrostatic latent image developing agent (28) was used in place of the electrostatic latent image developing agent (13), and the same evaluation was conducted.

The results are shown in Tables 4, 5 and 6.

Comparative Example 8

A copying test was conducted in the same manner as in Example 17 except that the electrostatic latent image developing agent (29) was used in place of the electrostatic latent image developing agent (13), and the same evaluation was conducted.

The results are shown in Tables 4, 5 and 6.

Comparative Example 9

A copying test was conducted in the same manner as in Example 17 except that the electrostatic latent image developing agent (30) was used in place of the electrostatic latent image developing agent (13), and the same evaluation was conducted.

The results are shown in Tables 4, 5 and 6.

Comparative Example 10

A copying test was conducted in the same manner as in Example 17 except that the electrostatic latent image developing agent (31) was used in place of the electrostatic latent image developing agent (13), and the same evaluation was conducted.

The results are shown in Tables 4, 5 and 6.

TABLE 4

| | Developing agent | Intermediate transfer material | Vickers hardness | Shape factor SF1 | G'(160)(Pa) | Amount of additives (% by mass) | Ratio of particles ≧ 0.03 μm |
|---|---|---|---|---|---|---|---|
| Example 17 | (13) | (1) | 280HV0.30 | 126 | 410 | 1.3 | 0.25 |
| Example 18 | (14) | (1) | 280HV0.30 | 128 | 430 | 1.3 | 0.25 |
| Example 19 | (15) | (1) | 280HV0.30 | 130 | 390 | 1.3 | 0.25 |
| Example 20 | (16) | (1) | 280HV0.30 | 131 | 380 | 1.3 | 0.25 |
| Example 21 | (13) | (2) | 11HV0.30 | 126 | 410 | 1.3 | 0.25 |
| Example 22 | (13) | (3) | 910HV0.30 | 126 | 410 | 1.3 | 0.25 |
| Example 23 | (17) | (1) | 280HV0.30 | 137 | 510 | 1.8 | 0.36 |
| Example 24 | (18) | (1) | 280HV0.30 | 115 | 150 | 1.2 | 0.71 |
| Example 25 | (19) | (1) | 280HV0.30 | 133 | 590 | 1.3 | 0.25 |
| Example 26 | (20) | (1) | 28HV0.30 | 118 | 100 | 1.3 | 0.25 |
| Example 27 | (21) | (1) | 280HV0.30 | 126 | 410 | 1.1 | 0.92 |
| Example 28 | (22) | (1) | 280HV0.30 | 126 | 410 | 1.8 | 0.007 |
| Example 29 | (13) | (4) | 330HV0.30 | 126 | 410 | 1.3 | 0.25 |
| Example 30 | (13) | (5) | 610HV0.30 | 126 | 410 | 1.3 | 0.25 |
| Example 31 | (13) | (6) | 500HV0.30 | 126 | 410 | 1.3 | 0.25 |
| Example 32 | (13) | (7) | 140HV0.30 | 126 | 410 | 1.3 | 0.25 |
| Example 33 | (27) | (1) | 280HV0.30 | 137 | 510 | 1.9 | 0.19 |
| Example 34 | (23) | (1) | 280HV0.30 | 121 | 260 | 1.4 | 0.39 |
| Example 35 | (24) | (1) | 280HV0.30 | 129 | 450 | 0.77 | 0.33 |
| Example 36 | (25) | (1) | 280HV0.30 | 115 | 200 | 8.2 | 0.25 |
| Example 37 | (26) | (1) | 280HV0.30 | 122 | 500 | 1.4 | 0.26 |
| Comparative Example 5 | (13) | (8) | 2HV0.30 | 126 | 410 | 1.3 | 0.25 |
| Comparative Example 6 | (13) | (9) | 1170HV0.30 | 126 | 410 | 1.3 | 0.25 |
| Comparative Example 7 | (28) | (1) | 280HV0.30 | 151 | 550 | 2.0 | 0.35 |
| Comparative Example 8 | (29) | (1) | 280HV0.30 | 108 | 130 | 1.2 | 0.55 |
| Comparative Example 9 | (30) | (1) | 280HV0.30 | 136 | 820 | 1.3 | 0.25 |
| Comparative Example 10 | (31) | (1) | 280HV0.30 | 116 | 68 | 1.3 | 0.25 |

TABLE 5

| | Scratches on the surface of the intermediate transfer material | | | | Reproduction of thin lines | | | |
|---|---|---|---|---|---|---|---|---|
| | Initial copy | 10000th copy | 20000th copy | 30000th copy | Initial copy | 10000th copy | 20000th copy | 30000th copy |
| Example 17 | none | none | generated very slightly | generated very slightly | good | good | good | good |
| Example 18 | none | none | generated very slightly | generated very slightly | good | good | good | good |
| Example 19 | none | none | generated very slightly | generated very slightly | good | good | good | good |
| Example 20 | none | none | generated very | generated very | good | good | good | good |
| Example 21 | none | generated very slightly | generated slightly | generated slightly | good | good | deteriorated very slightly | deteriorated very slightly |
| Example 22 | none | none | none | generated very slightly | good | good | good | good |
| Example 23 | none | generated very slightly | generated very slightly | generated slightly | good | good | good | deteriorated very slightly |
| Example 24 | none | none | generated very slightly | generated very slightly | good | good | good | good |
| Example 25 | none | generated very slightly | generated very slightly | generated slightly | good | good | good | deteriorated very slightly |
| Example 26 | none | none | generated very slightly | generated very slightly | good | good | good | good |
| Example 27 | none | generated very slightly | generated slightly | generated slightly | good | good | deteriorated very slightly | deteriorated very slightly |
| Example 28 | none | none | none | generated very slightly | good | good | good | good |
| Example 29 | none | generated very slightly | generated very slightly | generated slightly | good | good | good | deteriorated very slightly |
| Example 30 | none | none | generated very slightly | generated very slightly | good | good | good | good |
| Example 31 | none | generated very slightly | generated very slightly | generated slightly | good | good | good | deteriorated very slightly |
| Example 32 | none | generated very slightly | generated very slightly | generated slightly | good | good | good | deteriorated very slightly |
| Example 33 | none | none | generated very slightly | generated very slightly | good | good | good | good |
| Example 34 | none | none | generated very slightly | generated very slightly | good | good | good | good |
| Example 35 | none | generated very slightly | generated very slightly | generated slightly | good | deteriorated very slightly | deteriorated very slightly | deteriorated slightly |
| Example 36 | none | generated very slightly | generated slightly | generated slightly | good | good | deteriorated very slightly | deteriorated very slightly |
| Example 37 | none | none | generated very slightly | generated very slightly | good | good | good | good |
| Comparative Example 5 | none | generated | generated | deteriorated | deteriorated slightly | deteriorated | deteriorated | deteriorated |
| Comparative Example 6 | none | none | none | generated very slightly | good | good | good | good |
| Comparative Example 7 | none | generated very slightly | generated slightly | generated | good | good | deteriorated very slightly | deteriorated slightly |
| Comparative Example 8 | none | Experiment was terminated | | | deteriorated | Experiment was terminated | | |
| Comparative Example 9 | none | generated slightly | generated | generated | good | deteriorated very slightly | deteriorated very slightly | deteriorated slightly |
| Comparative Example 10 | none | none | generated very slightly | generated very slightly | good | good | good | good |

TABLE 6

| | Uneven transfer | | | | Image density | | | |
|---|---|---|---|---|---|---|---|---|
| | Initial copy | 10000th copy | 20000th copy | 30000th copy | Initial copy | 10000th copy | 20000th copy | 30000th copy |
| Example 17 | none | none | none | none | good | good | good | good |
| Example 18 | none | none | none | none | good | good | good | good |
| Example 19 | none | none | none | none | good | good | good | good |
| Example 20 | none | none | none | none | good | good | good | good |
| Example 21 | none | none | none | none | good | good | good | good |
| Example 22 | none | generated very slightly | generated very slightly | generated slightly | good | good | good | generated slightly |
| Example 23 | none | none | none | generated very slightly | good | good | good | good |

TABLE 6-continued

| | Uneven transfer | | | | Image density | | | |
|---|---|---|---|---|---|---|---|---|
| | Initial copy | 10000th copy | 20000th copy | 30000th copy | Initial copy | 10000th copy | 20000th copy | 30000th copy |
| Example 24 | none | none | none | generated very slightly | good | good | good | good |
| Example 25 | none | none | none | generated very slightly | good | good | good | good |
| Example 26 | none | none | none | generated very slightly | good | good | good | good |
| Example 27 | none | none | generated very slightly | generated very slightly | good | good | good | good |
| Example 28 | none | none | generated very slightly | generated very slightly | good | good | good | generated slightly |
| Example 29 | none | none | generated very slightly | generated slightly | good | good | good | generated slightly |
| Example 30 | none | none | generated very slightly | generated very slightly | good | good | good | good |
| Example 31 | none | none | generated very slightly | generated very slightly | good | good | good | good |
| Example 32 | none | none | generated very slightly | generated very slightly | good | good | good | good |
| Example 33 | none | none | none | generated very slightly | good | good | good | good |
| Example 34 | none | none | none | generated very slightly | good | good | good | good |
| Example 35 | none | none | none | none | good | good | good | good |
| Example 36 | none | generated very slightly | generated very slightly | generated slightly | good | good | good | generated slightly |
| Example 37 | none | none | generated very slightly | generated very slightly | good | good | good | good |
| Comparative Example 5 | none | none | generated slightly | generated slightly | good | good | generated slightly | generated slightly |
| Comparative Example 6 | generated | generated | generated | generated | lowered | lowered | lowered | lowered |
| Comparative Example 7 | none | generated very slightly | generated very slightly | generated slightly | good | lowered very slightly | lowered slightly | lowered |
| Comparative Example 8 | cannot be evaluated | Experiment was terminated | | | lowered | Experiment was terminated | | |
| Comparative Example 9 | none | generated very slightly | generated slightly | generated | good | lowered very slightly | lowered slightly | lowered |
| Comparative Example 10 | none | generated slightly | generated | generated | good | lowered slightly | lowered | lowered |

As is evident from the results in Tables 4, 5 and 6, when the toner in the invention was used, an excellent image forming method superior in reproduction of fine lines with less abrasion and scratching on the surface of the transfer belt, less uneven transfer and less reduction in image density, can be provided.

On one hand, in Comparative Examples 5 and 7, numberless scratches were recognized on the surface of the transfer belt, and the deterioration in reproduction of thin lines caused by deterioration in the performance of the transfer belt was observed. It is estimated that scratches are caused by the external additives on the surface of the intermediate transfer material upon collision of the toner with the surface of the transfer belt, resulting in uneven transfer current at the time of primary and secondary transfer. Further, in Comparative Example 6, the initial copy showed uneven transfer accompanying uneven contact between the surface of the photoreceptor and the intermediate transfer material and/or the intermediate transfer material and the recording medium. In Comparative Example 8, cleaning insufficiency occurred in the initial copy, and thus the experiment was terminated. In Comparative Example 9, uneven transfer accompanying scratches on the surface of the intermediate transfer material and reduction in the density of the image due to the scratches was confirmed. In Comparative Example 10, the breakage of the toner was observed in the development device. Thus, it is estimated that the toner became spent on the surface of the carrier, and as the charging was reduced, the substantially developed toner was reduced, thus causing background fogging and lower density.

As can be seen from the foregoing, the effect of the invention cannot be achieved in Comparative Examples 5 to 10.

According to the invention, the shape factor of a toner prepared by polymerizing vinyl monomers and the storage of elastic modulus at 160° C. are regulated in an electrophotographic process, whereby the scratching of the surface of the photoreceptor caused by residual metal oxides and/or metal nitrides as external additives on the surface of the toner, which are caused by collision of the toner with the photoreceptor etc. at the time of development, can be prevented, and the deterioration in the performance of the photoreceptor etc. caused by repeated abrasion and oxidation of the surface of the photoreceptor etc. can be prevented. Accordingly, there can be provided an excellent image forming method with less image deterioration even in producing a large number of copies.

What is claimed is:

1. An image forming method comprising a step of developing an electrostatic latent image formed on an electrophotographic photoreceptor with a toner for electrostatic latent image development containing a binder resin and a colorant, wherein a surface of the electrophotographic photoreceptor contains a compound having an unsaturated double bond, a surface of the toner for electrostatic latent image development has at least one kind of particles selected from metal oxide particles and metal nitride particles, and the toner for electrostatic latent image development has a SF-1 shape factor of 110 to 140 and contains a binder resin obtained by polymerizing a polymerizable monomer having a vinyl double bond, and a storage of elastic modulus at 160° C. (G'(160)) of the toner for electrostatic latent image development is in the following range:

$$80\ \text{Pa} \leqq G'(160) \leqq 620\ \text{Pa};\ \text{and}$$

wherein a total amount of the metal oxide particles and/or metal nitride particles added is 0.1 to 10% by mass relative to the toner, and the ratio of metal oxide particles and/or metal nitride particles having a particle size of no more than 0.03 μm relative to the total amount of the metal oxide particles and/or metal nitride particles is in the following range:

$$0.01 \leqq (\text{amount of particles having a particle size of } 0.03\ \mu\text{m or less})/(\text{total amount of metal oxide particles and/or metal nitride particles}) \leqq 0.8.$$

2. An image forming method according to claim 1, wherein the toner for electrostatic latent image development comprises colored toner particles prepared by mixing a resin particle dispersion having resin particles with a particle size of no more than 1 μm dispersed therein with a colorant dispersion having a colorant dispersed therein, aggregating the resin particles and the colorant to form aggregated toner particles, and coalescing the resulting aggregated particles by heating to a temperature that is higher than a glass transition temperature of the resin.

3. An image forming method according to claim 1, wherein the toner for electrostatic latent image development further comprises at least one kind of releasing agent.

4. An image forming method according to claim 3, wherein a content of the releasing agent contained in the toner for electrostatic latent image development is 0.5 to 50% by mass.

5. An image forming method according to claim 1, wherein an average particle diameter of the toner for electrostatic latent image development is 3 to 9 μm.

6. An image forming method according to claim 1, wherein a particle-size distribution of the toner for electrostatic latent image development is no more than 1.3.

7. An image forming method according to claim 1, wherein the polymerizable monomer having a vinyl double bond has a carboxyl group.

8. An image forming method according to claim 1, wherein the compound having an unsaturated double bond on the surface of the electrophotographic photoreceptor has at least one kind of structure shown in the formulae (1) to (5):

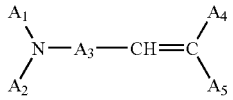

(2)

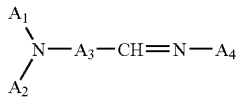

(3)

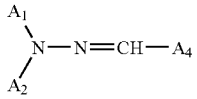

(4)

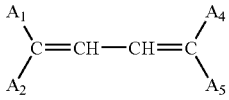

(5)

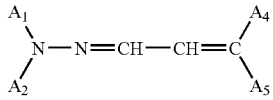

wherein $A_1$, $A_2$, $A_4$ and $A_5$ each independently represent a hydrogen atom, a $C_{1-6}$ alkyl group, an alkenyl group, a halogen atom, a methoxy group, an ethoxy group, a phenyl group, a naphthyl group, an anthracenyl group, a phenanthryl group, a pyrenyl group, a perylenyl group, a naphthcenyl group, a biphenyl group, a benzyl group, a pyridyl group or a carbazolyl group, each of which may have a substituent, and $A_3$ represents an alkylene group which may have a substituent.

9. An image forming method according to claim 8, wherein the electrophotographic photoreceptor further comprises an antioxidant.

10. An image forming method according to claim 8, wherein the compound having an unsaturated double bond on the surface of the electrophotographic photoreceptor is a charge transporting material.

11. An image forming method according to claim 10, wherein a ratio by mass of the charge transporting material relative to the binder resin (charge transporting material/binder resin) in a charge transporting layer is 0.08 to 6.

12. An image forming method according to claim 8, wherein a thickness of a charge generating layer included in the electrophotographic photoreceptor is 0.1 to 10 μm.

13. An image forming method according to claim 8, wherein a thickness of a charge transporting layer included in the electrophotographic photoreceptor is 5 to 30 μm.

14. An image forming method comprising at least the steps of:

forming an electrostatic latent image on a surface of an electrostatic latent image bearing body;

developing the electrostatic latent image with a toner for electrostatic latent image development containing a binder resin and a colorant to form a toner image; and transferring the toner image onto a surface of a transfer material, and thermally fixing the toner image, wherein the surface of the electrostatic latent image bearing body comprises a compound having an unsaturated double bond; the toner for electrostatic latent image development comprises a binder resin obtained by polymerizing a polymerizable monomer having a vinyl double bond, has at least one kind of particles selected from metal oxide particles and metal nitride particles on a surface of the toner, and has a shape factor SF1 of 110 to 140; and a storage of elastic modulus at 160° C. (G'(160)) of the toner for electrostatic latent image development is in the following range:

$$150\ \text{Pa} \leqq G'(160) \leqq 620\ \text{Pa};\ \text{and}$$

wherein a total amount of the metal oxide particles and/or metal nitride particles added is 0.1 to 10% by mass relative to the toner, and the ratio of metal oxide particles and/or metal nitride particles having a particle size of no more than 0.03 μm relative to the total amount of the metal oxide particles and/or metal nitride particles is in the following range:

$$0.01 \leqq (\text{amount of particles having a particle size of } 0.03\ \mu\text{m or less})/(\text{total amount of metal oxide particles and/or metal nitride particles}) \leqq 0.8.$$

15. An image forming method according to claim 14, wherein a Vickers hardness of the surface of the transfer material is 5HV.0.30 to 1000HV.0.30.

16. An image forming method according to claim 14, wherein the transfer material has a multi-layered structure.

17. An image forming method according to claim 14, wherein the transfer material comprises inorganic fillers.

18. An image forming method according to claim 14, wherein the surface of the transfer material further comprises a compound having a functional group containing a fluorine atom.

19. An image forming method according to claim 14, wherein the surface of the transfer material further comprises a silicone material.

* * * * *